US012241255B2

(12) United States Patent
Hatzinikolas et al.

(10) Patent No.: US 12,241,255 B2
(45) Date of Patent: Mar. 4, 2025

(54) SUPPORT BRACKET APPARATUS

(71) Applicant: Fero Corporation, Edmonton (CA)

(72) Inventors: Michael Hatzinikolas, Edmonton (CA); Andrea Hatzinikolas, Edmonton (CA)

(73) Assignee: Fero Corporation, Edmonton (CA)

( * ) Notice: Subject to any disclaimer, the term of this patent is extended or adjusted under 35 U.S.C. 154(b) by 315 days.

(21) Appl. No.: 17/576,839

(22) Filed: Jan. 14, 2022

(65) Prior Publication Data

US 2022/0205251 A1 Jun. 30, 2022

Related U.S. Application Data

(63) Continuation of application No. 16/700,868, filed on Dec. 2, 2019, now Pat. No. 11,255,091.

(60) Provisional application No. 62/942,401, filed on Dec. 2, 2019, provisional application No. 62/774,535, filed on Dec. 3, 2018.

(51) Int. Cl.
*E04F 13/08* (2006.01)
*E04B 1/38* (2006.01)

(52) U.S. Cl.
CPC .... *E04F 13/0853* (2013.01); *E04B 2001/389* (2023.08)

(58) Field of Classification Search
CPC ..... E04F 13/0853; E04B 2001/389
See application file for complete search history.

(56) References Cited

U.S. PATENT DOCUMENTS 1,455,712 A 5/1923 Collins
1,697,003 A 11/1927 Fink
1,729,935 A 10/1929 Froehlich
1,764,134 A 6/1930 Young et al.
2,363,156 A 6/1943 Sinner et al.
3,050,160 A 8/1962 Chesser et al.
3,234,702 A 2/1966 Zibell
(Continued)

FOREIGN PATENT DOCUMENTS

CA 2526876 A 2/2006
DE 3128246 A1 2/1983
(Continued)

OTHER PUBLICATIONS

International Search Report & Written Opinion dated Mar. 12, 2020 for PCT/CA2019/051727.

*Primary Examiner* — Andrew J Triggs
(74) *Attorney, Agent, or Firm* — Smart & Biggar LP

(57) ABSTRACT

An assembly supports external masonry veneer. A bracket mounts to a load bearing wall support structure. A shelf angle has a horizontal leg that defines a shelf for the veneer, and an upstanding leg supported by mounting brackets that secure the assembly to the wall structure. The horizontal shelf is segmented. The back of the shelf angle flexes between the segments to allow the shelf angle to follow the shape of a curve wall. The shelf angle is secured to the mounting brackets with locking clips. The mounting brackets may be channels. They may have lower abutments. The abutments may extend rearwardly. An insulator may be placed between the back and structure. The mounting bracket may have lightening holes. The lightening holes may be in a framework array including alternating diagonal struts. A low thermal conductivity coating may be applied to the bracket.

14 Claims, 40 Drawing Sheets

(56) References Cited

U.S. PATENT DOCUMENTS

| | | | | |
|---|---|---|---|---|
| 3,293,810 | A | 12/1966 | Cox | |
| 3,341,909 | A | 9/1967 | Havener | |
| 3,414,224 | A | 12/1968 | Robillard et al. | |
| 3,450,427 | A | 6/1969 | Fischer et al. | |
| 3,666,303 | A | 5/1972 | Huls | |
| 3,680,271 | A | 8/1972 | Satchell | |
| 3,730,466 | A | 5/1973 | Swanquist | |
| 3,942,292 | A | 3/1976 | Robinson | |
| 4,013,253 | A | 3/1977 | Perrault et al. | |
| 4,094,415 | A | 6/1978 | Larson | |
| 4,390,103 | A | 6/1983 | Husband | |
| 4,422,610 | A | 12/1983 | Hunt | |
| 4,429,850 | A | 2/1984 | Weber et al. | |
| 4,447,961 | A | 5/1984 | Valat | |
| 4,515,494 | A | 5/1985 | Robilliard et al. | |
| 4,805,364 | A | 2/1989 | Smolik | |
| 4,827,684 | A | 5/1989 | Allan | |
| 4,869,043 | A | 9/1989 | Hatzinikolas et al. | |
| 4,872,567 | A | 10/1989 | Bustos | |
| D311,858 | S | 11/1990 | Richmond | |
| 5,018,323 | A | 5/1991 | Clausen | |
| 5,035,099 | A | 7/1991 | Lapish | |
| 5,063,715 | A | 11/1991 | Goodman | |
| 5,082,388 | A | 1/1992 | Lauterbach | |
| 5,212,917 | A * | 5/1993 | Kurtz | A01G 9/28 47/33 |
| 5,265,396 | A | 11/1993 | Amimoto | |
| 5,313,752 | A | 5/1994 | Hatzinikolas | |
| 5,392,581 | A | 2/1995 | Hatzinikolas et al. | |
| 5,405,116 | A | 4/1995 | Shepherd et al. | |
| 5,456,435 | A | 10/1995 | Sweeney | |
| 5,588,537 | A | 12/1996 | Hagopian | |
| 5,619,834 | A | 4/1997 | Chen | |
| 5,694,736 | A | 12/1997 | Saether et al. | |
| 5,794,902 | A | 8/1998 | Henry | |
| 5,816,008 | A | 10/1998 | Hohmann | |
| 6,098,942 | A | 8/2000 | Heath | |
| 6,128,883 | A | 10/2000 | Hatzinikolas | |
| 6,161,709 | A | 12/2000 | Kluge et al. | |
| 6,298,620 | B1 | 10/2001 | Hatzinikolas | |
| 6,379,078 | B1 * | 4/2002 | Zwier | E01C 11/08 404/4 |
| 6,568,126 | B2 * | 5/2003 | Womack | E02B 3/04 47/33 |
| 6,584,741 | B1 | 7/2003 | Hatzinikolas | |
| 6,817,688 | B2 | 11/2004 | O'Halloran | |
| 6,848,224 | B2 | 2/2005 | Bailey | |
| 6,883,284 | B1 | 4/2005 | Burgunder | |
| 6,973,756 | B2 | 12/2005 | Hatzinikolas | |
| 7,367,165 | B2 | 5/2008 | Hatzinikolas | |
| 7,392,911 | B2 | 7/2008 | Stitchick et al. | |
| 7,415,803 | B2 | 8/2008 | Bronner | |
| 7,469,659 | B2 | 12/2008 | de Jonge et al. | |
| 7,614,590 | B2 | 11/2009 | Boville | |
| 7,654,058 | B2 | 2/2010 | Hatzinikolas | |
| 7,765,771 | B2 | 8/2010 | Serpico et al. | |
| 7,908,804 | B2 | 3/2011 | Vieira | |
| 8,051,621 | B2 | 11/2011 | Hatzinikolas | |
| 8,250,827 | B2 | 8/2012 | Lin et al. | |
| 8,333,048 | B2 | 12/2012 | Talpe | |
| 8,490,340 | B2 | 7/2013 | Hatzinikolas | |
| 8,490,341 | B2 | 7/2013 | Hatzinikolas | |
| 8,555,595 | B2 | 10/2013 | Hatzinikolas | |
| 8,621,802 | B2 | 1/2014 | Spyrou | |
| 8,667,763 | B2 | 3/2014 | Hatzinikolas | |
| 8,893,452 | B2 | 11/2014 | Hatzinikolas | |
| 8,955,263 | B2 | 2/2015 | Hatzinikolas | |
| 9,010,050 | B2 | 4/2015 | Hatzinikolas | |
| 9,010,062 | B2 | 4/2015 | Hill | |
| 9,027,301 | B2 | 5/2015 | Guinn | |
| 9,316,004 | B1 | 4/2016 | Hatzinikolas | |
| 10,294,676 | B2 | 5/2019 | Hatzinikolas | |
| 10,323,419 | B2 | 6/2019 | Hatzinikolas | |
| 11,255,091 | B2 * | 2/2022 | Hatzinikolas | E04F 13/142 |
| 2003/0177714 | A1 * | 9/2003 | Bailey | E04G 21/1866 52/204.2 |
| 2006/0156682 | A1 | 7/2006 | McAndrew et al. | |
| 2006/0272251 | A1 | 12/2006 | Hatzinikolas | |
| 2010/0287864 | A1 | 11/2010 | Hatzinikolas | |
| 2011/0107711 | A1 | 5/2011 | Foley | |
| 2014/0174014 | A1 | 6/2014 | Hatzinikolas | |
| 2014/0190110 | A1 | 7/2014 | Hatzinikolas | |
| 2015/0059259 | A1 | 3/2015 | Hatzinikolas | |
| 2018/0298577 | A1 | 10/2018 | Morey | |
| 2020/0190814 | A1 | 6/2020 | Hatzinikolas | |
| 2022/0205251 | A1 * | 6/2022 | Hatzinikolas | E04F 13/09 |

FOREIGN PATENT DOCUMENTS

| | | | |
|---|---|---|---|
| EP | 1375777 | A1 | 1/2004 |
| GB | 2417039 | A1 | 2/2006 |

* cited by examiner 552
680
636
632
92
656
658
622
624
646
622
648
624
682
628
532
540
552
642
530
546
544
524
556
542

670
614
602
408
604
606
672
612
436
438
434
610
458
608
618
616
436
434
608

H164
℄ 164
148
144
146
140
142
56
150
660
170
662
172
184
182
180
168
H166
152
162
166
℄

SUPPORT BRACKET APPARATUS

This application claims the benefit of priority as a continuation of U.S. patent application Ser. No. 16/700,868 filed Dec. 2, 2019 which itself claimed the priority of U.S. Provisional Patent Application 62/774,535 filed Dec. 3, 2018, and U.S. Provisional Patent Application 62/942,401 filed Dec. 2, 2019, the specification and drawings of all of them being incorporated herein by reference.

FIELD OF INVENTION

This specification relates to structural materials for use in the construction of buildings, and, in one particular context, to support structure external veneer components.

BACKGROUND OF THE INVENTION

In former times, brick walls were load bearing structures. In contemporary building structures bricks, or other masonry elements, or other visible finished surface elements, are rarely load-bearing. They tend more often to be employed as surface cladding on the exterior face of load-bearing structure as a masonry veneer.

When mounting face brick or stone veneer on the face of a wall structure, the first row of bricks or stone, or veneer commonly fits on a steel support. The steel support may be termed a shelf angle, and may extend outward from the wall structure, and may run along, or have a major dimension extending in, a direction that is generally horizontal and cross-wise to the wall. The steel support is mounted to the wall before brick-laying commences. The steel support may be welded to a steel anchoring system embedded in the wall.

Alternatively, the steel support may be carried in spaced apart brackets that have themselves been mounted to the load bearing wall structure. This become more problematic where the wall is not planar, but curved or rectangular, and where the wall is interrupted by interruptions and boundary conditions such as corners, doors, windows, and so on.

SUMMARY OF INVENTION

In an aspect of the invention there is a shelf angle. It has a web and a flange extending away from the web. The flange is segmented to permit bending of the web.

In a feature of that aspect of the invention, the web is continuous and the flange is discontinuous. In another feature, the flange includes at least a first segment and a second segment. The first and second segments are side-by-side. The flange has a notch formed therein between the first and second segments. In another feature, prior to bending of the web, the notch terminates inwardly at the web at a narrow end, and the notch broadens outwardly away from the narrow end. In a further feature, the flange includes a plurality of segments of the flange. Each segment of the plurality of segments has a broad end adjoining the web, and a narrow end most distant from the web, each segment being trapezoidal in plan view. In a further feature, the web is mounted to run on a continuous curve when seen in plan view, and the segmented flange has a plurality of feet defining segments of the flange, the feet defining a discontinuous path of shelf supports alongside the web. In another further feature, the seat is smaller in the lengthwise direction than (a) half a brick (b) ¼ of the arc length pitch spacing of the web between centers of adjacent segments of the flange. In another feature, the web has apertures formed therethrough. In a further feature, the web has apertures formed therein in which to admit mounting support fittings. The mounting support fittings are spaced along the web lengthwise. The flange has notches formed therein. The notches are spaced along the shelf angle. The apertures in the web are staggered from the notches in the flange. In another feature, a pair of first and second notches is associated with a first segment of the flange, and one of the apertures is centered relative to the first segment.

In another aspect of the invention there is a shelf angle assembly. It has a shelf angle; at least a first mounting bracket, and a retainer. The shelf angle has a web and a flange. The flange defines a surface upon which to mount masonry veneer. The web extends out-of-plane relative to the flange. The mounting bracket has a first portion and a second portion. The first portion defines a back. The back has a mounting fitting by which to secure the mounting bracket to primary structure. The second portion includes a leg that extends away from the mounting fitting. The leg has a shelf angle seat defined therein distant from the first portion. The shelf angle seat includes at least a vertical load transfer interface and a moment couple transfer interface. The retainer, when installed, immobilises the web of the shelf angle relative to the moment couple transfer interface of the second portion of the first mounting bracket.

In a feature of that aspect, the shelf angle seat of the mounting bracket admits installation of the shelf angle in front-to-rear motion thereof relative to the back of the first mounting bracket; and, when installed, the retainer inhibiting rear-to-front retreat of the shelf angle. In another feature, the shelf angle includes an aperture formed in the web thereof. The shelf angle seat includes a toe that occupies the aperture on installation. The toe includes the vertical load transfer interface. In another feature, the mounting bracket includes a transom distant from the back, and, on installation, the retainer secures the web of the shelf angle relative to the transom. in still another feature, the flange of the shelf angle includes a plurality of feet on which to support masonry veneer; the web is flexible between adjacent segments of the feet.

In another feature, the assembly includes at least a first, a second, and a third of the mounting brackets by which the assembly is mounted to a supporting primary structure. The flange of the shelf angle includes at least a first segment, a second segment, and a third segment. The flange of the shelf angle is notched between the segments, the notches facilitating bending of the web of the shelf angle adjacent to the notches; and, on installation. The shelf angle is mounted to the mounting brackets with the first segment of the shelf angle standing outwardly of the first mounting bracket. The second segment of the shelf angle stands outwardly of the second mounting bracket. The third segment of the shelf angle is mounted outwardly of the third mounting bracket. The first, second, and third mounting brackets is mounted non-co-linearly to the primary structure.

In another aspect of the invention, there is a shelf angle assembly. It has a mounting bracket, a shelf angle segment, and a retainer. The mounting bracket has a back and a pair of first and second legs extending away from the back to form a channel section. Each of the legs has a profile distant from the back, the profile defining a shelf angle seat. The back of the mounting bracket has a mounting fitting by which to secure the mounting bracket to supporting structure. The shelf angle has a first leg and a second leg joined at an angle. The first leg defines a shelf on which to carry masonry veneer. The second leg defines an upstanding web. The upstanding web and the shelf angle seats are mutually engageable. The retainer is movably engageable with the mounting bracket and the shelf angle to lock the shelf angle in place after the shelf angle has been positioned in engagement with the seats of the mounting bracket.

In a feature of that aspect, the first and second legs of the shelf angle meet at a right angle. The right angle has an internal radius. The mounting bracket has a retainer anchor seat. The retainer is a retainer clip has and anchor and a grip. On installation the anchor engages the anchor seat and the grip engages the web of the shelf angle. The retainer clip captures the shelf angle in the shelf angle seats. In another feature, the retainer clip is U-shaped in section. The anchor is defined by a first leg of the U-shape. The grip is defined by a second leg of the U-shape that is opposed to the first leg thereof. The shelf angle is movably engageable into the shelf angle seats in a first direction of motion. The retainer clip is slidably movable into engagement in a second direction of motion. The second direction of motion is cross-wise to the first direction of motion. When slid into place, the retainer clip prevents retraction of the shelf angle from engagement with the mounting bracket. In another feature, the first and second legs of the mounting bracket have apertures formed therein adjacent to the respective shelf angle seats. In still another feature, the first leg of the shelf angle is tapered when seen in plan view. The first leg has a root proximate to the second leg of the shelf angle. A distal margin is distant from the second leg of the shelf angle. The distal margin is narrower than the root. In another feature, the mounting bracket is more than three times as tall as the shelf angle. In a further feature, at least the mounting bracket has a low thermal conductivity coating.

In another aspect of the invention, there is a masonry veneer supporting shelf angle assembly that is securable to wall structure. It has a mounting bracket; a shelf angle; and a retainer. The mounting bracket has a wall mounting fitting and a shelf angle seat distant from the wall mounting fitting defining an accommodation. The shelf angle has a first member defining a shelf upon which to mount masonry veneer, and a second member defining a back connected to the shelf, the shelf angle is mateable with the seat. When the shelf angle is mated to the seat, the retainer has a first portion that engages the mounting bracket and a second portion that engages the shelf angle, and, when so engaged, the shelf angle is captured in the accommodation by the retainer.

In a feature of that aspect, the first member defines a horizontal flange of the shelf angle, and the second member defines a vertical web of the shelf angle. In another feature, the mounting bracket is formed of a channel that has a back and a pair of first and second legs extending away from the back. The first and second legs each have a respective the seat, and the back includes the wall mounting fitting. in a further feature, the shelf angle is positionable in the seat in linear translation, and when installed, the retainer obstructs removal of the shelf angle from the seat. In still another feature, the shelf angle is movable into the seat in a first degree of freedom of motion. The retainer is installed in a second degree of freedom of motion independent of the first degree of freedom of motion. In a further feature, the first degree of freedom of motion is lateral translation toward the wall structure. In still another feature, the second degree of freedom of motion is at least predominantly vertical translation of the retainer relative to the mounting bracket and the shelf angle. In another feature, the mounting bracket seat includes a vertical shear load transfer interface at which a vertical shear load of the shelf angle is carried into the mounting bracket. In a yet further feature, the retainer defines a moment couple reaction interface at which an overturning moment from the shelf angle is opposed by the retainer. In a further feature, the seat has a horizontal projection toward the wall structure, and the mounting fitting is located upwardly outside the projection. In yet another feature, the mounting fitting has a center of force that is more than two seat pitches above the horizontal projection. In an additional feature, the shelf angle supports bricks, and the mounting fitting has a center of reaction force that is more than two brick pitches above the projection. In another feature, the mounting bracket is formed from a channel member, the channel member has a back and a pair of first and second legs extending away from the back, and the legs have lightening apertures formed therein. In an additional feature, the apertures are non-circular, have a major axis and a minor axis, and the major axis is angled relative to vertical, the major axis extending upwardly on an angle toward the wall structure. In another feature, the assembly further includes a layer of thermal insulation has a thickness, and the seat is spaced from the fitting by a distance at least as great as the thickness of the thermal insulation. In yet another feature, the shelf angle has a segmented flange. In a still further additional feature, the shelf angle has at least one of: (a) an array of apertures formed therein that reduces thermal conductivity between the wall structure and the shelf angle; and (b) a low thermal conductivity coating.

In another aspect, there is a shelf angle. It has an upstanding web and a flange array joined to, and extending away from, the upstanding web. The flange array runs along the web and presents a plurality of shelf segments upon which to place masonry. The shelf segments lie on a common path. The web is bendable to permit angular displacement of at least a first of the plurality of shelf segments relative to a second of the shelf segments.

In another aspect there is a segmented shelf angle. It has at least a first segment and a second segment; and an upstanding web that is common to both the first segment and the second segment. The upstanding web joins the first and second segments at a neck. The neck is bendable.

In a feature of those aspects, each segment has a second moment of area, $I_{yy}$, for resistance to bending about a vertical axis. The neck has a second moment of area, $I_{yy}$, that is less than the respective second moments of area $I_{yy}$ of the first and second segments. in another feature, each of the first and second segments has a first member defining a shelf upon which to mount masonry veneer. A second member defines the respective upstanding back of the segments. The backs of the first and second segments are portions of the upstanding web of the shelf angle. The neck connects the respective backs of the first and second segments. In another feature, the second moments of area relative to bending about a vertical axis of each of the first and second segments have a respective neutral axis that lies forwardly of the back of the respective first and second segments. The neck has a height and a through thickness. The neutral axis of the second moment of area of the neck relative to bending about a vertical axis lies within the through thickness of the neck.

In another aspect, there is a shelf angle assembly for supporting masonry veneer. It has a shelf angle, at least a first mounting bracket and a second mounting bracket, and at least a first retainer and a second retainer. The shelf angle seats on, and transmits vertical loads into, the first and second mounting brackets. As installed, the first and second retainers lock the shelf angle against rotation relative to the respective mounting brackets.

In a feature of that aspect, each of the first and second mounting brackets has a shelf angle seat in which to receive a portion of the shelf angle. As assembled, the first and second mounting brackets are spaced apart from each other along the shelf angle. The first and second retainers are first and second mounting clips. Each the mounting clip has a first portion that anchors to the respective mounting bracket, and a second portion that captures the shelf angle. In another feature, the shelf angle has a first member defining a shelf on which to mount masonry veneer, and a second member defining a back. The back and the shelf form an angle. The second portion of the respective clips engage the back of the shelf angle. In another feature, the first and second mounting clips have the form of U-shaped channels. The first portion of the respective clips is a first leg of the U-shape, and the second portion of the clip is a second leg of the U-shape. In another feature, the first retainer is slidingly insertable to lock the shelf angle relative to the first mounting bracket.

In another aspect, there is a masonry veneer mounting assembly. It has a shelf angle and an array of mounting brackets that includes at least a first mounting bracket and a second mounting bracket to which the shelf angle mounts. At least one of (a) the shelf angle and (b) the first mounting bracket, has a thermal insulation coating.

In a feature of that aspect, the thermal insulation coating forms a thermal conduction break between the shelf angle and the first mounting bracket. In another feature, the thermal insulation coating forms a thermal conduction break between the first mounting bracket and supporting structure to which the first mounting bracket is secured. In still another feature, there is a first thermal insulation coating portion that forms a first thermal conduction resistance between the shelf angle and the first mounting bracket, and a second thermal insulation portion coating that forms a second thermal conduction resistance between the first mounting bracket and supporting structure to which the first mounting bracket is secured. In still another feature, at least one of the first mounting bracket and the second mounting bracket is coated overall in a thermal insulation coating. in another feature, the first mounting bracket and the shelf angle are each provided with a respective the thermal insulation coating. In an additional feature, the thermal insulation coating is an aerogel coating. In another additional feature, the mounting assembly includes at least a first retainer clip. The retainer clip is treated with a thermal insulation coating to form at least one thermal conduction resistance between the first mounting bracket and the shelf angle. In a further feature, the entire clip is covered in a thermal insulation coating. In still another feature, the thermal insulation coating is an aerogel coating.

In another aspect of the invention, there is a mounting assembly for mounting masonry to supporting structure with the masonry spaced away from the supporting structure. The mounting assembly has a shelf angle; a first mounting member; and a second mounting member. The shelf angle is segmented to permit flexing to conform to non-planar supporting structure. The first and second mounting members are spaced laterally apart from each other along the non-planar supporting structure. The shelf angle has a vertical leg and a horizontal leg. The shelf angle has a length running laterally to span the first and second mounting members. The horizontal leg defines a shelf for the masonry. The horizontal leg extends forwardly of the vertical leg. The first and second mounting members extend rearwardly of the vertical leg. Each of the first and second mounting members has a respective web that stands away from the supporting structure, whereby the shelf angle is spaced forwardly away from the supporting structure. Each of the first and second mounting members has an upper region and a lower region. The shelf angle extends forwardly away from the respective lower regions of the first and second mounting members. The respective upper regions of the first and second mounting members each has a support attachment fitting for securement to the supporting structure. The respective support attachment fittings is higher than the vertical leg of the shelf angle.

In a feature, the first member has a vertical load input interface between the second member and the first member. There is a vertical load output interface at which the first member is connected to load bearing structure. A line of action is defined between the input and output interfaces. The line of action has a Rise/Run where the Rise is greater than the Run. In another feature, the first member has a vertical height that is one of (a) greater than two courses of face brick; and (b) in a range of 2 to 15 pitches of seat height of the vertical leg of the shelf angle. In another feature, the shelf angle has a segmented veneer support flange. Segments of the flange are separated by a respective notch therebetween. Each respective notch is shorter than a lengthwise pitch of a brick of the masonry veneer. In a further feature, the lower region of the first member has a rearwardly facing horizontal reaction interface for engagement with the support structure. In a still further feature, the first member has a seat defined in the web thereof, and the shelf angle is removably mounted therein. In a yet further feature, the attachment fitting accommodates vertical adjustment of the first member relative to the support structure. In still yet another feature, the attachment fitting accommodates a mechanical fastener by which the mounting assembly is secured to the support structure. In another feature, the vertical leg of the shelf angle is mounted to the respective webs of the first and second members. In another feature, the web extends upwardly away from the vertical leg of the shelf angle. In still another feature, a horizontal projection of the shelf angle that extends toward the load-bearing wall structure projects downwardly clear of the attachment fitting. In another feature, the first member has a lowermost margin that is flush with the shelf angle. In still another feature, the web of the first member has a profiled seat formed therein, and the shelf angle nests in the seat. In yet another feature, the shelf angle has at least one accommodation formed therein, and the web of the first member has a protrusion that seats in the at least one accommodation. In a further feature, the web of the first member has a seat formed therein; the shelf angle has at least one accommodation formed therein. The web of the first member has a protrusion that engages the accommodation. The shelf angle nests in the seat. In still another feature, thermal insulation is mounted between the shelf angle and the support structure. In another feature, the first member has a back, the web and the back of the first member meet such that the back forms a flange relative to the web. The first member runs vertically, the attachment fitting is formed in the back.

In another feature, the first member has a vertically running channel section. The channel section includes a back bounded by first and second legs. The web is the first leg. The second leg is a web the same as the first leg and spaced therefrom. The attachment fitting is formed in the back. The shelf angle is mounted to the legs distant from the back. in another feature, the first member has a vertical height that is greater than two pitches of face brick. The attachment fitting accommodates a mechanical fastener by which the mounting assembly is secured to the support structure. The vertical leg of the shelf angle is mounted to the respective webs of the first and second members. The web of the first member extends upwardly away from the vertical leg of the shelf angle. The first member is concealed behind the shelf angle. Insulation is mounted between the shelf angle and the support structure. In another feature, each of the first and second members has a back and a pair of first and second legs. The pair of first and second legs is joined to, and extend away from, the back. The web is the first leg. The second leg is a second web spaced from the first leg. The attachment fitting is formed in the back. The vertical leg of the shelf angle is mated to the pair of first and second legs of the first and second members. The attachment fitting accommodates a mechanical fastener by which the mounting assembly is secured to the support structure. The respective webs extends upwardly to a greater height than the vertical leg of the shelf angle. The first member and the second member are concealed behind the shelf angle. In another feature, the attachment fitting accommodates vertical adjustment of the first member relative to the support structure. The first member has a lowermost margin that is flush with the shelf angle. Insulation is mounted between the vertical leg of the shelf angle and the support structure.

In another aspect of the invention, there is a mounting assembly for mounting masonry to supporting structure with the masonry spaced away from the supporting structure.

The mounting assembly has a shelf angle; a first mounting member; and a second mounting member. The first and second mounting members are spaced laterally apart from each other. The shelf angle has a vertical leg and a horizontal leg. The shelf angle has a length running laterally to span the first and second mounting members. The horizontal leg defines a shelf for the masonry. The horizontal leg extends forwardly of the vertical leg. The first and second mounting members extend rearwardly of the vertical leg. Each of the first and second mounting members has a respective web that stands away from the supporting structure, whereby the shelf angle is spaced forwardly away from the supporting structure. Each of the first and second mounting members has an upper region and a lower region. The shelf angle extends forwardly away from the respective lower regions of the first and second mounting members. The upper regions of the first and second mounting members each have a respective support attachment fitting. The first member has a lower margin. The lower margin is concealed behind the shelf angle.

In a feature of that aspect, the first member has a lowermost margin that is flush with the shelf angle. In another feature, the web of the first member has a seat formed therein. The shelf angle has at least one accommodation formed therein. The web of the first member has a protrusion that engages the at least one accommodation. The shelf angle nests removably in the seat. In another feature, the web is a first web. Each of the first and second members has a back. There is a first web, and a second web spaced from the first web. The first and second webs are joined to, and extending away from, the back. The attachment fitting is formed in the back. The attachment fitting accommodates a mechanical fastener by which the mounting assembly is secured to the support structure. The vertical leg of the shelf angle is mounted to the first and second webs of the first and second members respectively. The respective webs of the first and second members extend upwardly to a greater height than does the vertical leg of the shelf angle.

In another aspect of the invention, there is a mounting assembly for mounting masonry to supporting structure with the masonry spaced away from the supporting structure. The mounting assembly has a shelf angle; a first mounting member; and a second mounting member. The first and second mounting members are spaced laterally apart from each other. Each of the first and second mounting members has a back and first and second legs joined to and extending forwardly from the back away from the supporting structure. The shelf angle has a vertical leg and a horizontal leg. The shelf angle has a length running laterally to span the first and second mounting members. The horizontal leg defines a shelf for the masonry. The horizontal leg extends forwardly of the vertical leg. The first and second mounting members extend rearwardly of the vertical leg, whereby the shelf angle is spaced forwardly away from the supporting structure. Each of the first and second mounting members has an upper region and a lower region. The shelf angle is mounted to, and extending forwardly away from, the respective lower regions of the first and second mounting members. The upper regions of the first and second mounting members each has a respective support attachment fitting formed in the respective backs. The respective attachments fittings are located at a height that is upward of the vertical leg of the shelf angle.

In a feature, the attachment fitting is adjustable, and a layer of insulation is mounted between the vertical leg of the shelf angle and the support structure. in another feature, the shelf angle is removable from the first and second mounting members. In a further feature, at least one of: (a) the first member has an input load transfer interface and an output load transfer interface; there is a Rise/Run between them, and the Rise is greater than the Run; (b) the first member has a height that is greater than two courses of face brick; and (c) the vertical leg of the shelf angle has a seat height, and the first member has a height that is in the range of 2: 15:1 times the seat height. In another feature, the mounting assembly has at least one of: (a) lightening apertures formed in at least the lower regions of the first and second legs of the mounting members to constrict heat conduction through the lower regions; and (b) a low thermal conductivity coating applied to at least a respective portion of the first and second mounting members, the thermally conductive coating defining a thermal resistance.

In another aspect of the invention there is a masonry veneer support assembly mounting bracket. The mounting bracket has a back, a leg standing forwardly of the back, and an abutment standing rearwardly proud of the back. The leg has a vertical shear load input. The leg has a moment couple reaction. The back has a vertical shear load output; and the abutment extending downwardly of the shear load output.

In a feature, the abutment extends downwardly of the vertical shear load input. In another feature, the back defines an accommodation, and a cushion is mounted in the accommodation. In a further feature, the cushion is made of a less thermally conductive material than is the mounting bracket. In another feature, the abutment is a rearward extension of the leg. In another feature, the leg has a plurality of openings formed therein to leave a structural support framework. In still another feature, the mounting bracket has a channel shape when seen from above, the channel shape has two of the legs, the legs extending forwardly of the back and is opposed and spaced apart. In another feature, each of the legs has one of the abutments extending rearwardly as an extension thereof. The back is truncated at a level above the abutments. In another feature, each of the legs has a forwardly protruding toe defining the vertical shear load input. Each of the legs has a plurality of apertures formed therein to leave an open framework. An accommodation is formed upwardly of the abutments and rearwardly of the back. A thermal insulator occupies the accommodation. in another feature, the mounting bracket has the shape of a channel formed from a single blank of sheet metal.

In another aspect of the invention, there is a masonry veneer support assembly mounting bracket. It has a channel that has a back, a first leg and a second leg. The first and second legs are connected to the back and extend forwardly away therefrom. The first and second legs each have a forward margin most distant from the back, the forward margin defining a shelf-angle seat. The back has a mounting fitting defined therein by which to secure the mounting bracket to supporting wall structure. Each of the legs has a rearwardly extending abutment. The abutment is located downwardly of the mounting fitting.

In a feature thereof, the abutments of the first and second legs extend rearwardly proud of the back. in another feature, an accommodation is defined upwardly of the abutments and rearwardly of the back. In another feature, a spacer is mounted in the accommodation. The spacer is less thermally conductive than the mounting bracket. In another feature, there is a shelf angle retainer. The shelf angle retainer and the legs are mutually engaging. In another feature, the first and second legs are perforated to leave an open framework. In still another feature, the legs have respective first and second toes. The toes protruding forwardly to define a vertical shear load input. The shear load input is located at a height that is upwardly of the respective abutments of the first and second legs. In another feature, the mounting bracket has the shape of a channel formed from a single blank of sheet metal. In still another feature, any one of the first and second legs has first and second uprights, and removal of more than 50% of the material of the leg in any pitch of apertures between the uprights. In still another feature, the back has first and second uprights, and apertures formed therein between the uprights, and over a vertical distance of one pitch of apertures, 50% of the material of the back has been removed. In still another feature, at least one of the side legs and back of the channel section is perforated to yield an array of rectangular sides and ends with an array of intermediate diagonal struts.

In another aspect, there is a masonry veneer support. It has a shelf angle that includes a shelf upon which to support masonry veneer. It has a web standing upwardly from the shelf to form the shelf angle. The web defines a profile. The shelf of the shelf angle includes a portion that extends rearwardy of the profile of the shelf angle as seen in profile view.

In a feature of that aspect, the web of the shelf angle has at least a first upwardly extending lateral edge, and the shelf of the shelf angle includes a wing extending sideways beyond the lateral edge. In another feature, the web of the shelf angle includes first and second upwardly extending lateral edges at either end thereof. The shelf of the shelf angle includes respective first and second wings extending sideways beyond the respective lateral edges of the web. In another feature, the shelf includes a first shelf portion and a second shelf portion, and the first and second shelf portions meet at a corner. In a further feature, the corner is a square corner. In still another feature, the shelf has a first portion and a second portion. The first portion has a first leg length. The second portion has a second leg length. The first leg length is different from the second leg length. In still another feature, the shelf has a third portion. The first portion lies between the second portion and the third portion. The third portion has a third leg length. The third leg length is different from the first leg length. The first leg length is shorter than the second leg length and shorter than the first leg length. A notch is formed in the shelf between the second portion and the third portion. In another feature, the shelf is asymmetric. In a further feature, the second portion of the shelf has a varying leg length. In an additional feature, as seen from above, the varying leg length is formed at least partially on one of (a) a straight-line taper; (b) a curve; (c) a profile combining a straight line taper and a curve.

In still another feature, there is a mounting support assembly that includes the mounting support in combination with at least a first mounting bracket and a second mounting bracket. The first and second mounting brackets is laterally spaced apart and the masonry veneer support spans the first and second mounting brackets. The masonry veneer support is maintained in place on the brackets by retainers that clip the masonry veneer support to the mounting brackets. In still another feature, the masonry veneer support has a corner formed therein. There is at least a third mounting bracket. The third mounting bracket is non-coplanar with the first and second mounting brackets. In another feature, the web has a first portion and a second portion. The second portion of the web is discontinuous from the first portion. The first portion of the web is mounted to the first and second mounting brackets. The second portion of the web is mounted to the third mounting bracket.

In another aspect, there is a masonry veneer support. It has a shelf angle that includes a shelf upon which to support masonry veneer and a web standing upwardly from the shelf to form the shelf angle. the web defining a profile, the web has upwardly extending lateral edges; and the shelf of the shelf angle includes at least a first portion extending sideways of a first of the lateral edges.

In a feature of that aspect, the shelf has a second portion that extends sideways beyond the second edge of the web. in another feature, the shelf of the shelf angle includes a portion extending rearwardly of the profile when the shelf angle is seen in profile view. In still another feature, the shelf includes a first shelf portion and a second shelf portion, and the first and second shelf portions meet at a corner. In another feature, the corner is a square corner. In a further feature, the shelf is asymmetric. In still another feature, the first portion of the shelf has a first leg length extending forward of web. The second portion of the shelf has a second leg length extending forward of the web. The first leg length is different from the second leg length. In an additional feature, the shelf has a third portion. The first portion lies between the second portion and the third portion. The third portion has a third leg length. The third leg length is different from the first leg length. The first leg length is shorter than the second leg length and shorter than the first leg length. A notch is formed in the shelf between the second portion and the third portion. In another feature, at least one portion of the shelf has a varying leg length. In a further feature, as seen from above, the varying leg length is formed at least partially on one of (a) a straight-line taper; (b) a curve; (c) a profile combining a straight line taper and a curve.

In still another feature, there is a masonry veneer mounting assembly that includes the support member in combination with at least a first mounting bracket and a second mounting bracket. The first and second mounting brackets are laterally spaced apart. The web of the masonry veneer support spans the first and second mounting brackets. The masonry veneer support is held in place on the brackets by retainers that clip the masonry veneer support to the first and second mounting brackets. In another feature, the masonry veneer support has a corner formed therein and there is at least a third mounting bracket mounted around the corner from the first and second mounting brackets such that the third mounting bracket is non-coplanar with the first and second mounting brackets. In still another feature, the web has a first portion and a second portion. The second portion of the web is discontinuous from the first portion. The first portion is mounted to the first and second mounting brackets. The second portion of the web is mounted to the third mounting bracket.

BRIEF DESCRIPTION OF THE ILLUSTRATIONS

The foregoing aspects and features of the invention may be understood with the aid of the accompanying illustrations, in which:

FIG. 1*a* is a top view of a curved shelf angle installation;

FIG. 1*b* is a perspective view from above of the installation of FIG. 1*a;*

FIG. 1*c* is a perspective view from below of the installation of FIG. 1*a;*

FIG. 1*d* is a front view of the installation of the shelf angle installation of FIG. 1*a;*

FIG. 1*e* is a perspective view of the shelf angle of FIG. 1*a* in a straight condition;

FIG. 1*f* is a perspective view of the shelf angle of FIG. 1*e* bent into an S-curve;

FIG. 1*g* is a perspective shows a curved shelf angle like that of FIG. 1*f* with retaining clips attached;

FIG. 1*h* is a top view of the curved shelf angle of FIG. 1*g;*

FIG. 2*a* is a side view in section of a general arrangement of an assembly of wall elements including the shelf angle assembly of FIG. 1*a;*

FIG. 2*b* is a side view of an alternate embodiment of wall elements to that of FIG. 2*a;*

FIG. 2*c* is a side view of another alternative to the embodiment of FIG. 2*a;*

FIG. 2*d* is a side view of still another alternative embodiment to that of FIG. 2*a;*

FIG. 3*a* is a front view of details of the shelf angle of FIG. 1*e;*

FIG. 3*b* is a corresponding top view of the shelf angle of FIG. 3*a;*

FIG. 3*c* is a side view of the shelf angle of FIG. 3*a;*

FIG. 4*a* is a perspective view from behind, of a segment of a shelf angle, a retaining clip, and a mounting bracket as assembled in FIG. 1*a;*

FIG. 4*b* is a perspective view from the front, of the assembly of FIG. 4*a;*

FIG. 4*c* is an exploded view of the assembly of FIG. 4*b;*

FIG. 4*d* shows an alternate embodiment of the shelf angle of FIG. 4*c;*

FIG. 4*e* is a front view of the assembly of FIG. 4*a;*

FIG. 4*f* is a bottom view of the assembly of FIG. 4*a;*

FIG. 4*g* is a side view of the assembly of FIG. 4*a;*

FIG. 5*a* is a perspective view of the mounting bracket of the assembly of FIG. 4*a;*

FIG. 5*b* is a front view of the mounting bracket of FIG. 5*a;*

FIG. 5*c* is a side view of the mounting bracket of FIG. 5*a;*

FIG. 5*d* is a bottom view of the mounting bracket of FIG. 5*a;*

FIG. 6*a* is a rear perspective view of the retainer clip of the assembly of FIG. 4*a;*

FIG. 6*b* is a front perspective view of the retainer clip of FIG. 6*a;*

FIG. 6*c* is a front view of the retainer clip of FIG. 6*a;*

FIG. 6*d* is a bottom view of the retainer clip of FIG. 6*a;*

FIG. 6*e* is an end view of the retainer clip of FIG. 6*a;*

FIG. 7*a* is a perspective view of an alternate embodiment of retainer clip to that of FIG. 6*a;*

FIG. 7*b* is a front view of the retainer clip of FIG. 7*a;*

FIG. 8*a* is an enlarged detail, in section, of the alternate embodiment of FIG. 2*c;*

FIG. 8*b* is a front view of the enlarged detail of the mounting bracket of the assembly of the alternate embodiment of FIG. 8*a;*

FIG. 8*c* is a bottom view of the mounting bracket of FIG. 8*b;*

FIG. 8*d* is a side view of the mounting bracket of FIG. 8*b;*

FIG. 9*a* is an enlarged detail, in section, of the alternate embodiment of FIG. 2*d;*

FIG. 9*b* is a front view of the mounting bracket and cross-member of the alternate embodiment of FIG. 9*a;*

FIG. 9*c* is a bottom view of the mounting bracket and cross-member of FIG. 9*b;*

FIG. 9*d* is a side view of the bracket and cross-member of FIG. 9*b;*

FIG. 10*a* is a front view of an alternate mounting bracket and cross-member to that of FIG. 9*b;*

FIG. 10*b* is a front view of another embodiment of mounting bracket and cross-member to that of FIG. 10*a;*

FIG. 10*c* is a side view of an alternate embodiment of mounting bracket to that of FIG. 9*d;*

FIG. 11*a* is a perspective view of an alternate embodiment to that of FIGS. 8*a*, 9*a* and 10*a*-10*c;*

FIG. 11*b* is an exploded perspective view of the hanger and retainer of FIG. 11*a* without the shelf angle;

FIG. 11*c* is an exploded side view of the hanger and retainer of FIG. 11*b;*

FIG. 12*a* is a perspective view of an alternative embodiment of assembly to that of FIG. 11*a;*

FIG. 12*b* is a side view of the assembly of FIG. 12*a;*

FIG. 12*c* is a perspective view of the mounting bracket of FIG. 12*a;*

FIG. 12*d* is a side view of the mounting bracket of FIG. 12*c;*

FIG. 13*a* is a perspective view of an alternative to the embodiment of FIG. 12*a* for flush mounting of the shelf angle;

FIG. 13*b* is a side view of the embodiment of FIG. 13*a;*

FIG. 13*c* is a perspective view of the mounting bracket of the embodiment of FIG. 13*a;*

FIG. 13*d* is a side view of the mounting bracket of FIG. 13*c;*

FIG. 14*a* is a perspective view of an alternate form of shelf angle mounting bracket assembly to that of FIG. 2*a*, 2*b*, 2*c* or 2*d;*

FIG. 14*b* is a side view of the assembly of FIG. 14*a;*

FIG. 14*c* is a perspective view of a mounting bracket of the assembly of FIG. 14*a;*

FIG. 14*d* is a side view of the mounting bracket of FIG. 14*c;*

FIG. 15*a* is a perspective view of an alternate form of shelf angle mounting bracket assembly to that of FIG. 14*a;*

FIG. 15*b* is a side view of the assembly of FIG. 15*a;*

FIG. 15*c* is a perspective view of a mounting bracket of the assembly of FIG. 15*a;*

FIG. 15*d* is a side view of the mounting bracket of FIG. 15*c;*

FIG. 16*a* is a perspective view of an alternate form of shelf angle mounting bracket assembly to that of FIGS. 14*a* and 15*a;*

FIG. 16*b* is a perspective view of a mounting bracket of the assembly of FIG. 16*a* from in front, above, and to the left;

FIG. 16*c* is an alternate perspective view of a mounting bracket of the assembly of FIG. 16*a;*

FIG. 16*d* is a side view of the mounting bracket of FIG. 16*b;*

FIG. 16*e* is a rear view of the mounting bracket of FIG. 16*b;*

FIG. 17*a* is a perspective view of an alternate form of shelf angle mounting bracket assembly to that of FIG. 16*a;*

FIG. 17*b* is a perspective view of a mounting bracket of the assembly of FIG. 17*a* from behind, above, and to the left, and with insulation;

FIG. 17*c* is an alternate perspective view of a mounting bracket of the assembly of FIG. 17*a;*

FIG. 17*d* is a side view of the mounting bracket of FIG. 17*b;*

FIG. 17*e* is a rear view of the mounting bracket of FIG. 17*b;*

Figure 14C:
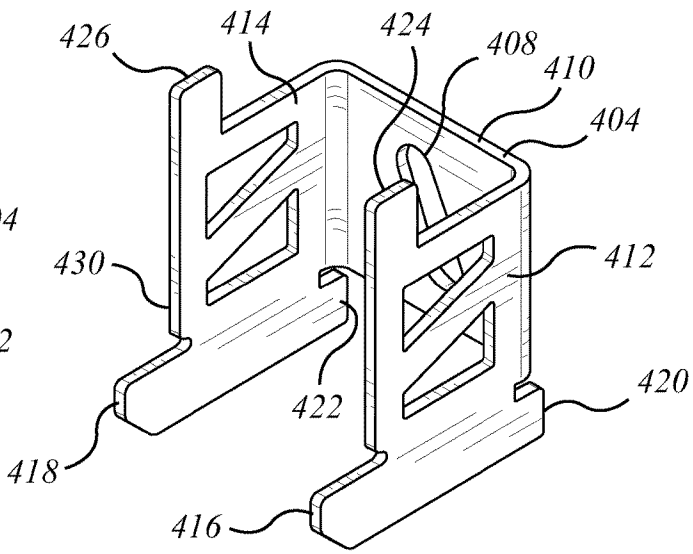
Figure 14A:
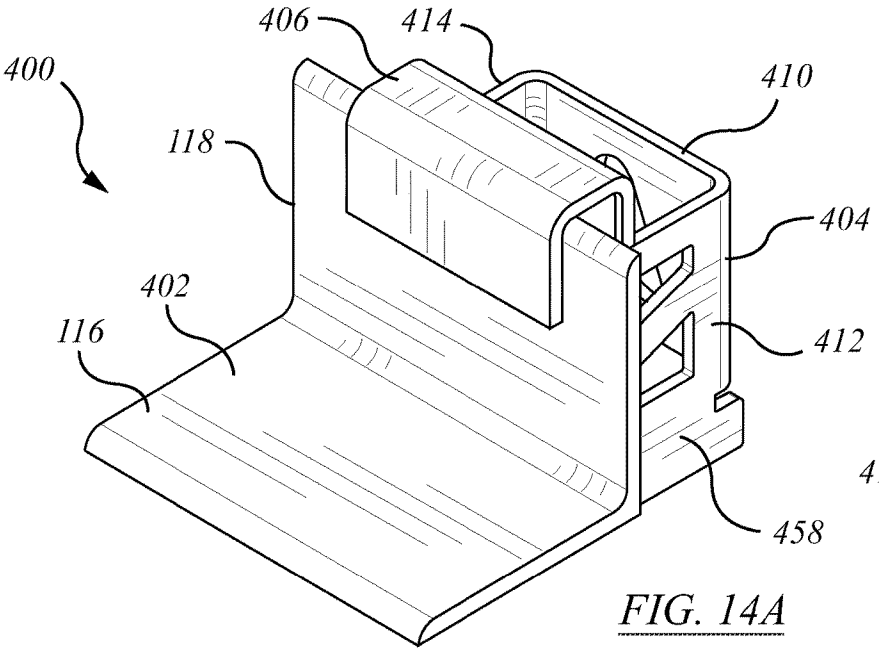
Figure 14D:
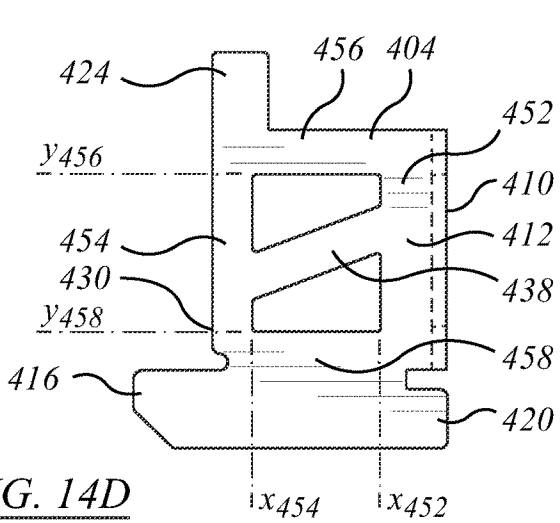
Figure 14B:
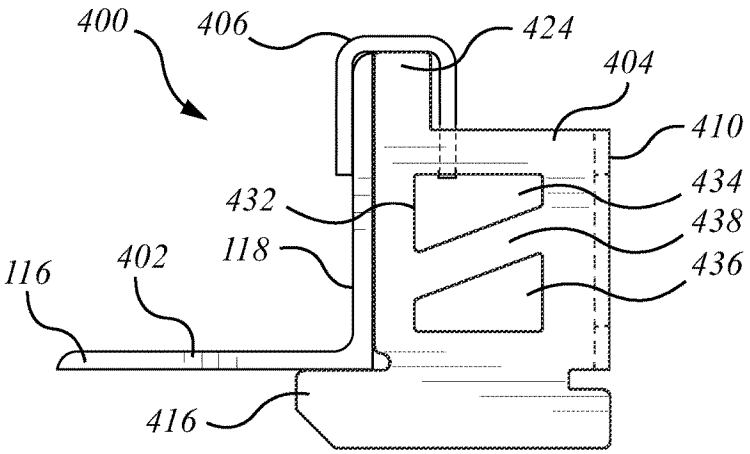
Figure 15C:
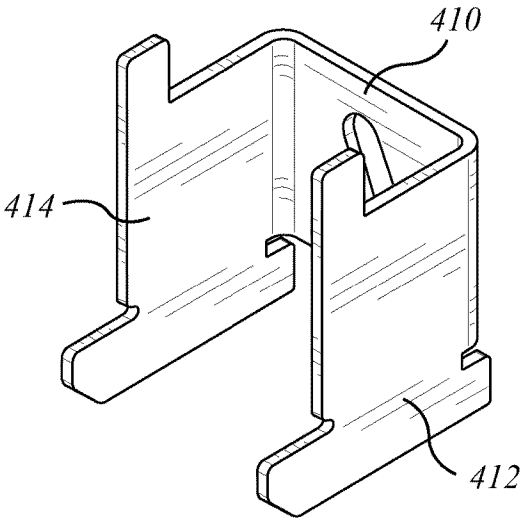
Figure 15D:
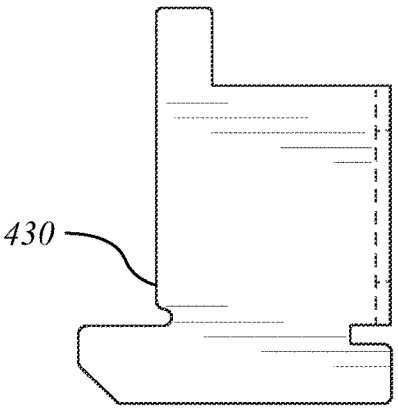
Figure 15A:
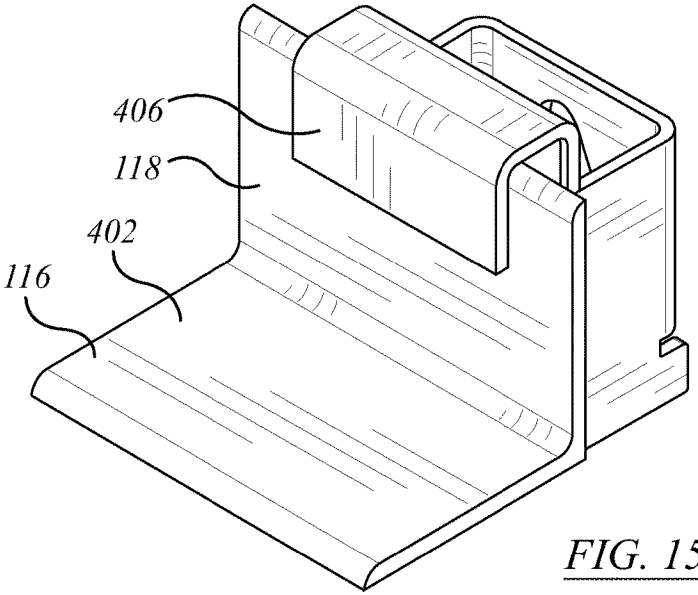
Figure 15B:
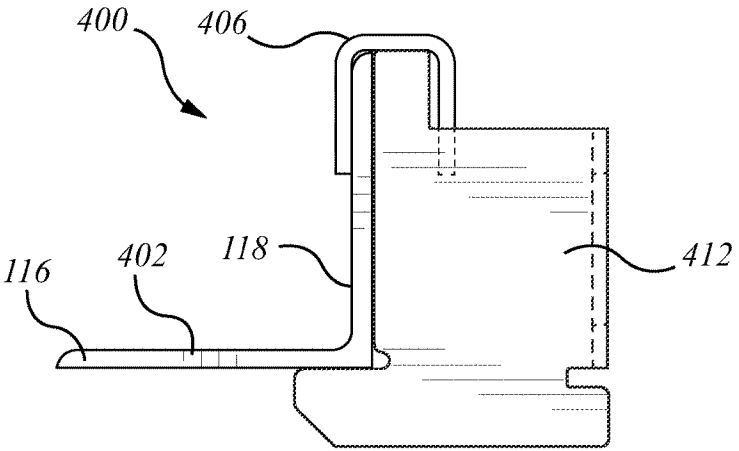
Figure 25A:
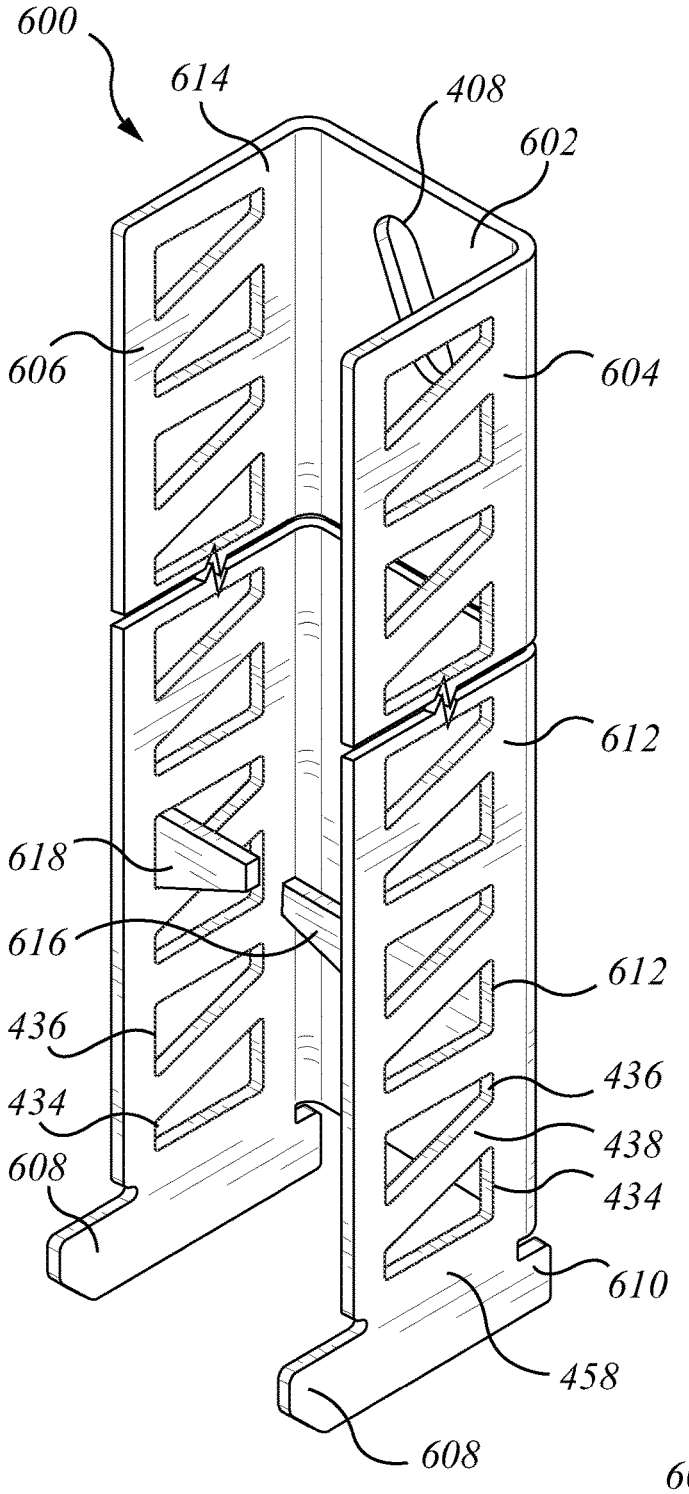

FIG. 25*a* is an isometric view from in front and to the left of a long-legged alternate mounting bracket to that of FIGS. 14*a* and 14*c;*

Figure 25B:
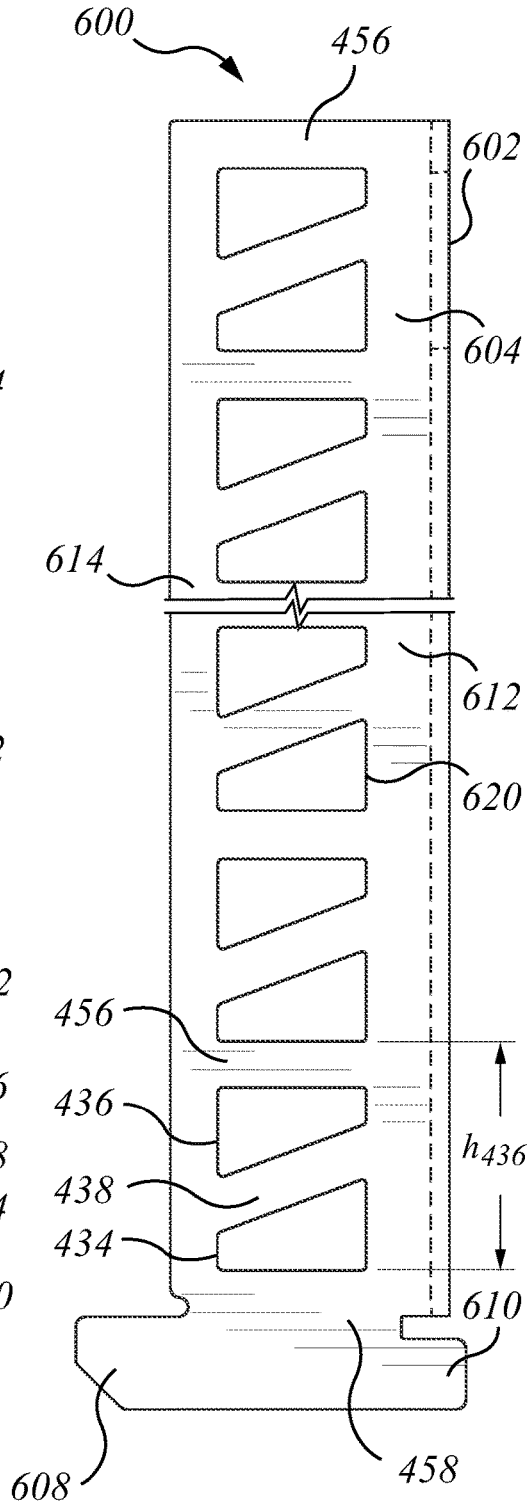

FIG. 25*b* is a side view of the mounting bracket of FIG. 25*a;*

Figure 16B:
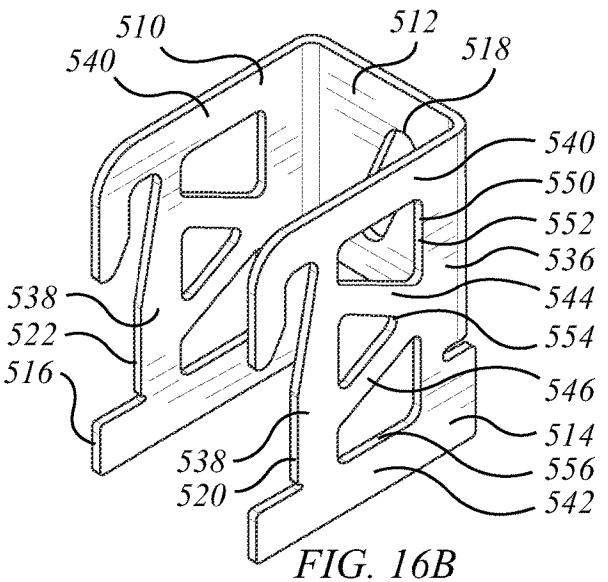
Figure 16A:
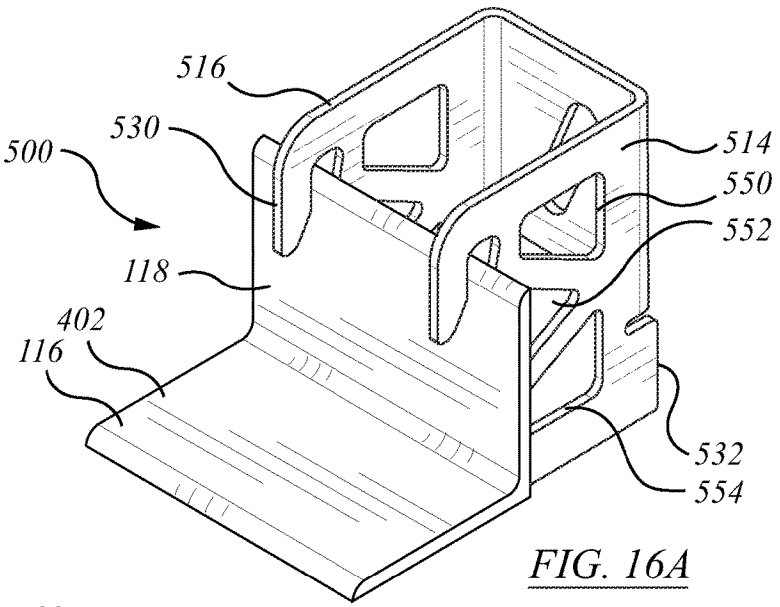
Figure 16E:
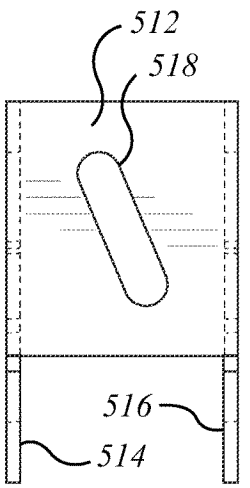
Figure 16D:
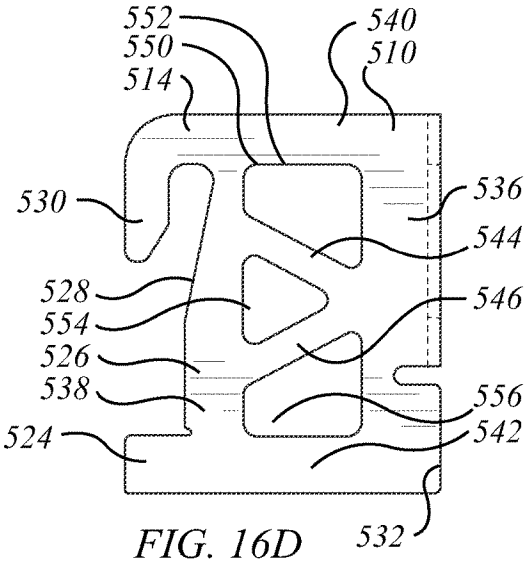
Figure 16C:
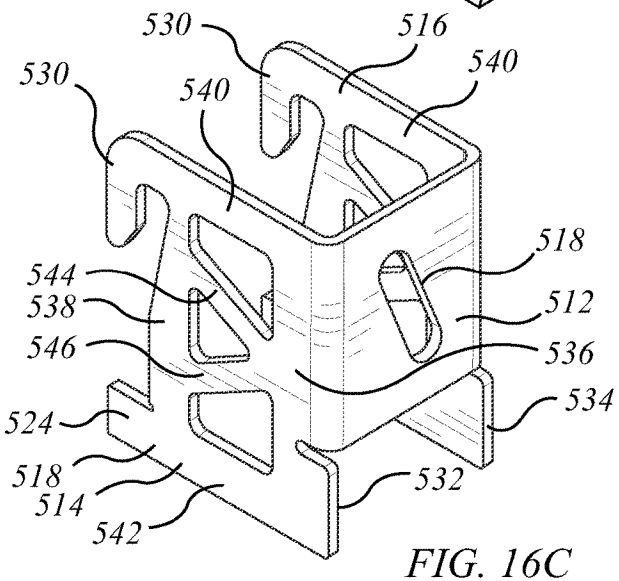
Figure 17B:
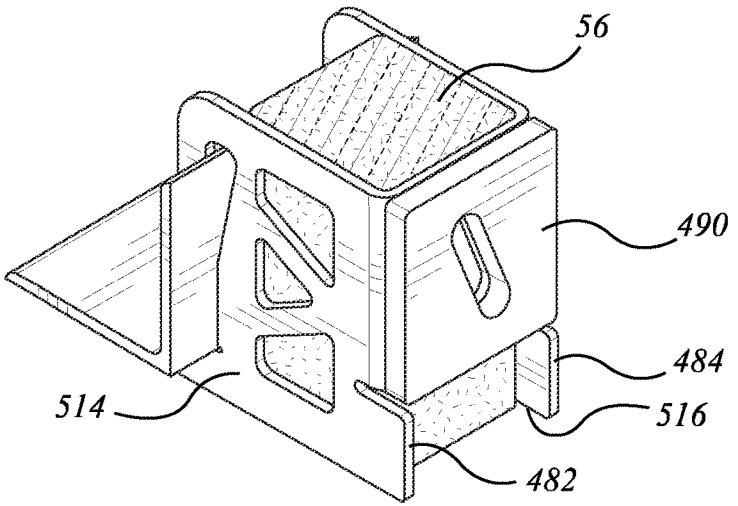
Figure 17A:
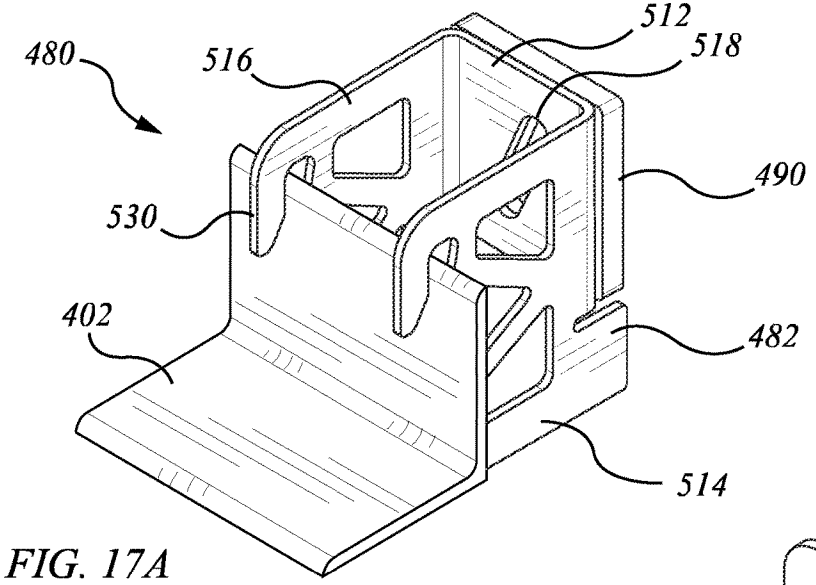
Figure 17E:
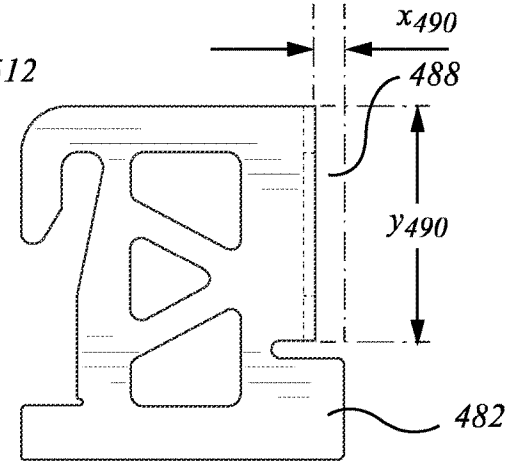
Figure 17D:
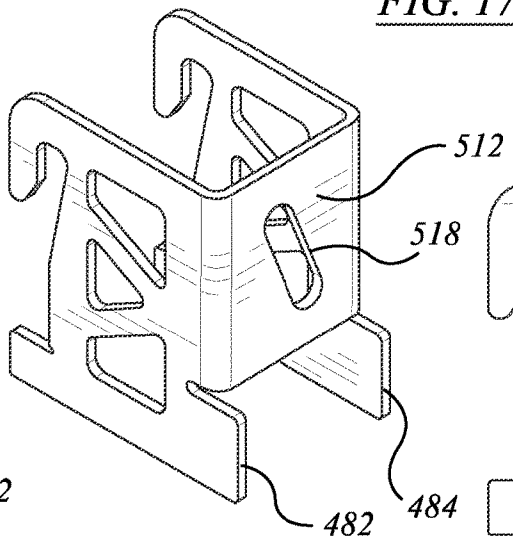
Figure 17C:
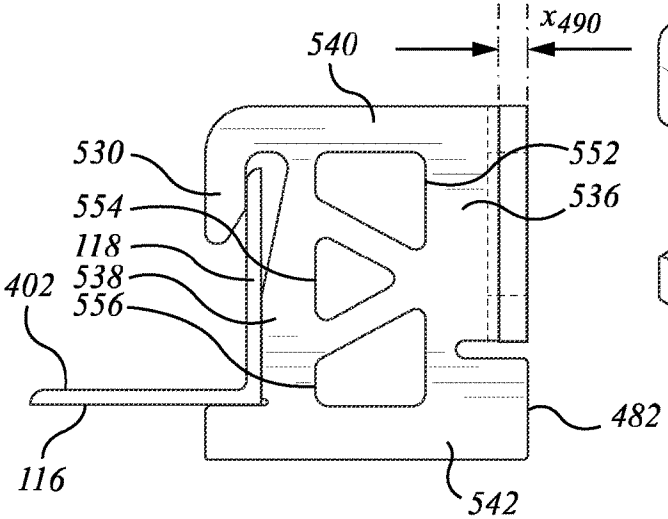
Figure 26A:
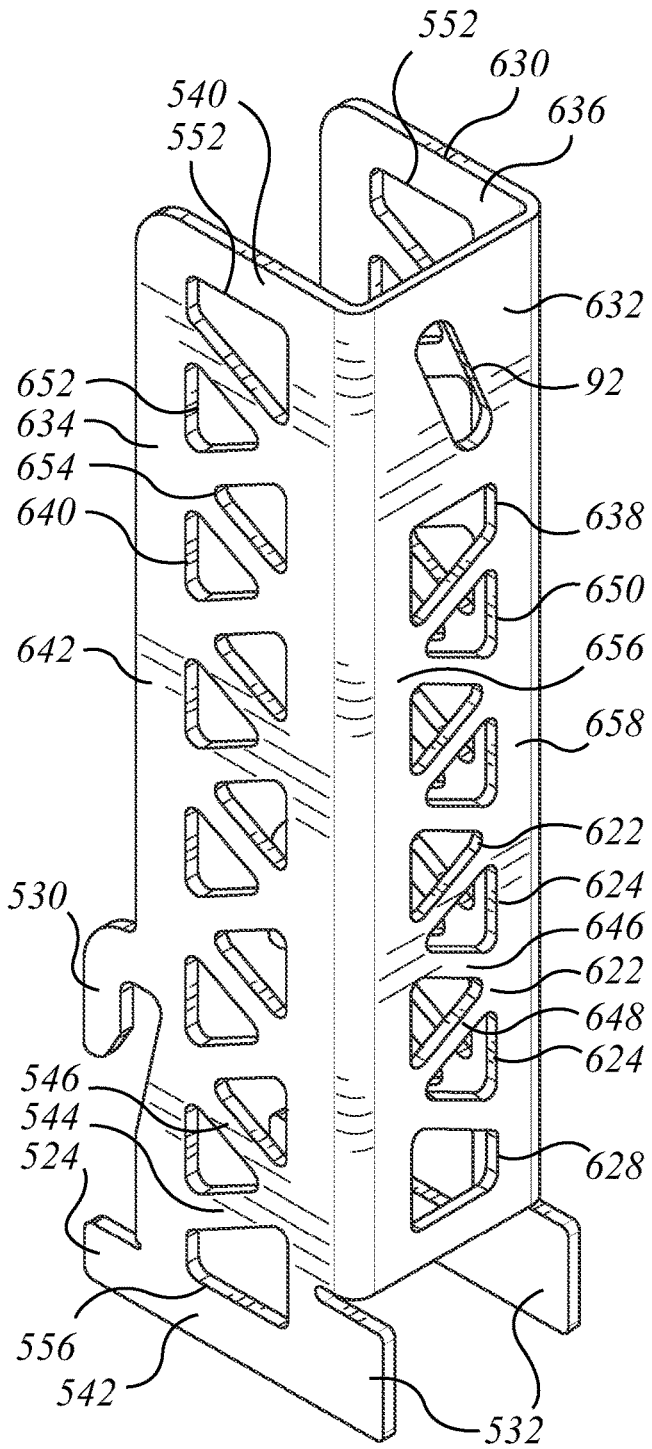
Figure 26B:
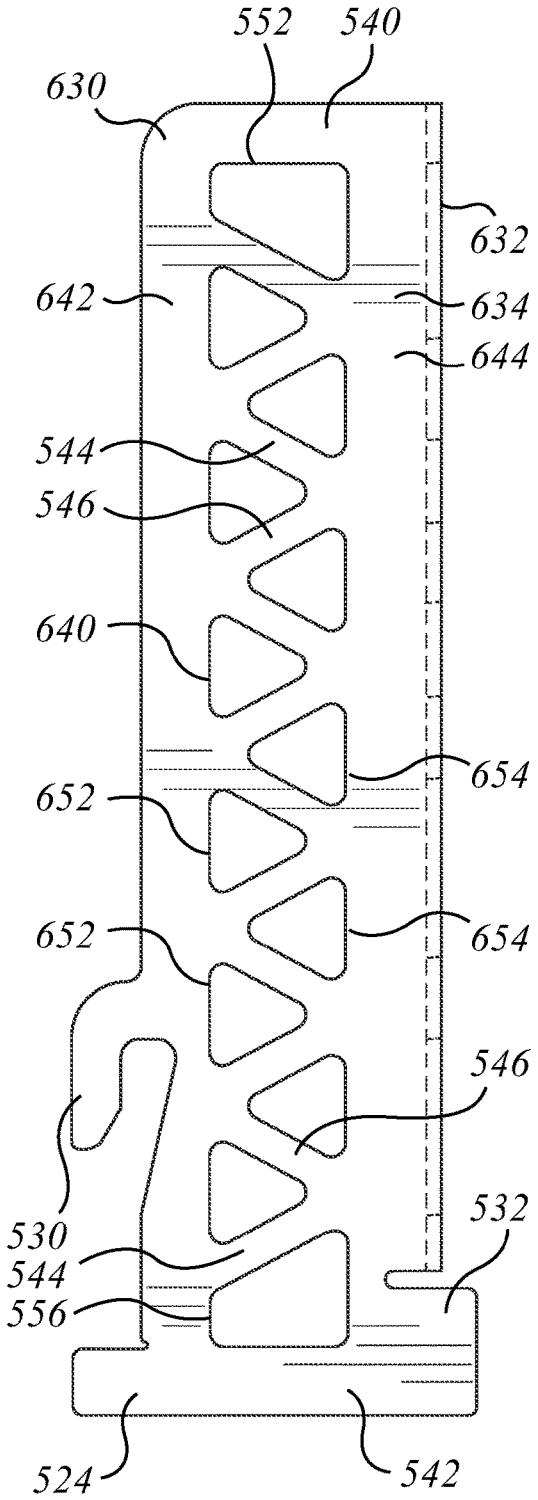

FIG. 26*a* is an isometric view from in front and to the left of a long-legged alternate mounting bracket to that of FIGS. 16*a* and 16*c*; and FIG. 26*b* is a side view of the mounting bracket of FIG. 26*a;*

Figure 1A:
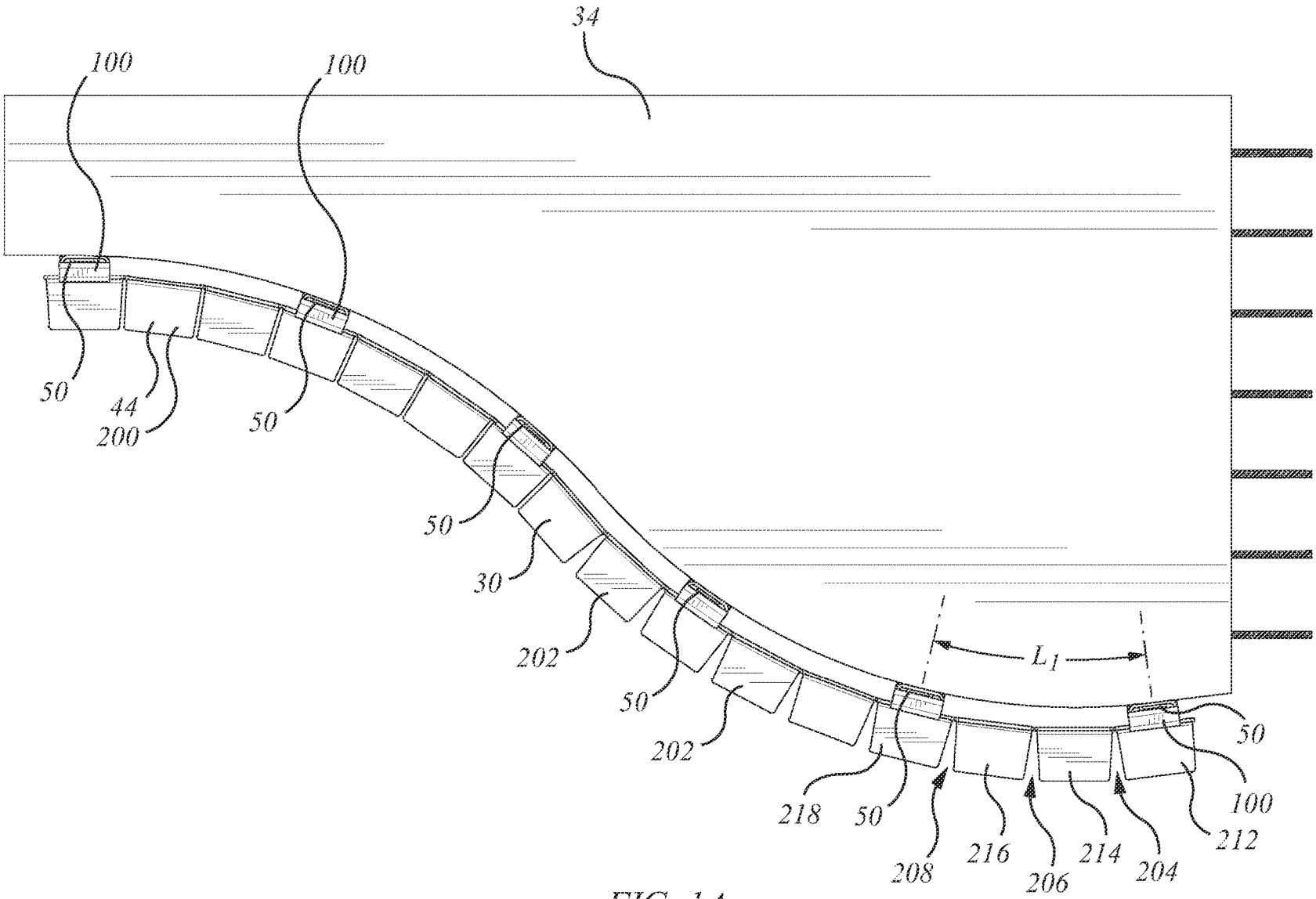
Figure 2A:
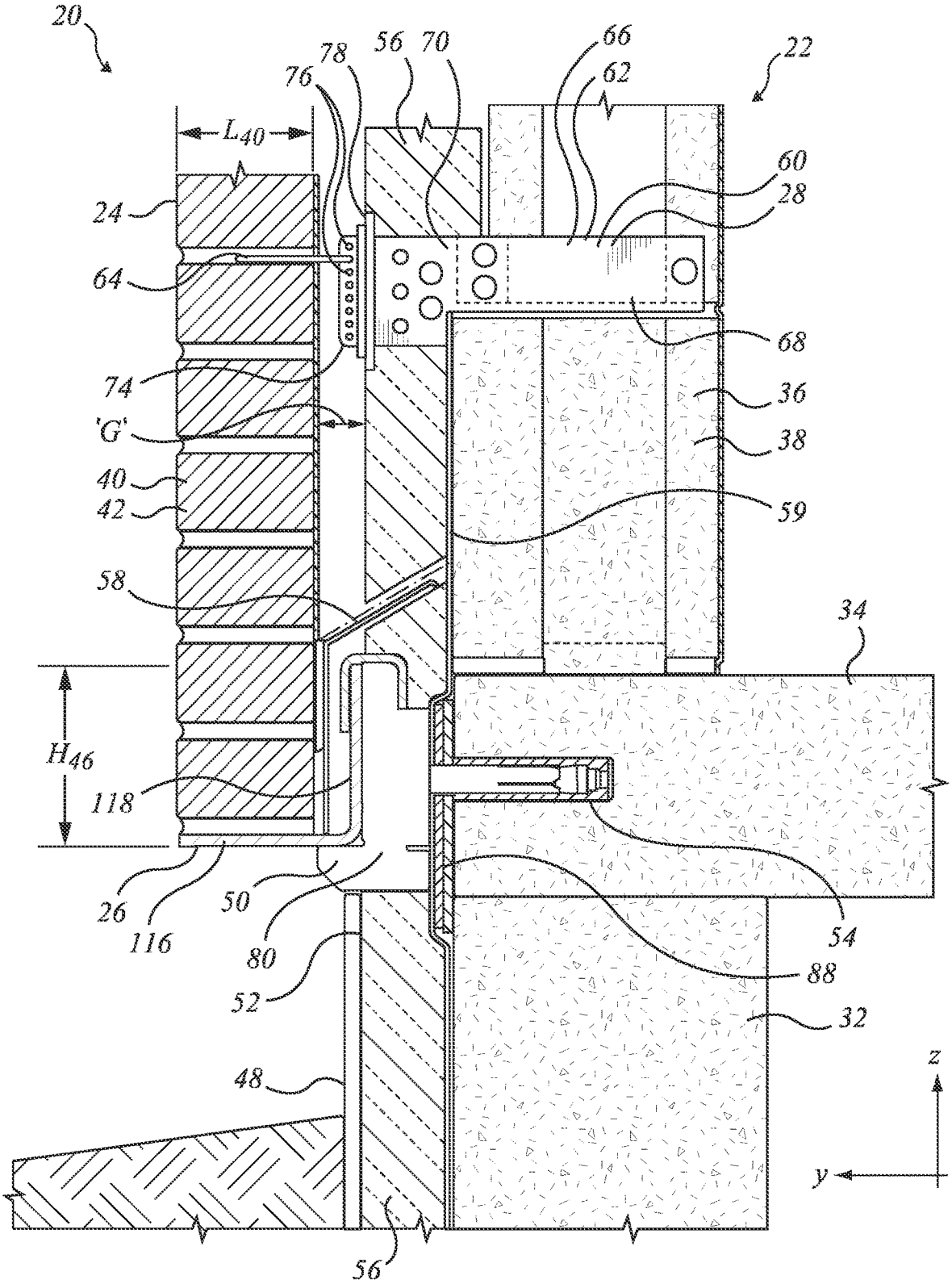
Figure 2B:
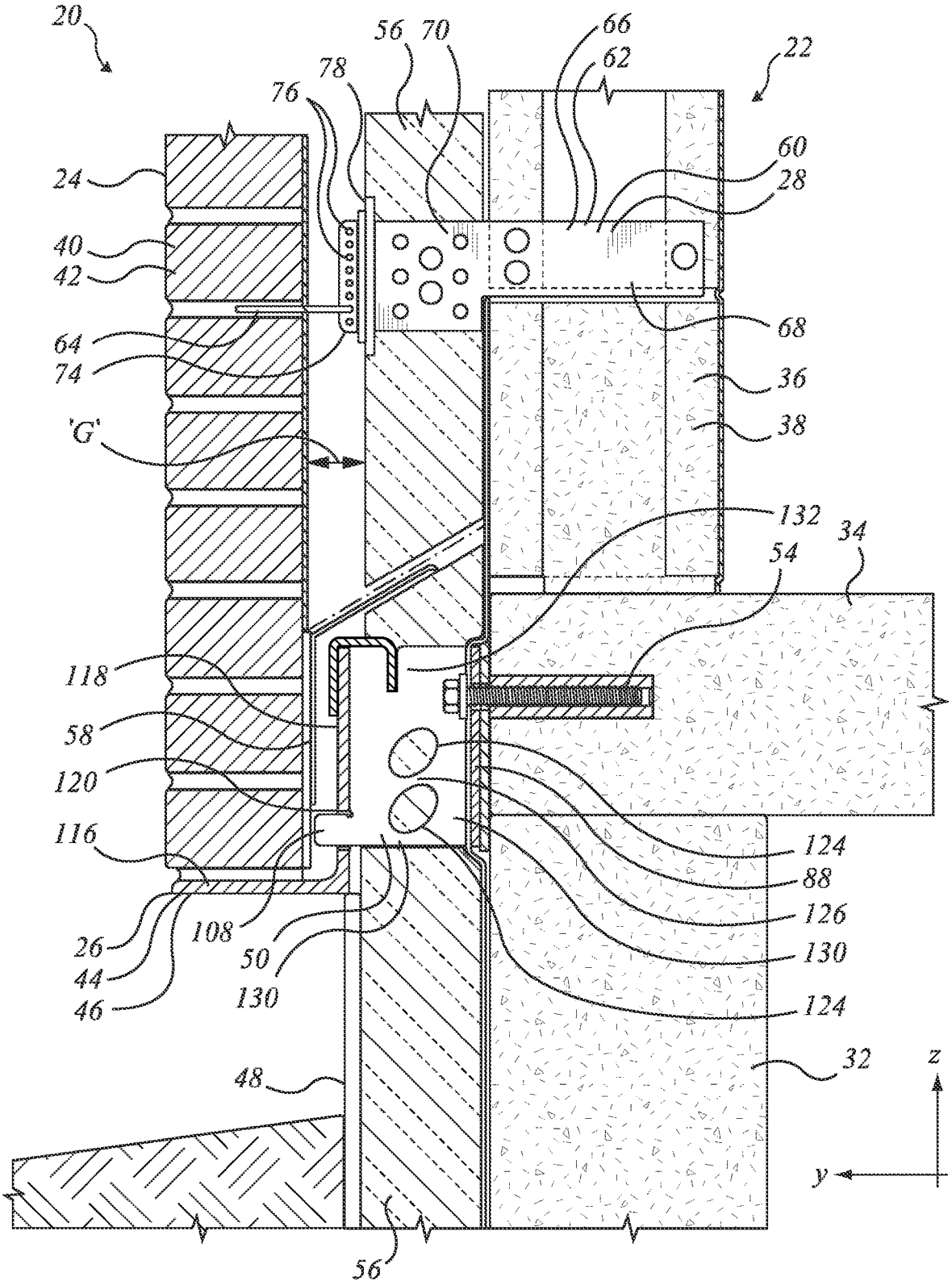
Figure 2C:
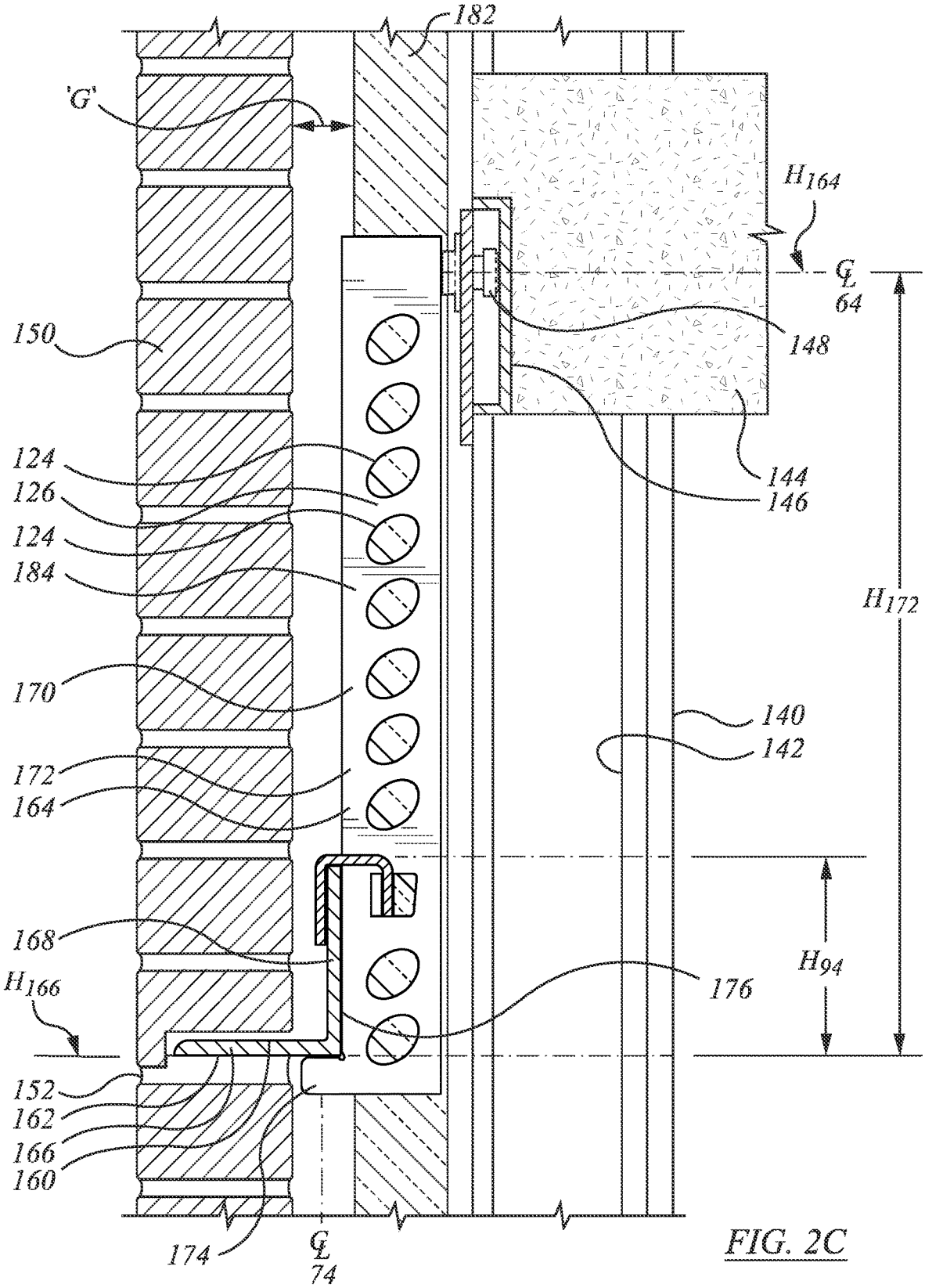
Figures 27A, 27B, 27C:
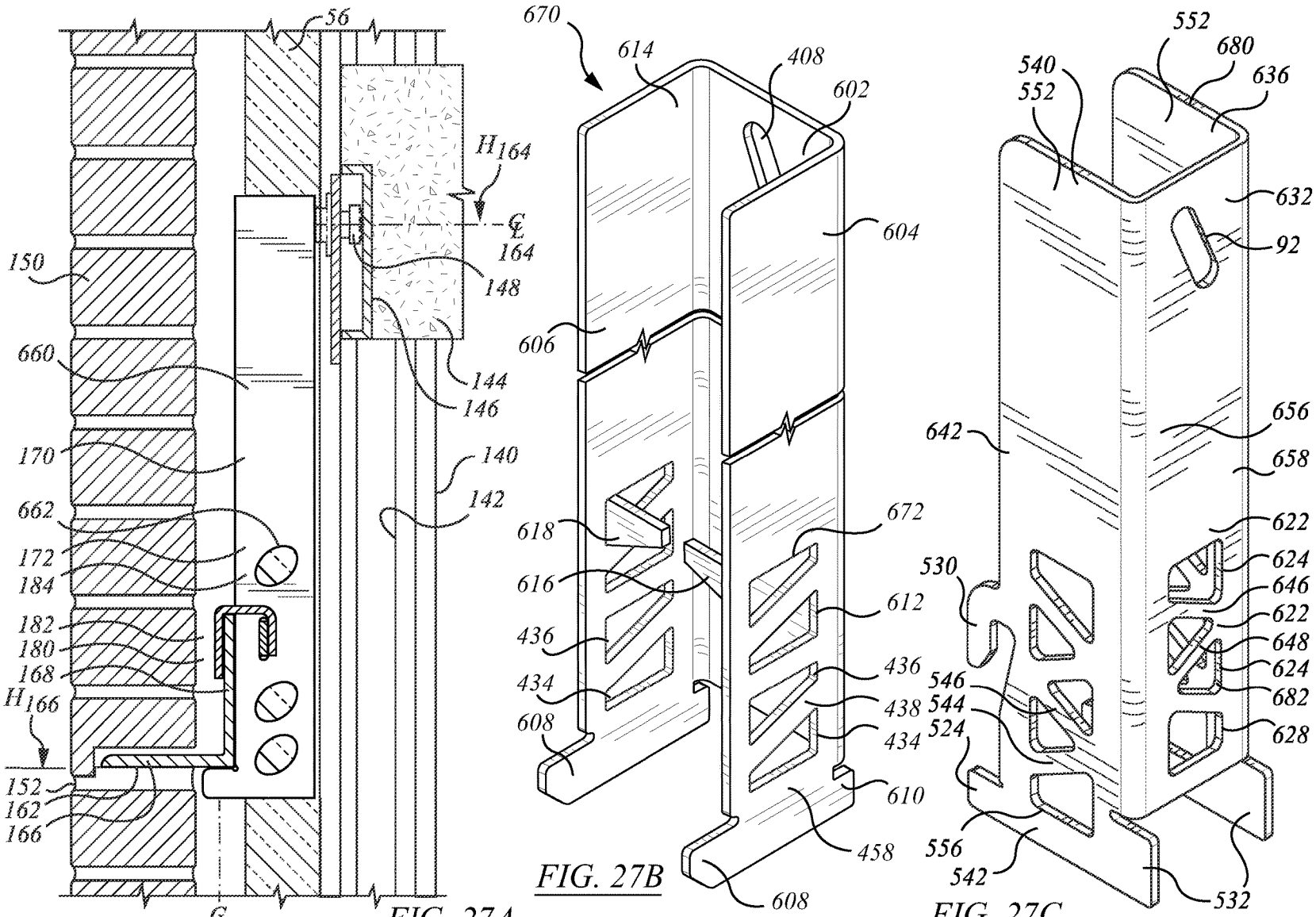
Figure 28A:
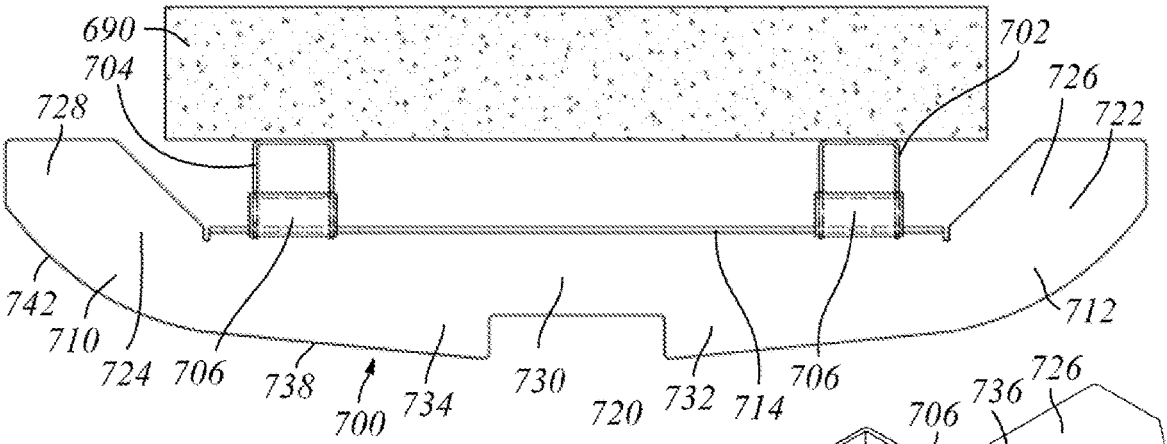

FIG. 27*a* corresponds to FIG. 2*c*, with only the lower portion perforated;

FIG. 27*b* corresponds to FIG. 25*a*, with only lower perforation;

FIG. 27*c* corresponds to FIG. 26*a*, with only lower perforation;

FIG. 28*a* is a top view of an alternate shelf angle embodiment to FIG. 1*a;*

Figure 28B:
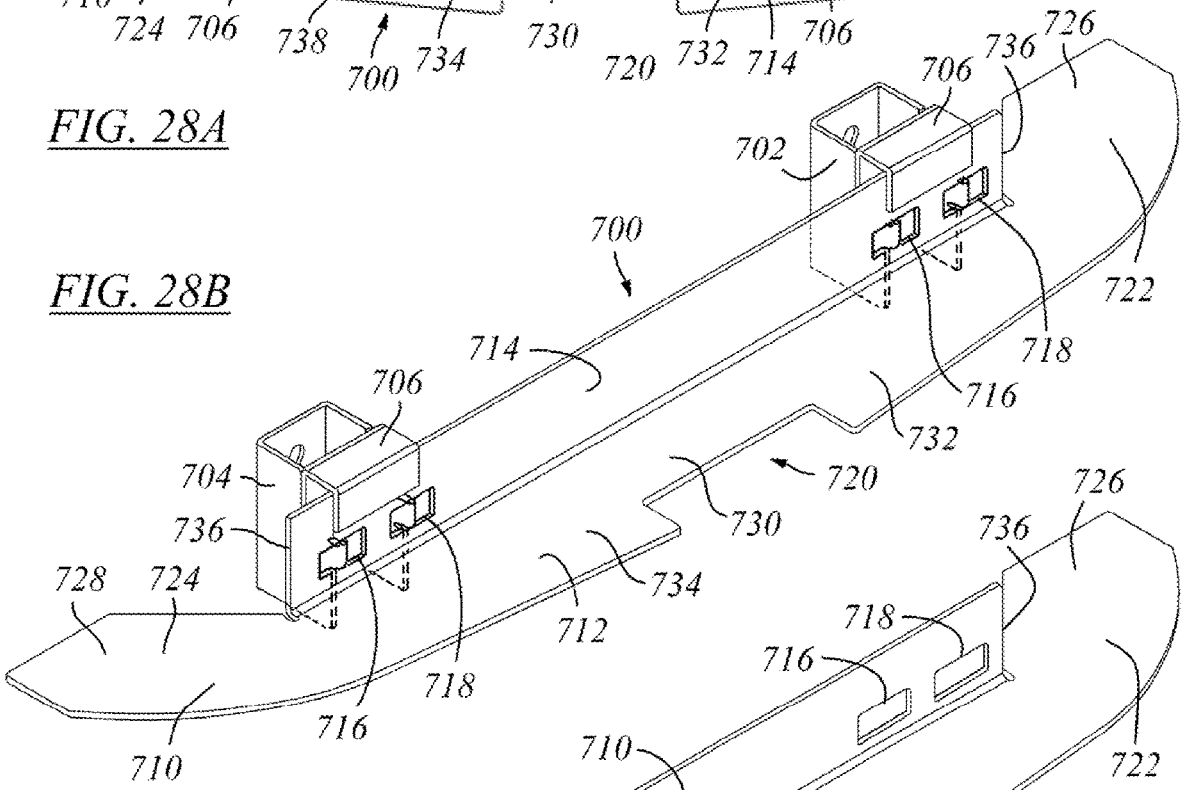

FIG. 28*b* is an isometric view of the shelf angle installation of FIG. 28*a;*

Figure 28C:
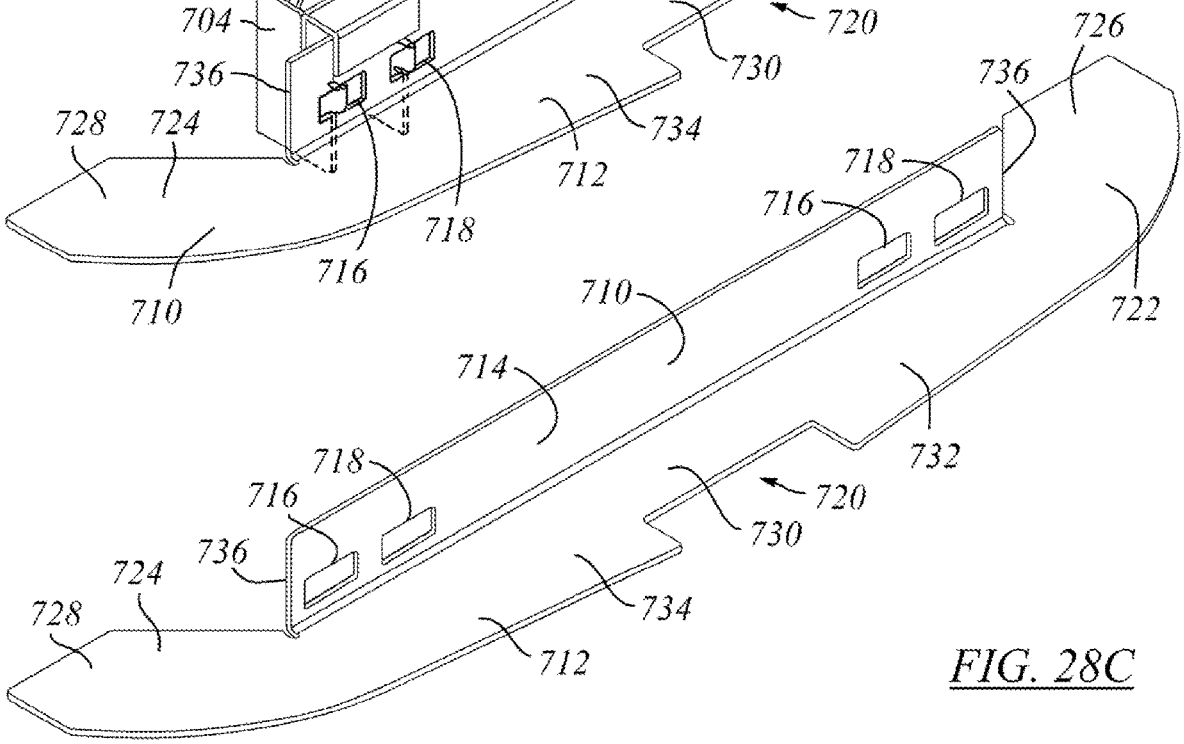

FIG. 28*c* shows the shelf angle of FIG. 28*b;*

Figure 29A:
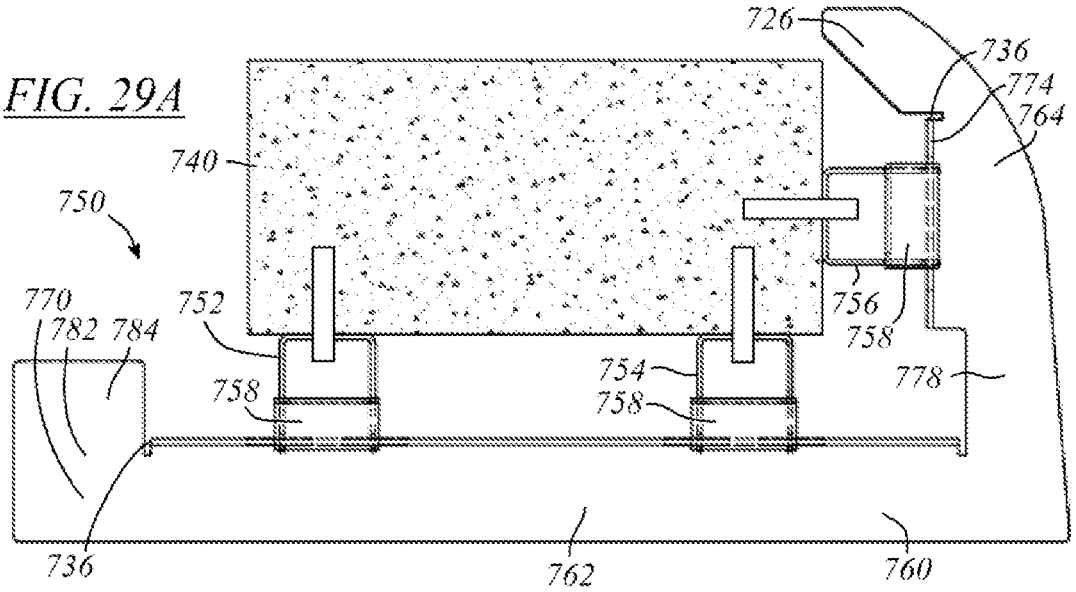

FIG. 29*a* is a top view of an alternate shelf angle embodiment to FIG. 28*a;*

Figure 29B:
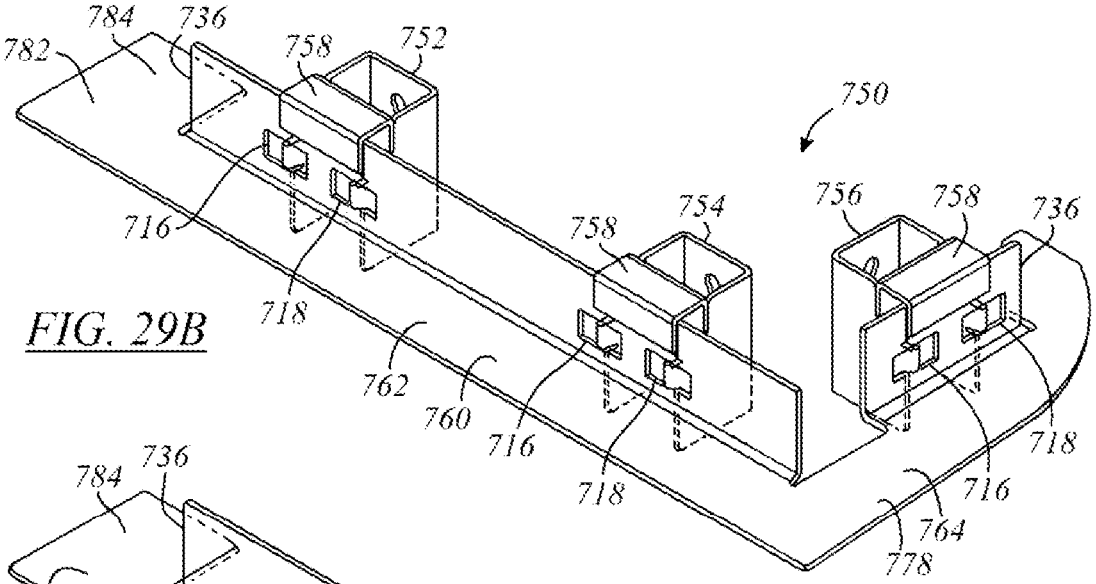

FIG. 29*b* is an isometric view of the shelf angle installation of FIG. 29*a;*

Figure 29C:
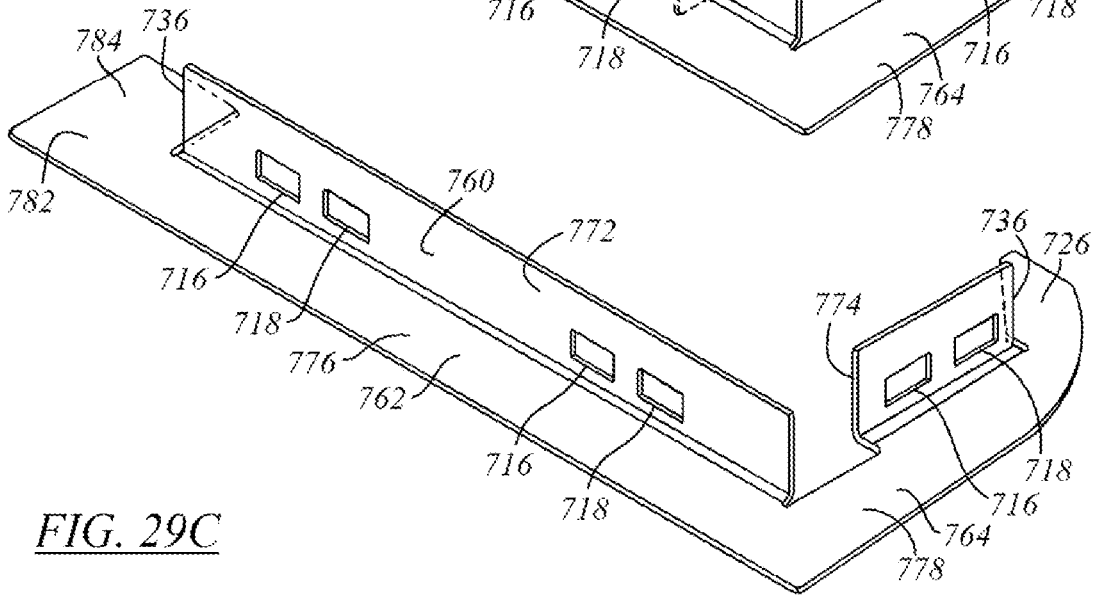

FIG. 29*c* shows the shelf angle of FIG. 28*b*.

DETAILED DESCRIPTION

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings may be taken as being to scale, or generally proportionate, unless indicated otherwise.

The terminology used in this specification is thought to be consistent with the customary and ordinary meanings of those terms as they would be understood by a person of ordinary skill in the art in North America. Following from the decision of the Court of Appeal for the Federal Circuit in *Phillips* v. *AWH Corp*., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of experience in the art.

Figure 1B:
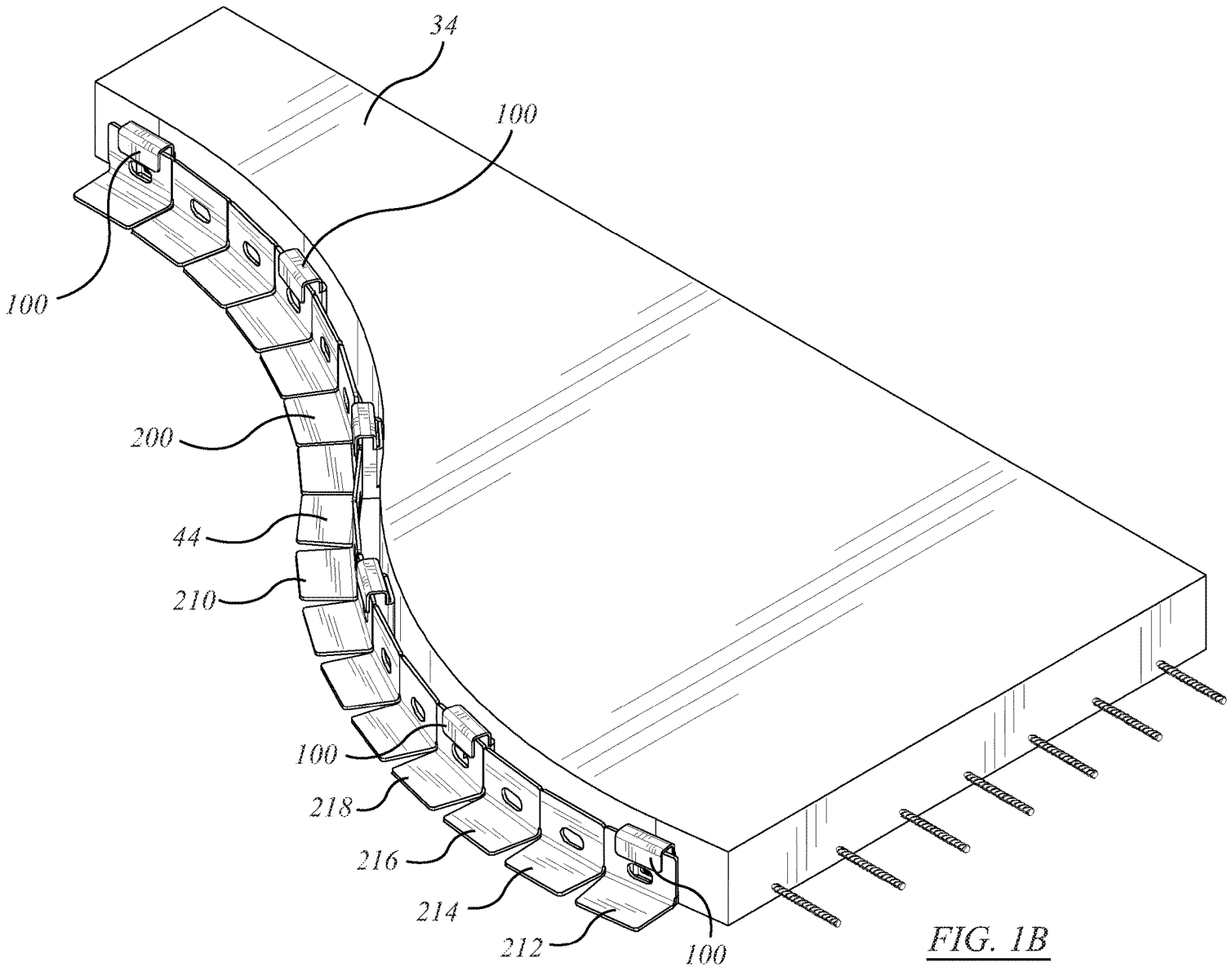
Figure 1C:
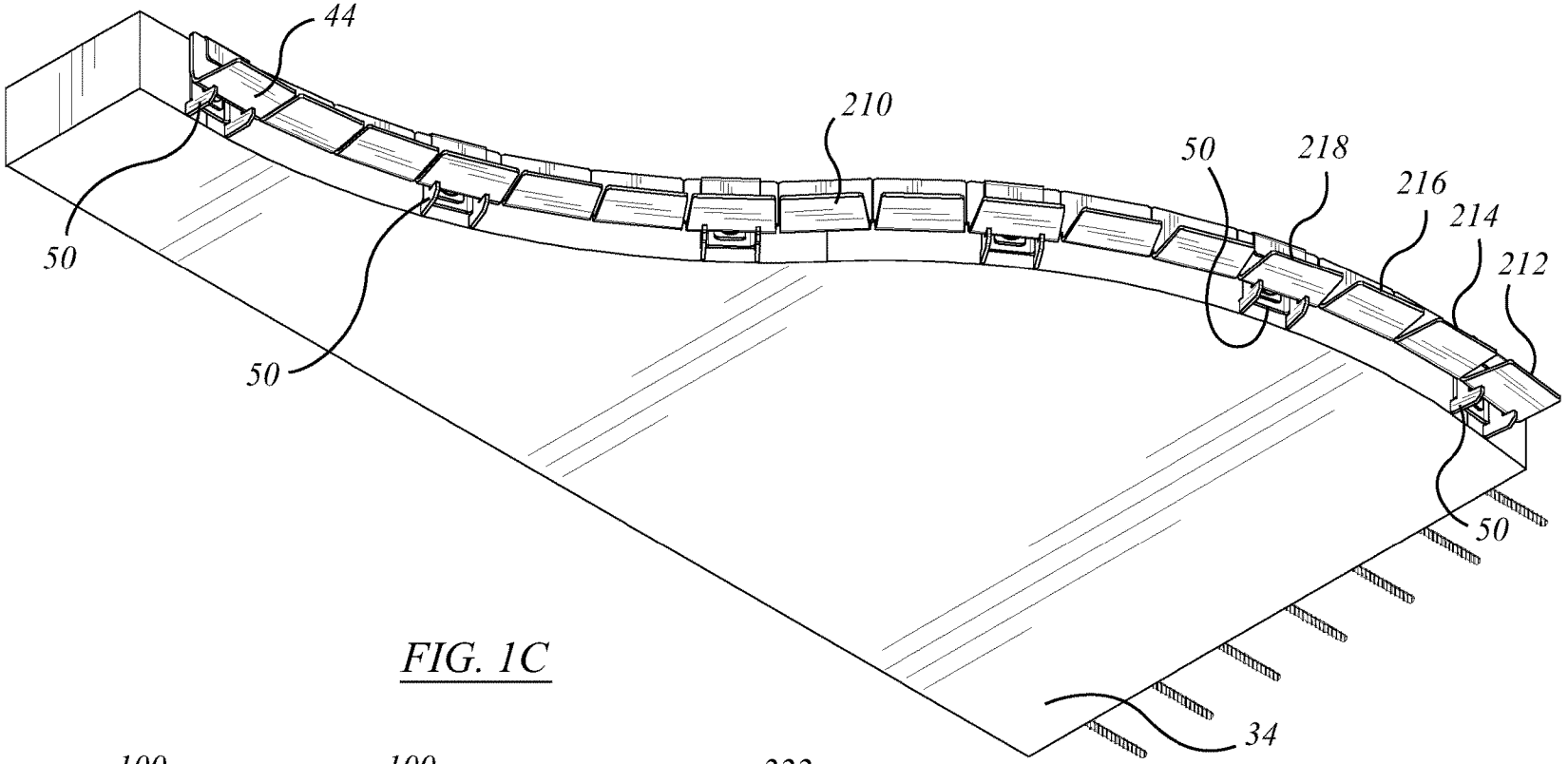
Figure 1D:
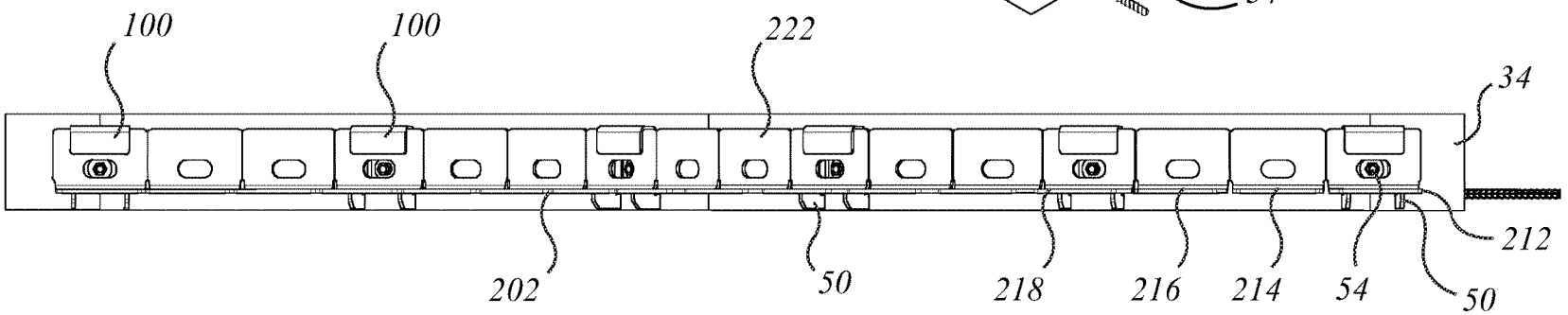
Figure 1E:
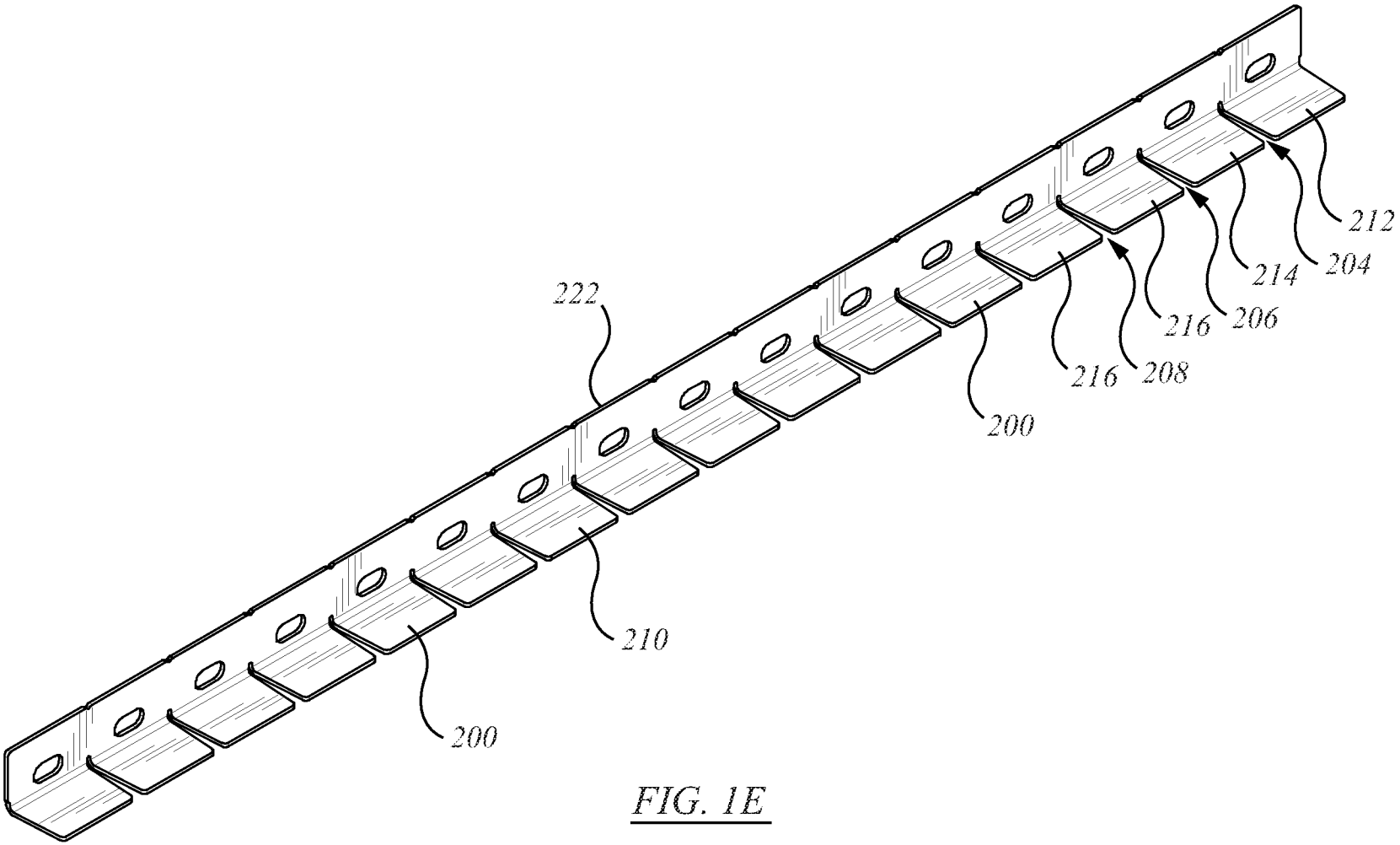
Figure 1F:
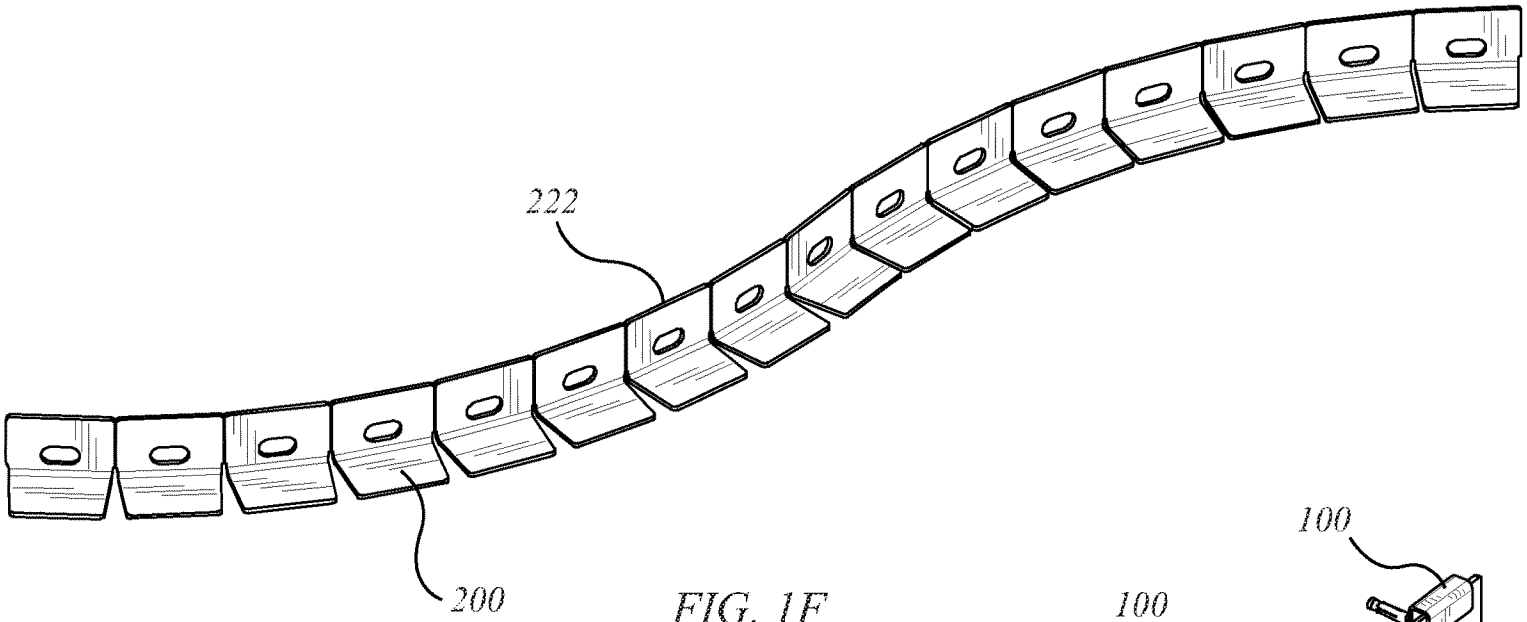
Figure 1G:
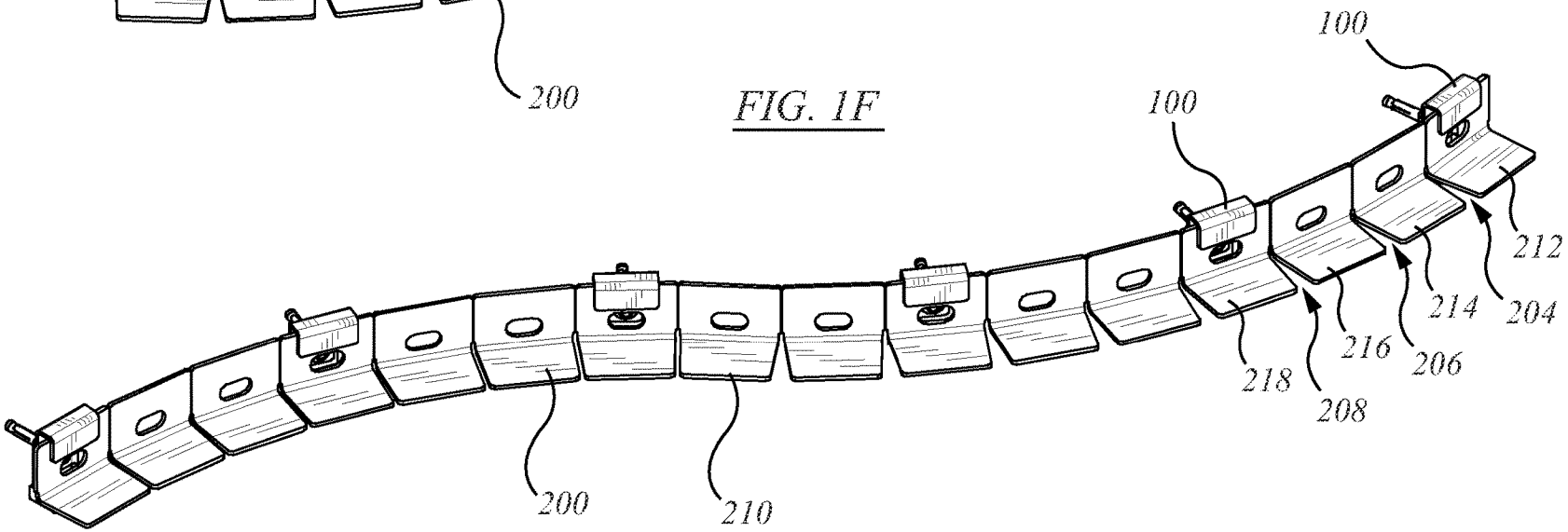
Figure 1H:
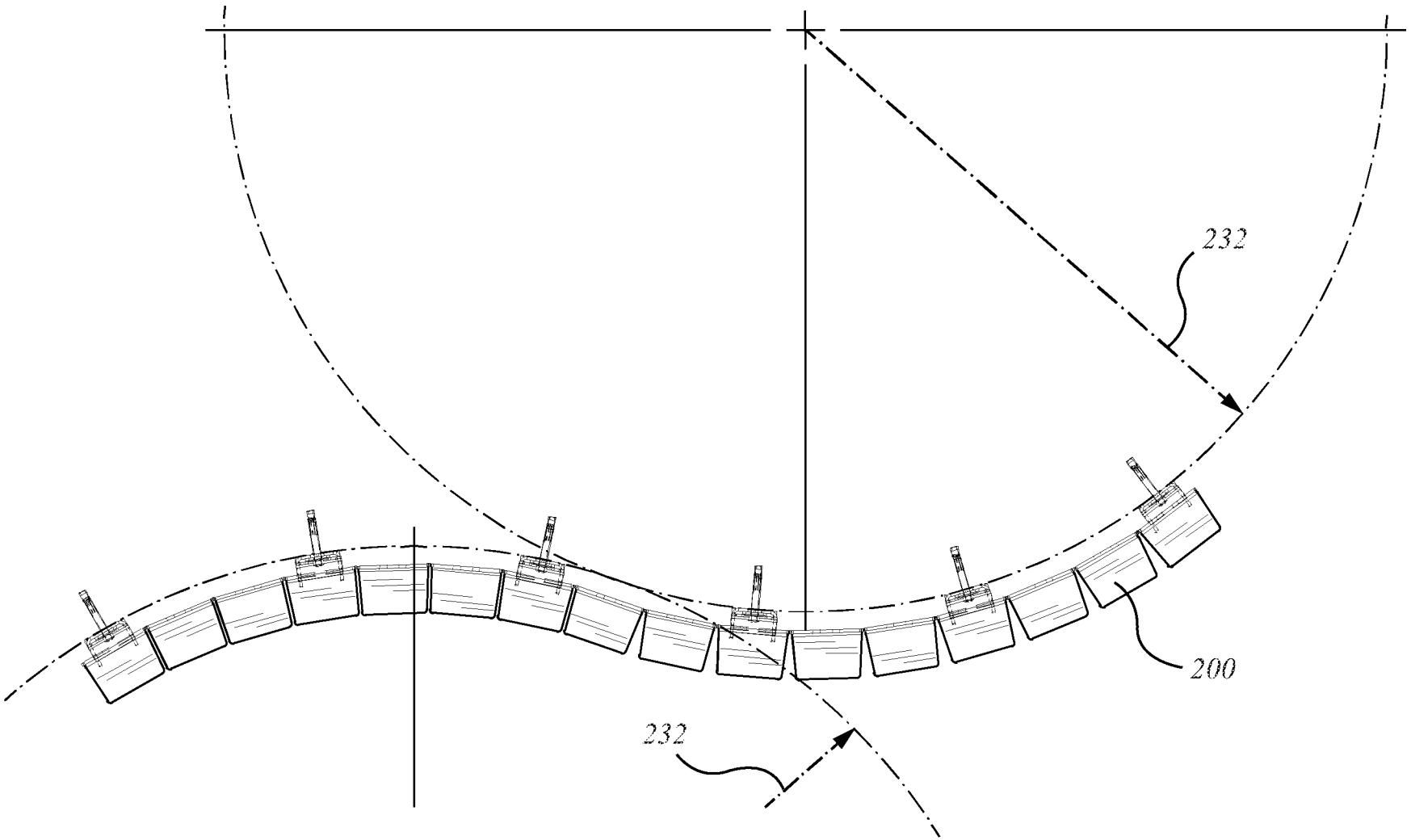

Referring to the general arrangement of FIG. 2*a*, there is a partial cross-section of a wall assembly, indicated generally as 20, such as might include the shelf angle assembly 30 of FIGS. 1*a*-1*d*. For the purposes of this description it may be helpful to consider a Cartesian co-ordinate frame of reference. The vertical, or up-and-down, direction may be designated as the z-axis, or z-direction. The direction perpendicular to the plane of the page may be considered as the longitudinal direction or x-direction, or x-axis, and may be taken as being the cross-wise direction of the wall tangent to any curvature such as seen in FIG. 1*h*. The left-to-right direction in the plane of the page, i.e., perpendicular to the wall, may be considered the sideways, or y-direction, or y-axis.

In this description, reference is made to load-bearing structure, and load-bearing wall structure. The description pertains to mounting bracket assemblies that support external facing veneer components, such as face brick, spaced away from the supporting structure. The mounting brackets are anchored to load-bearing structure. Whether that load bearing structure is a structural wall or a concrete floor slab carried by framework, by a poured wall, by a block wall, or other load bearing members, in the context of this description whether it is a wall, a floor, or a ceiling, within the meaning of this specification it is a load-bearing wall structure to which the veneer supporting members may be mounted.

This description relates to apparatus, such as shelf angle assembly 30, for supporting masonry veneer, such as face brick or face stone, whether rough or finished. The masonry veneer, or whatever type, may sometimes be taken as having a weight of 35 lbs/sq.ft. The various alternatives herein include a first member (or several first members), and a second member. The first member, or first members may be wall mounting brackets. The second member may be a shelf angle. The term "shelf angle" is a term of art in the science or art of building construction. See, for example "*Technical Notes on Brick Construction*" by the Brick Industry Association, 1850 Centennial Park Drive, Reston, Virginia, 20191, www.gobrick.com (703) 620-0010, identified as 28B and dated December 2005, found at https://www gobrick-.com/docs/default-source/read-research-documents/technicalnotes/28b-brick-veneer-steel-stud-walls.pdf?sfvrsn=. A "shelf angle" is a substantial structural member, capable of carrying the 35 lbs/sq. ft. load of a masonry veneer, and is not to be confused with light metal railings for kitchen shelves, book shelves, or display cabinets in a retail display. A shelf angle has a forwardly extending leg that has a length, or reach, that exceeds the depth of face brick. Such a length may be 4 to 6 inches, or possibly more. Unless otherwise stated, as a default herein, the first member and second member may be as being steel, which may be a mild steel. Other materials may be suitable depending on the circumstances and the designed loads. A shelf angle may be a rolled steel member having a back, or web, as rolled from the steel mill, square to the horizontal flange, or shelf, upon which the masonry veneer sits. It has a material thickness that is generally ¼" or more, such as or 5/16", ⅜" or 7/16" or ½", with various lineal weights per foot. Shelf angles are sometimes made in 20 ft or 40 ft lengths, cut to length, and, in some instances, may have mounting apertures or other fittings in the back as described hereinbelow, or machined, cut, or punched to yield the segmented form described in greater detail herein. Likewise, shelf angle mounting brackets are substantial structural elements of sizes, thicknesses and weights commensurate with the role of supporting shelf angles and the masonry veneer they carry.

Wall assembly 20 may include load-bearing structure, or a load bearing assembly, indicated generally as 22, and externally visible facing elements, indicated generally as 24. The externally visible facing elements are mated to, or linked to, or stabilized by, load bearing structure 22. The linking, or positioning of the facing elements with the load-bearing structural elements may be achieved by the use of interface elements such as supports, or support assemblies, 26, and tying members 28. Support assemblies 26 and tying members 28 may be taken as being made of mild steel unless otherwise noted. Combinations of load bearing frame or wall assemblies, such as 22, facing elements 24, support assemblies 26 and tying assemblies 28 may be assembled as indicated in FIG. 2*a*.

Load-bearing structure 22 can be understood as being a supporting primary structure, which may have several different forms. First, it may include a foundation, which may be a poured concrete foundation 32. There may be a floor structure, such as a poured concrete floor slab 34. Floor slab 34 may carry a wall structure 36 which may have the form of laid blocks 38, or which may in other embodiments include a framed structure, such as may be a wood or steel framed structure.

Visible facing elements 24 may include brickwork 40, or stonework, be it rough stone or finished stone, or other cladding. The anchor system may support masonry veneer, thin granite veneer, large stone panels or pre-cast concrete in place of the bricks. In FIG. 2*a*, facing elements 24 are shown as bricks 42 laid in successive courses. Support assembly 26 may include a base or bench or first member 44 in the form of a "shelf angle", or angle iron 46. Shelf angle 46 may be an angle iron that runs along the wall structure in the horizontal direction, following the shape of the wall, for example as seen from above in FIG. 1*h*, and provides the bed upon which the lowest course of bricks finds its support, hence shelf angle 46 may be termed a brick support. Shelf angle 46 may rest with the back of the angle iron seated above a non-load bearing abutment or stop or skirt such as plate 48. First member 44 may be mounted to a second member 50, which may have the form of a support bracket or mounting bracket 52. Second member 50 it itself fixedly mounted to the load bearing wall structure. The vertical load of the facing, e.g., bricks 42 is carried by the bench or "shelf" of first member 44, and passed into such number of second members 50 as may support first member 44. There may be at least first and second such second support members 50 spaced laterally apart along the wall or supporting wall structure, be that wall structure straight and planar, or be it curved, as in FIG. 1*h*. For example, there may be several such supports on, for example, 24" centers, indicated as spacing Li, which may correspond to the spacing, or double the spacing of wall studs in standard framing. Second members 50 may then carry the shear load from first member 44 into the load bearing wall structure. The depth of second members 50 in the y-direction (i.e., normal to the wall) may typically be less than the vertical height of second members 50, such that the webs of second members 50 may be considered low aspect ratio beams in which the bending moment is small, or negligible.

Second members 50 are secured to load bearing wall structure 22. The securement may be, for example, mechanical securements such as threaded fasteners or expanding fasteners or anchors 54. In securement to a poured concrete wall or floor slab (as shown), fasteners 54 may be concrete anchors. Fasteners 54 may be concrete anchor fittings, as shown in FIG. 2*a*, or embedded threaded rods, studs, or bolts. Fasteners 54 are concrete anchors in FIGS. 2*a*, 4*b* and 4*c*. On installation, the anchor foot is inserted in a preformed (typically pre-drilled) socket such as a blind hole formed in the concrete slab, and the fastener is tightened, drawing the collet or mandrel into the segmented shank, forcing it to expand and bind in the blind hole. As tightened, the underside of anchor head flange 138 bears upon a spreader or washer, or spacer 128, and the nut is tightened against it.

Second members 50 have a depth (in the y-direction) that may correspond to, or may be greater than, the thickness of insulation panels 56 such as may be mounted to the front (or outside) face of the structural load-bearing wall assembly 22. There may also be a drainage shield, or flashing, 58 such as may encourage moisture to drain outwardly of and away from structural wall assembly 26. A vapour barrier membrane 59 may be captured behind insulation panels 56. Flashing 58 may traverse insulation 56 at the level of shelf angle 44 with its lowermost margin draining over angle iron 46, such that any moisture draining over vapour barrier 59 is drained away. That is, a continuous metal flashing 58 is supported on or above shelf angle 46. It may connect to a continuous flexible flashing which extends over the brick supports and that may connect to a vapour barrier membrane on the outer face of the wall. Sheets of rigid insulation may be mounted over top of the membrane on the outer face of the wall. The anchor system shown allows cavity insulation to be continuous behind the brick support. The rigid insulation may be of a thickness that allows an air space or gap 'G' between the insulation and the external veneer brick facing 40 mounted on shelf angle 46. The angle support brackets 52 may be made in a variety of sizes each corresponding to a desired thickness of the rigid insulation and air space. For example, the support bracket of the embodiments of FIGS. 2*b*, 2*c* and 2*d* may be deeper in the y-direction than the embodiment of FIG. 2*a*. In these arrangements, or embodiments, a standard size of brick support shelf angle 46 may be used without regard to the spacing between the brick facing and the face of the wall desired for insulation.

In some embodiments, tying members 28 may be located upwardly of support assembly 26. Tying members 28 may have the form of brick tie assembly 60, in which there is an anchor 62 and a brick tie 64. As may be noted, anchor 62 has a body 66 such as may have the form of a stamped steel plate. The distal portion of body 66 may be termed a tail 68. Tail 68 may have a length in the y-direction (i.e., into the wall) corresponding to the through thickness of cinder blocks 38, and such as may be located between adjacent blocks of a block wall, and embedded in the mortar therebetween. Alternatively, tail 68 may be embedded in a further poured concrete wall, as may be. To that end, tail 68 may have perforations such as may permit mortar (or poured concrete) to flow therethrough. Body 66 may also have a proximal portion 70 of a depth in the y-direction corresponding to the thickness of insulation panel 56. Proximal portion 70 may be perforated to reduce thermal conduction in the y-direction. Proximal portion 70 may have a step, or abutment, or indexing or locating feature, such as a shoulder, by which the correct depth position in the y-direction is obtained relative to the cinder block and the insulation. Body 66 may also have an outermost end portion 74 having an array of tie location apertures, or seats or positions 76. A faceplate 78 seats on the outside face of the insulation, and may be used on installation where the positioning of anchor 62 is set prior to installation of tail 68 in a poured concrete form. Brick tie 64 is then located in one or another of the seat positions 76. When the successive courses of bricks 42 are laid, the outermost ends of brick tie 64 are embedded in the mortar between courses, as suggested in FIG. 1*a*. Tying members as described are used where the air or insulation space between the load bearing structure and the external veneer exceeds one inch, and in all cases where the wall height exceeds 30 ft. Tying members as described may be placed on up to 24 inch spacing vertically, and up to 32 inch spacing horizontally.

Considering FIG. 2*a*, and FIGS. 4*a*-4*f* and 5*a*-5*d*, support bracket 52 may have the form of a channel 80 (as viewed from above or below, as in FIG. 5*d*) having a first member in the nature of a rear plate or back 82, and a second member in the nature of a web or leg 84. Channel 80 may also have a third member in the nature of a second web or leg 86. In the embodiment shown, legs 84 and 86 stand outwardly of back 82. That is, as installed back 82 may lie in an x-z plane abutting the load bearing structure 22, be it framing, metal girders, poured concrete wall or poured concrete slab, and so on. Legs 84 and 86 stand outwardly away from that y-z plane. In general, it may be convenient that legs 84 and 86 stand in y-z planes perpendicular to the plane of back 82, standing spaced apart and parallel, but this is not necessarily so. For example, legs 84, 86 could be splayed to form a V or winged shape as opposed to a square-sided U. In the particular embodiment illustrated, legs 84, 86 are a pair of side plates that extend from respective sides of the rear plate, back 82, in a direction away from the wall to form the sides of the U-shaped channel. The side plates are generally rectangular in shape and lie in respective vertical planes.

Figure 4A:
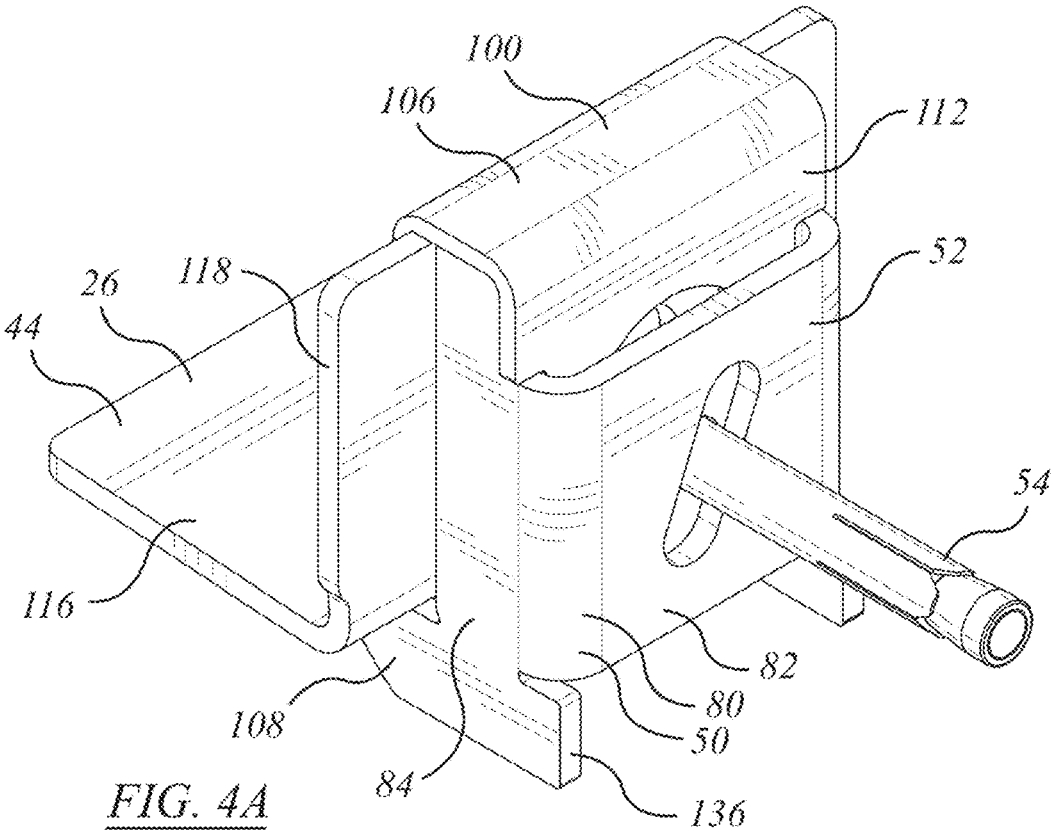
Figure 4B:
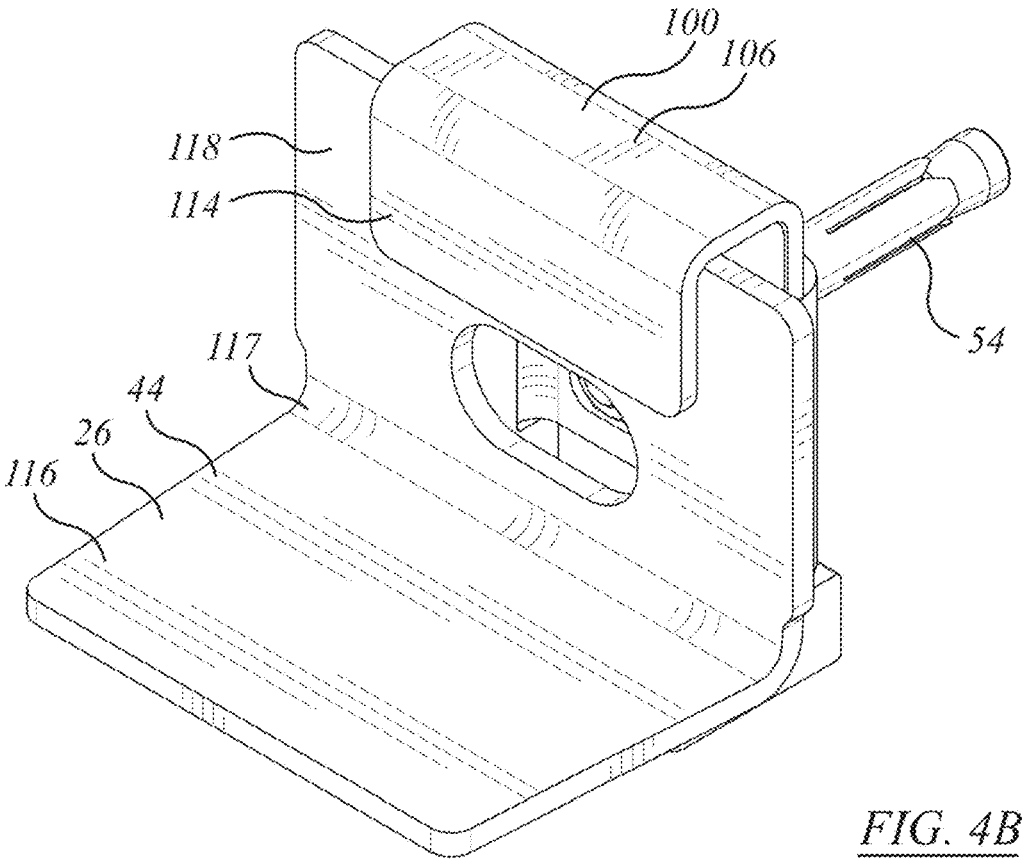
Figures 4C, 4D:
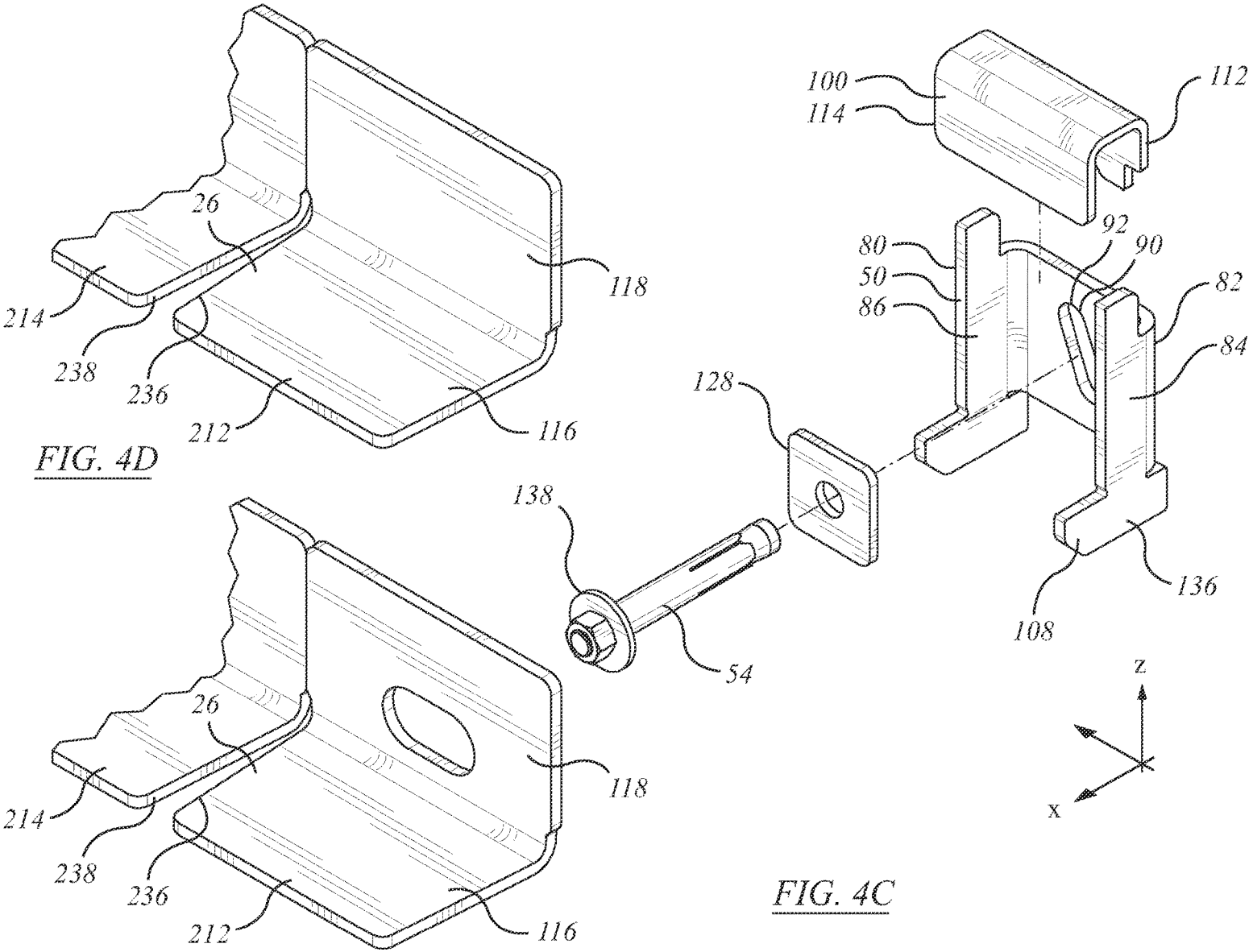
Figure 4E:
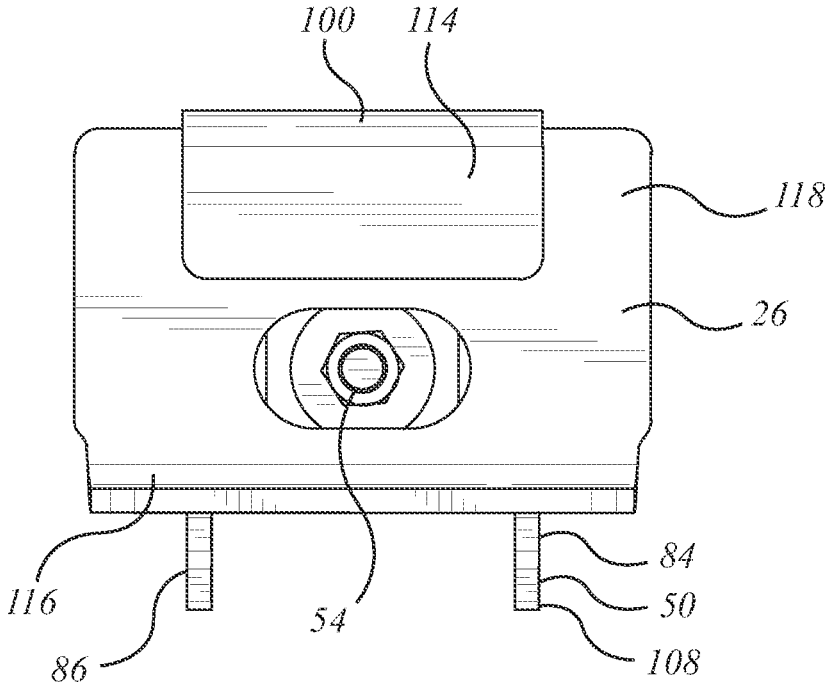
Figure 4F:
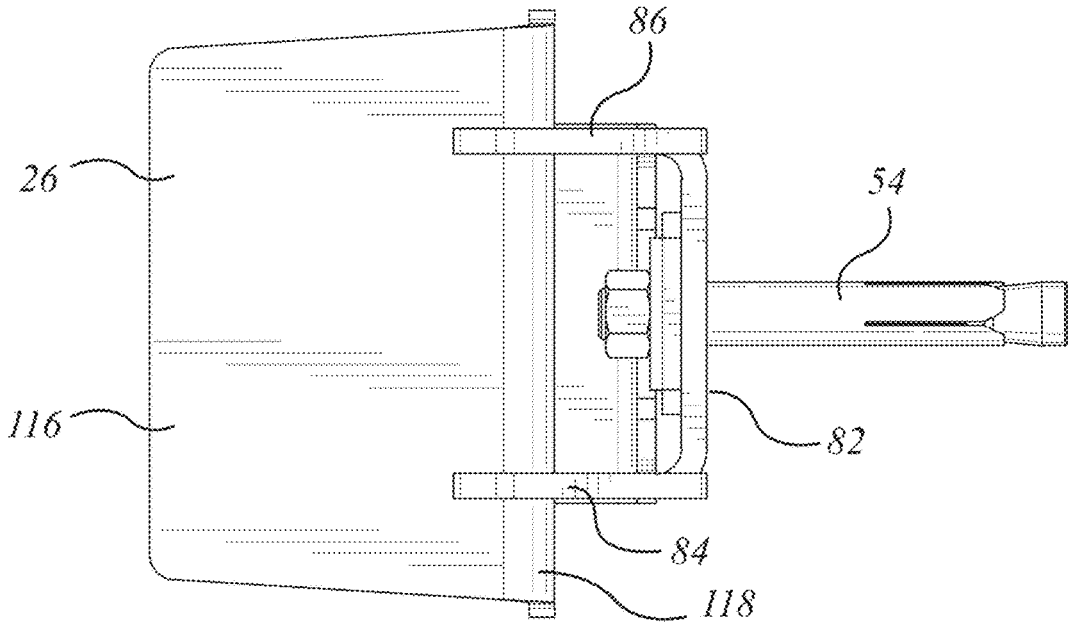
Figure 5A:
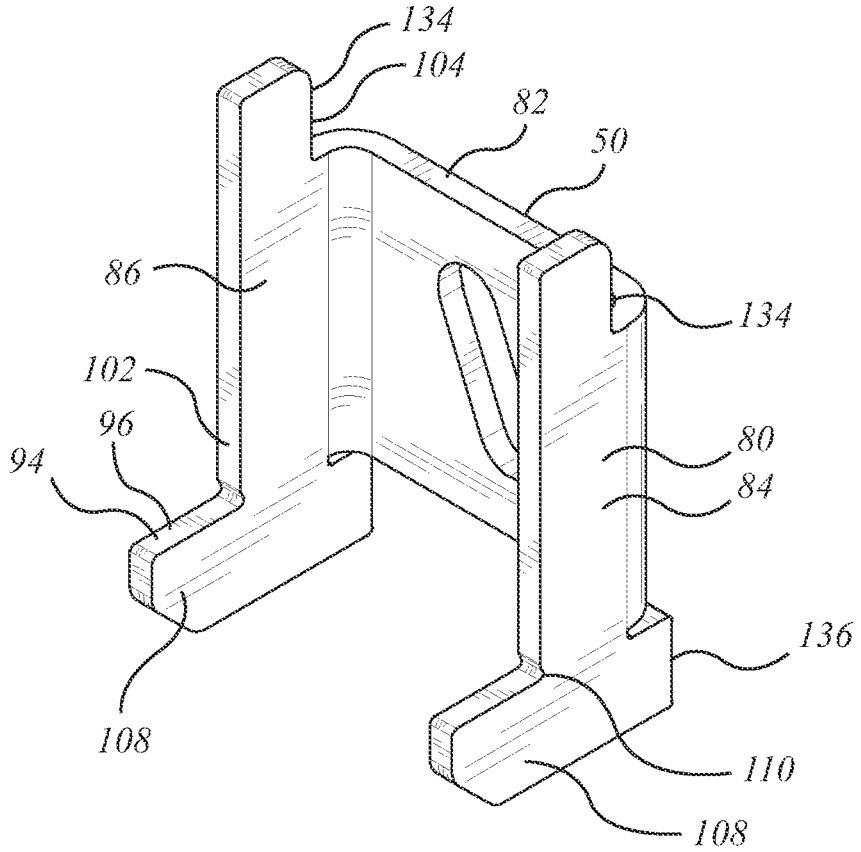
Figure 5B:
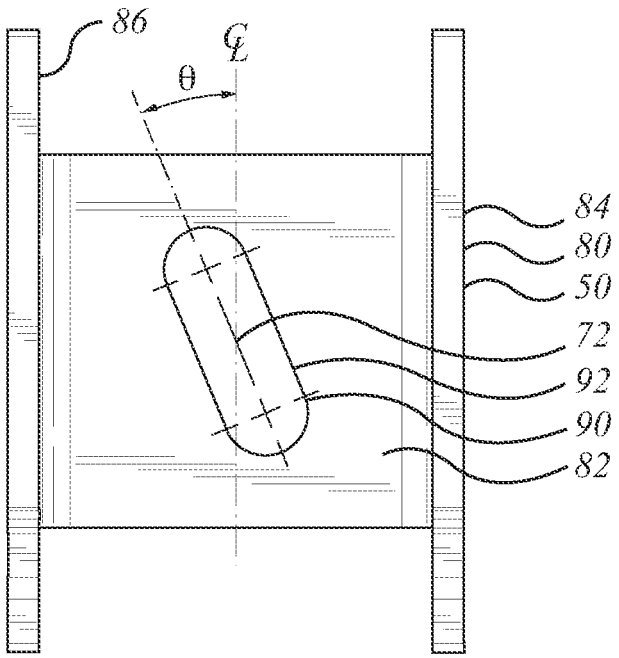
Figure 5C:
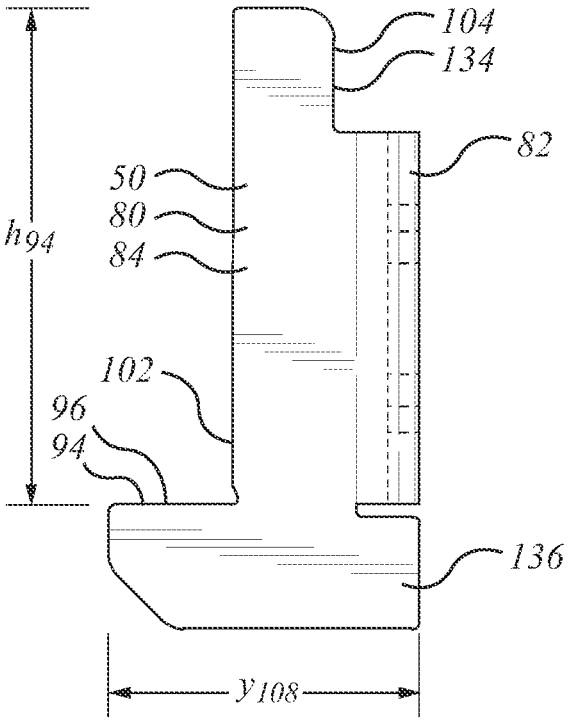
Figure 5D:
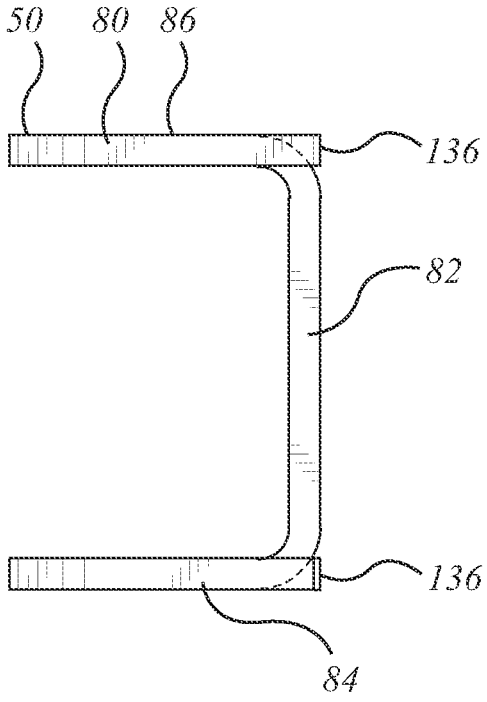
Figure 6A:
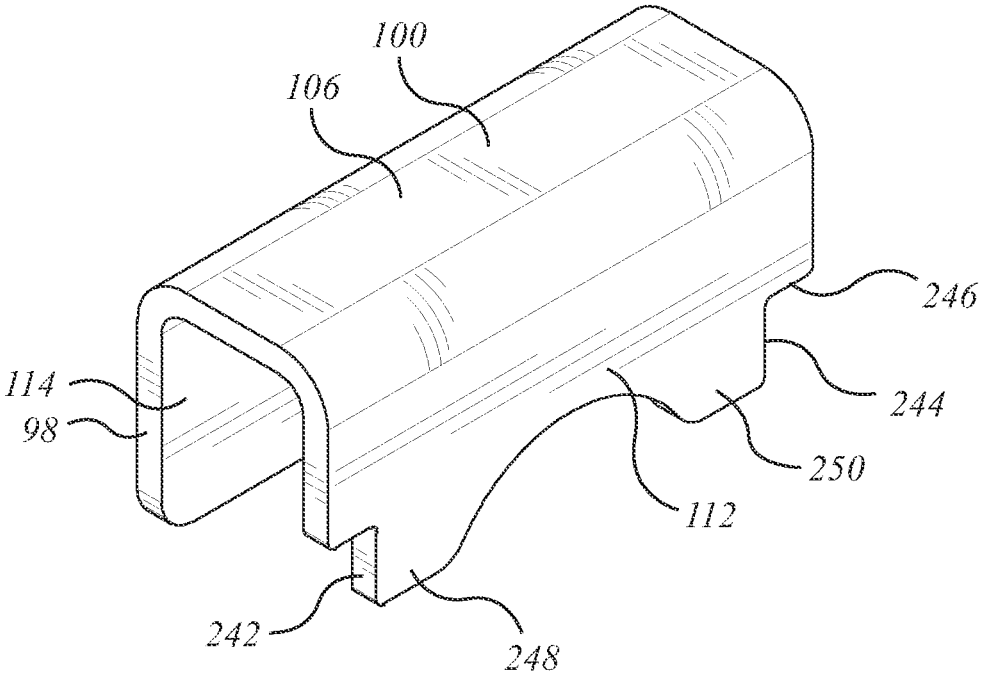
Figure 6B:
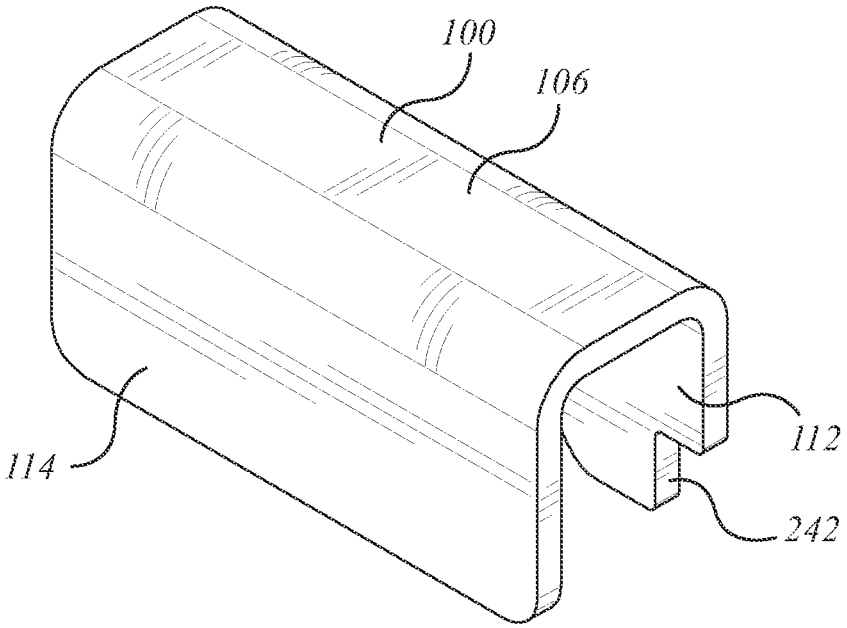
Figure 6C:
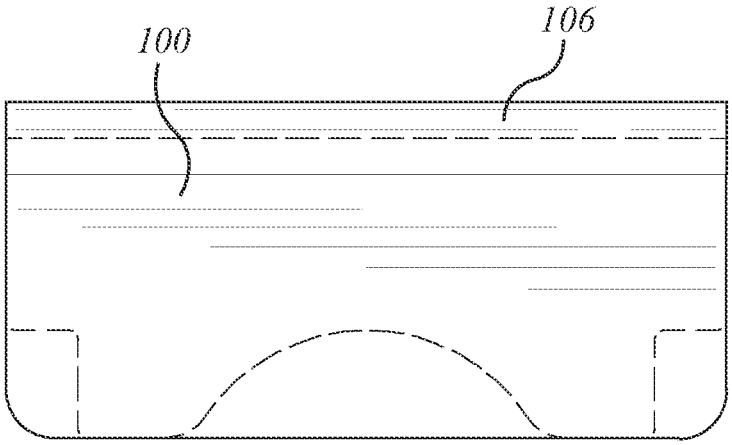
Figure 6D:
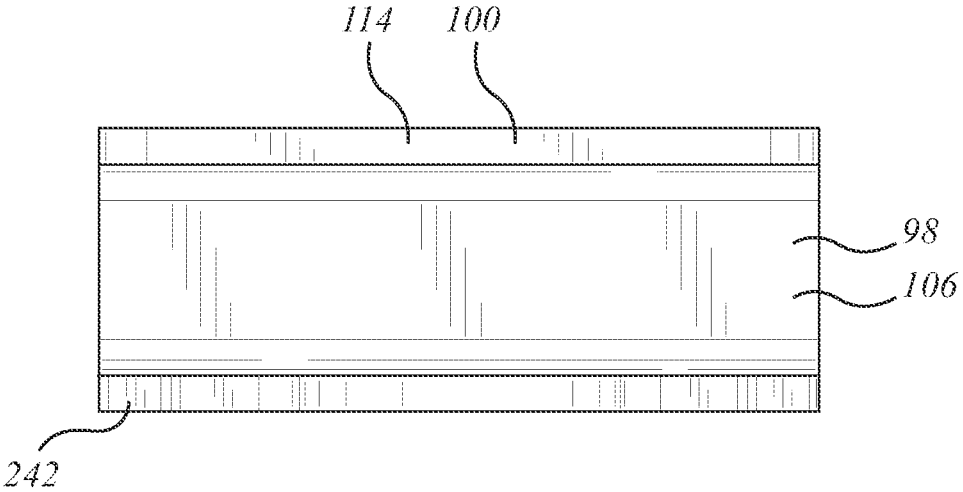
Figure 6E:
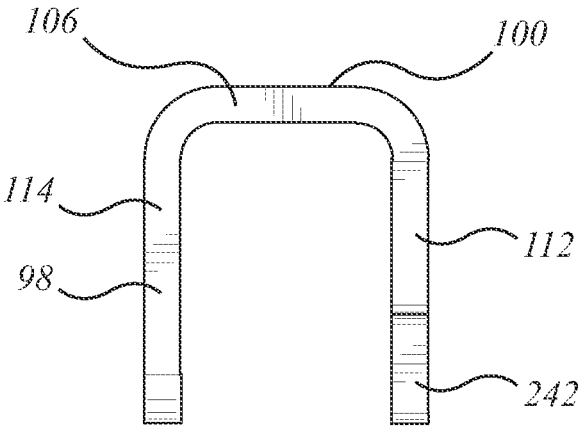
Figure 7A:
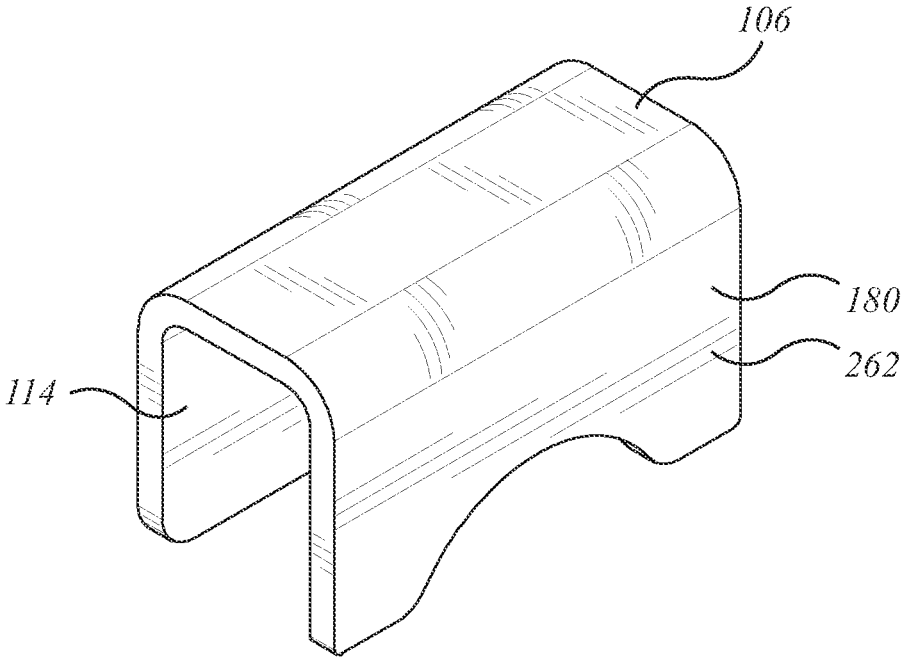
Figure 7B:
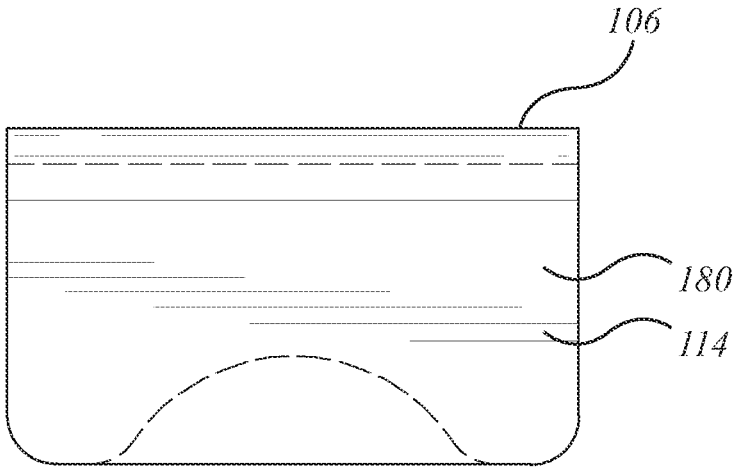
Figure 8A:
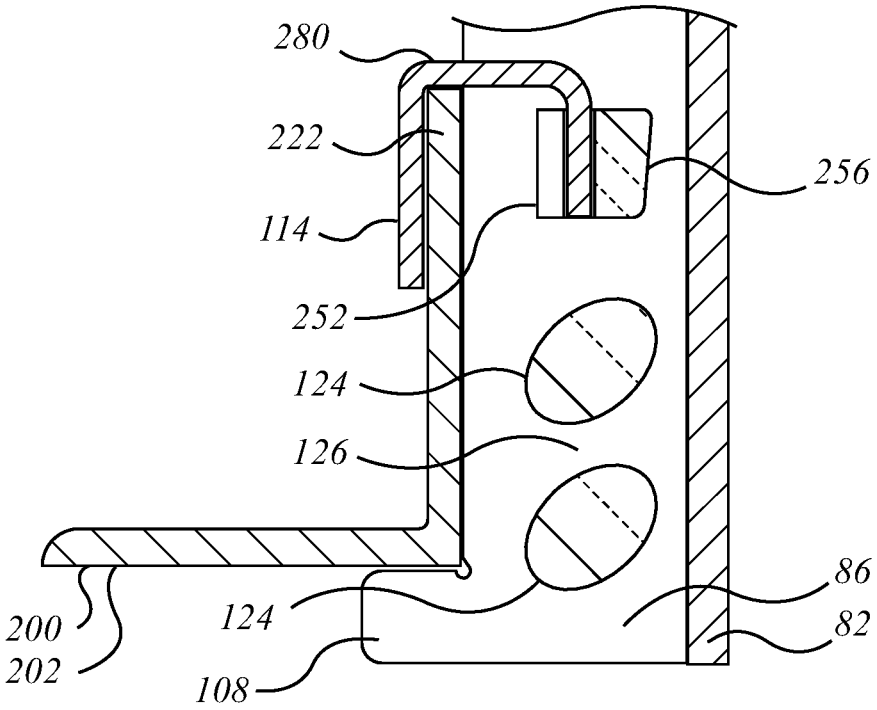
Figure 8B:
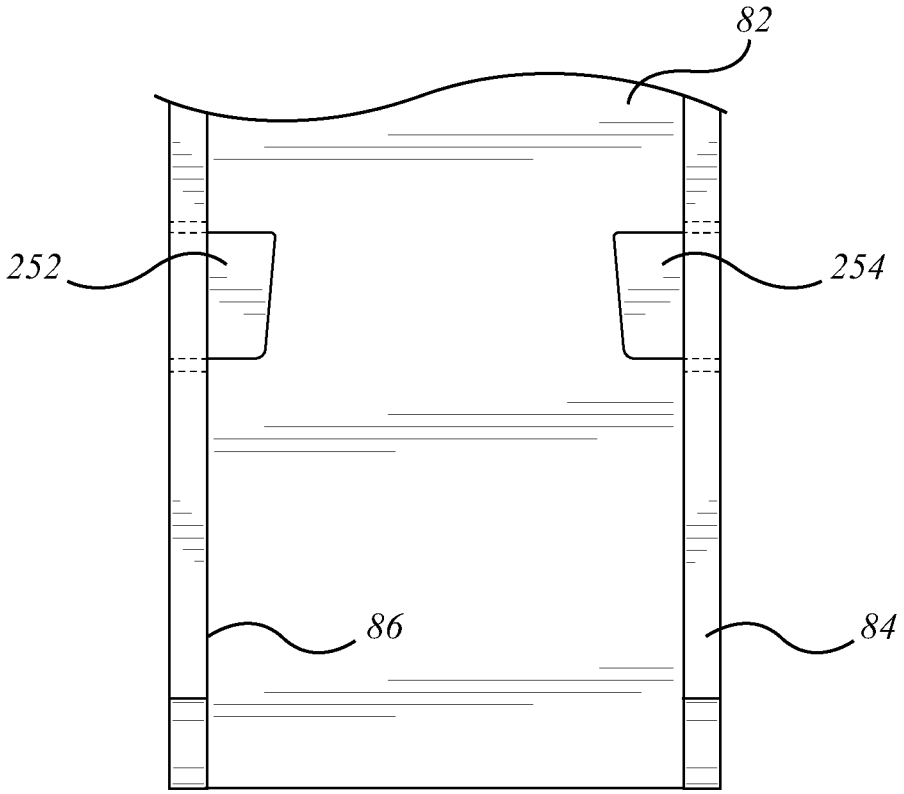
Figure 8C:
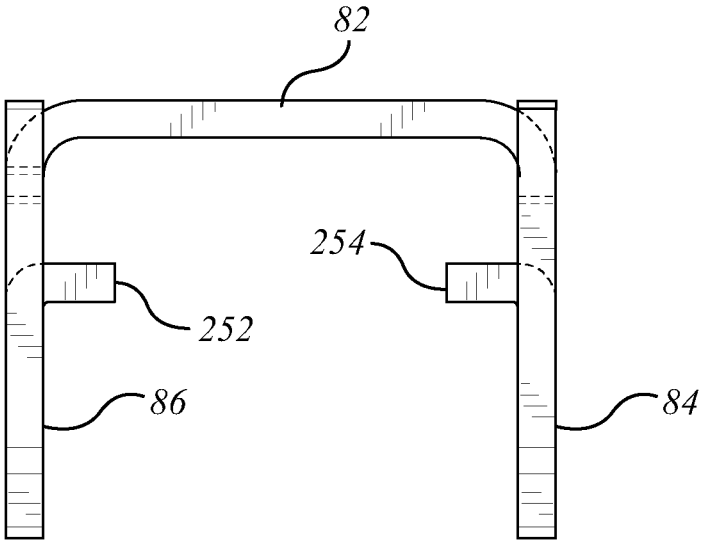
Figure 8D:
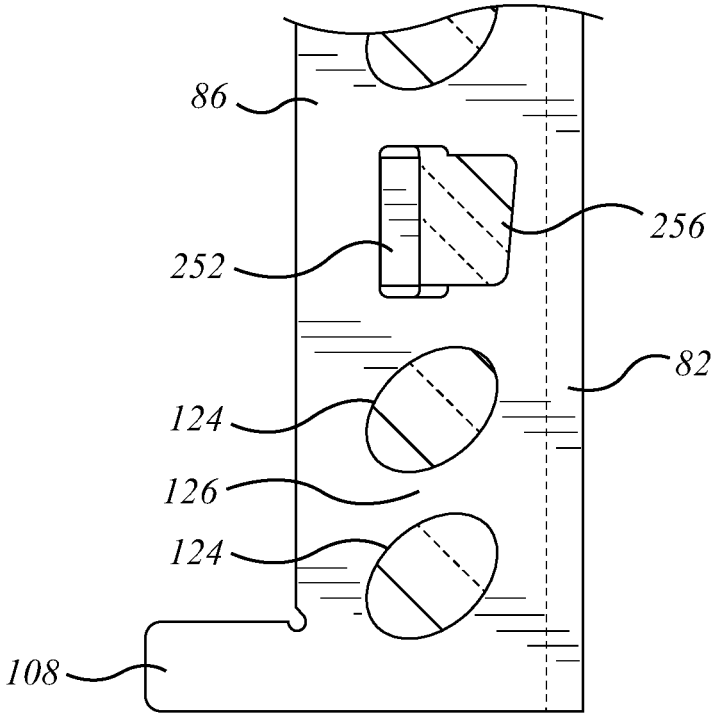

Back 82 may have a mounting, a seat, or an attachment fitting 90 such as shown in FIGS. 4*a* and 5*b* by which mechanical fastener 54 may secure bracket 52 to the load bearing structure. In general, in all of the embodiments herein a shim plate or plates 88, such as may be substantially similar in size to the anchor bracket, may be mounted between each anchoring bracket and the outer face of the wall (i.e., load-bearing wall assembly 52), as may be suitable, for evenly engaging the concrete surface and for spacing each anchor bracket 52 from the wall as desired to accommodate irregularities in the outer face of the wall and for spreading the concentrated load of mechanical fastener 54 and mounting bracket 52 into the wall structure. Fitting 90 may be a slot 92 that permits height adjustment of bracket 52. Slot 92 may be oriented at a non-parallel angle or direction that is skewed relative to the vertical axis at an angle, theta. Slot 92 may be an elongate aperture in back 82 that extends along an inclined axis 72 angularly offset from vertical. FIGS. 4*a* and 5*b* show a left-hand configuration of slot 92. A right hand configuration can also be made. In one example, the inclined axis may be offset 22.5 degrees from vertical. In a right hand configuration the fastener slot may be offset 22.5 degrees from vertical axis in the opposite direction. The upright plate of back 82 can thus be fastened to the wall at numerous locations relative to the wall corresponding to different positions of the bolt within the slot.

Figure 2D:
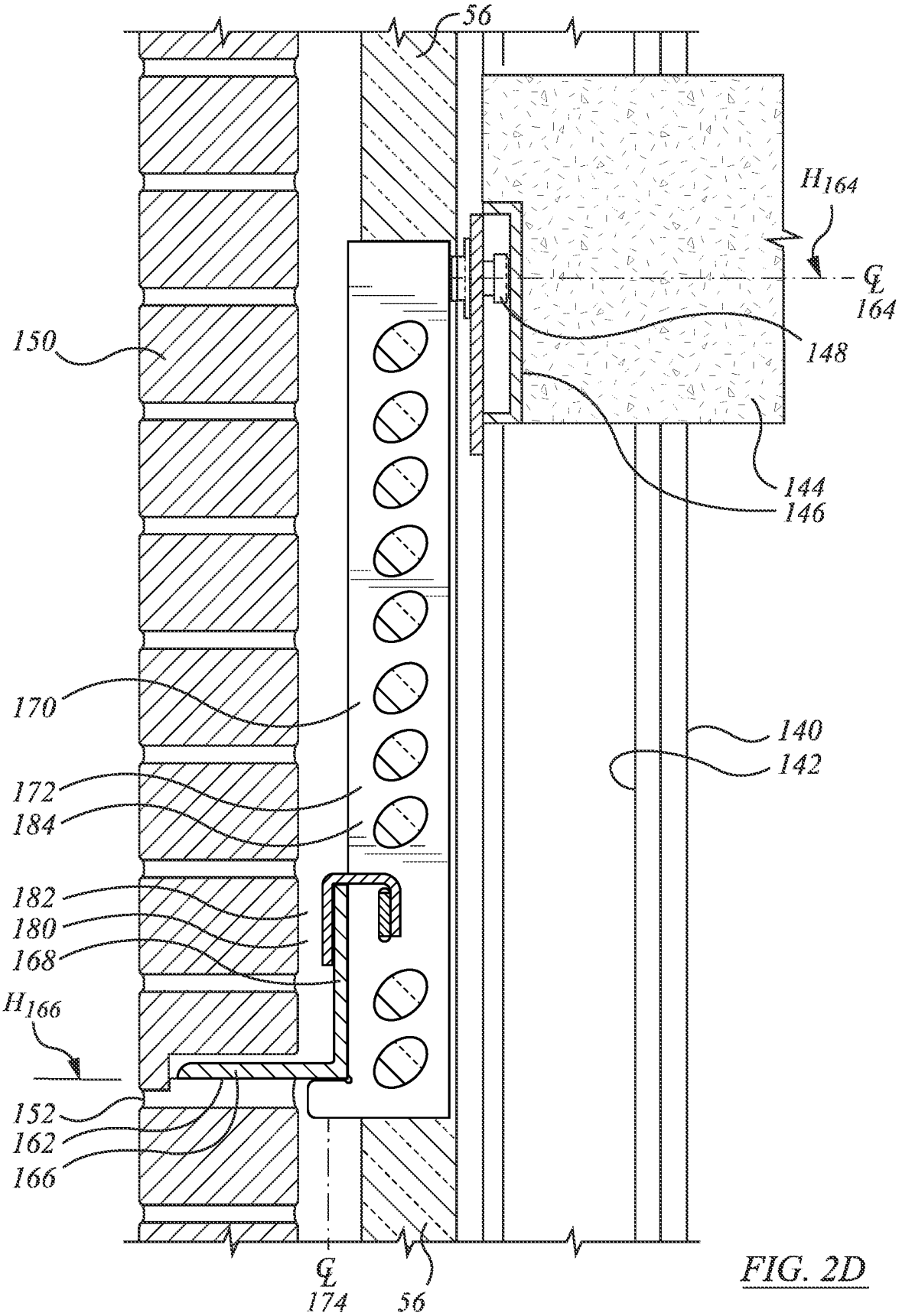
Figure 3C:
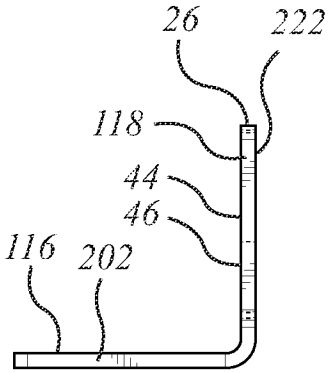
Figure 3A:
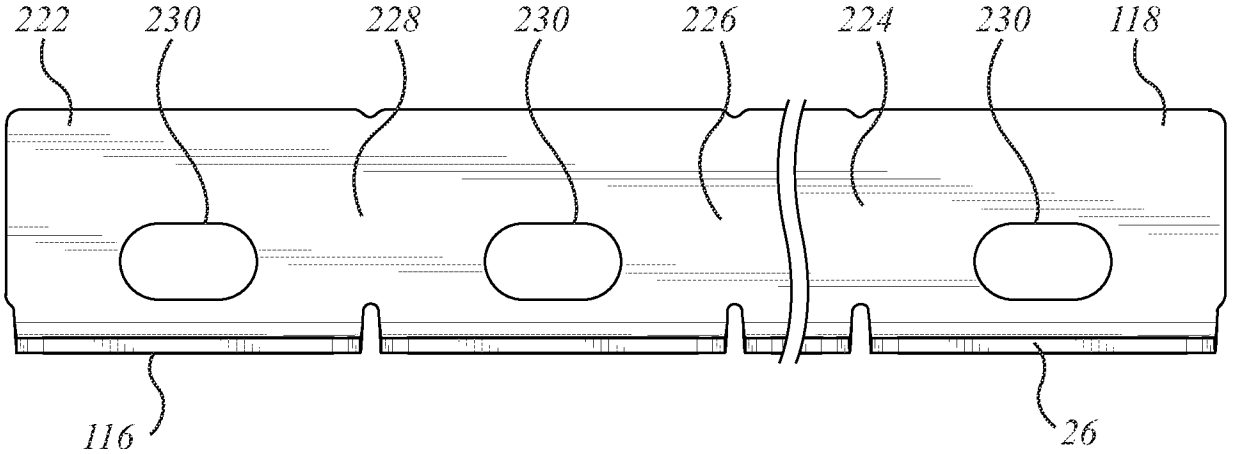
Figure 3B:
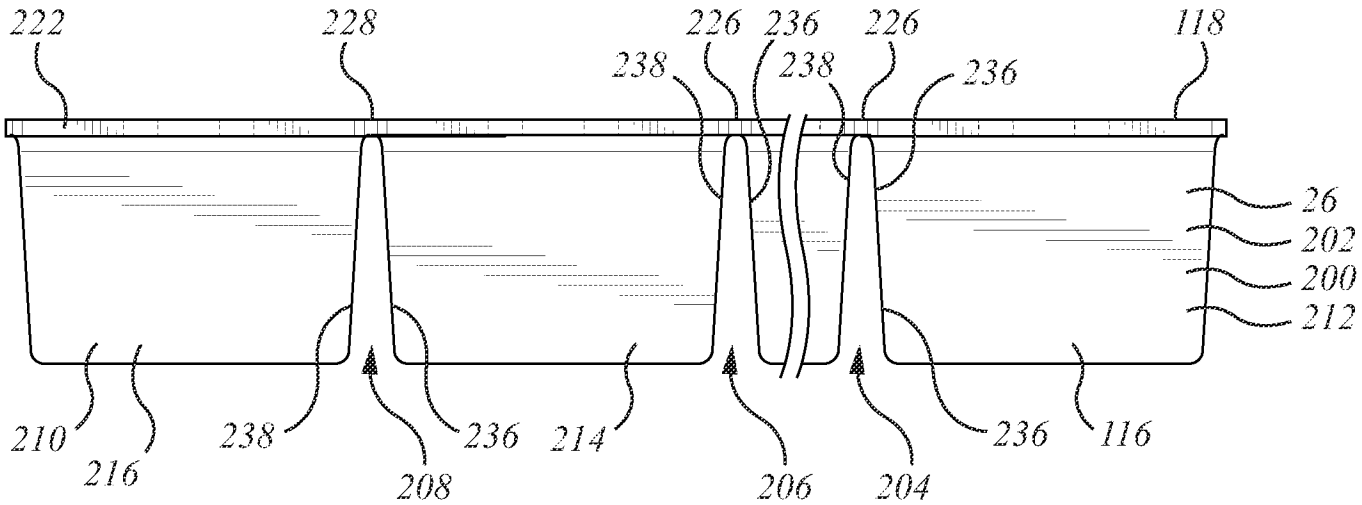
Figure 4G:
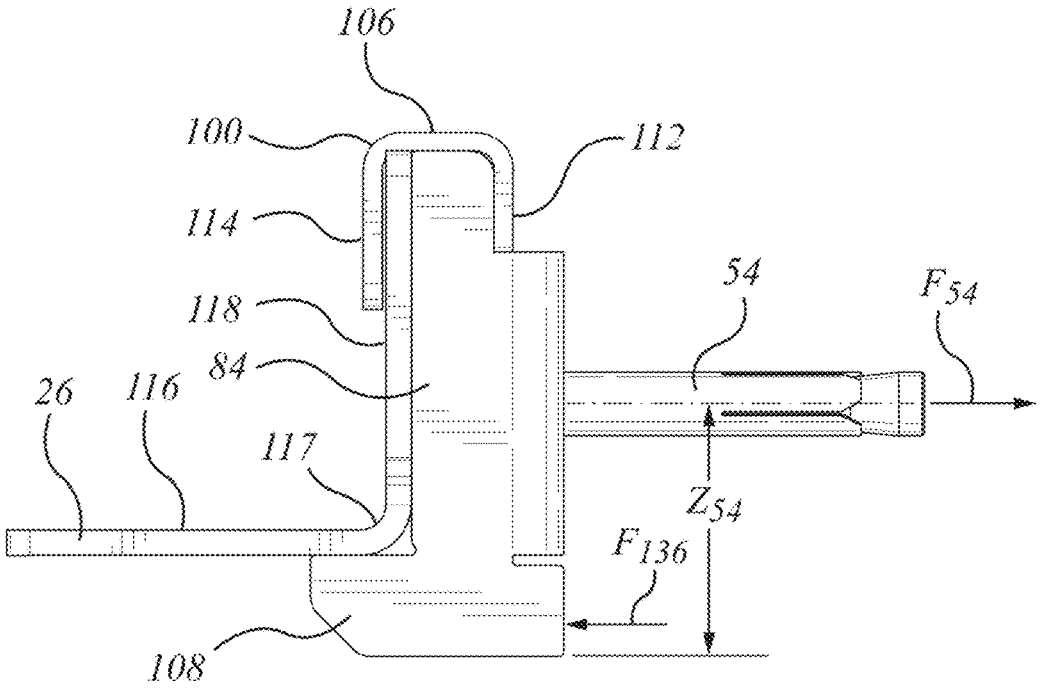

As installed, as suggested in FIG. 4*g* by arrows representing forces $F_{54}$ (in tension) and $F_{136}$ (in compression), fastener 54 may be in tension, and the lowermost edge of back 82, or the lowermost edges of the rearwardly facing feet or abutments, 136, may be compressed, i.e., pressed against the load-bearing structure, giving a reaction and a moment arm, $z_{54}$. Moment arm, $z_{54}$ is shown, notionally, as a dimension from the centerline of fastener 54 to the lowermost extremity of abutment 136. This dimension is actually the maximum possible effective moment arm if all of the compressive reaction $F_{136}$ were applied at the bottom corner of abutment 136. In reality, the reaction may be a force distributed over the height of the bearing surface, such that $F_{136}$ would really be a distributed load spread over the abutting surface, and the effective center of the reaction load is located between the top and bottom edges, somewhat higher than the bottom edge of the abutment, perhaps ⅔ of the way down the leg. Be that as it may, the graphical representation of $z_{54}$, $F_{54}$ and $F_{136}$ is intended conceptually to convey that fastener 54 is in tension, abutment 136 is in compression, and there is a moment arm such that a moment couple counteracts the moment couple of the eccentric vertical load of the masonry veneer carried on the forwardly extending shelf of the shelf angle as installed. Slot 92 may be located closer to the upper margin of bracket 52 than to the lower margin, as in the embodiments of FIGS. 2*c* and 2*d*, such that moment arm $z_{54}$ of the reaction of bracket 52, defined as the distance from the centerline of fastener 54 to the lower margin, is typically greater than half the height of bracket 52, indicated a $z_{52}$, (FIGS. 2*c* and 2*d*). In the default, the upper datum of $z_{54}$ may be taken as the mid-height location of fitting 90, namely half way up in the middle of slot 92, as in FIGS. 2*a*, 4*a* and 5*b*. Slots 92 of successive brackets 52 may be alternately left handed and right handed. That is, in use, a plurality of anchor brackets may be spaced horizontally across a wall, or along the contour of a curved wall. The anchoring brackets 52 may be mounted in an alternating arrangement of left-hand and right-hand configurations. On installation, the vertical shear load may tend to cause the brackets to wedge and lock in position on the fasteners.

The side plates defined by legs 84, 86 are receive and carry the brick support defined by bracket 46. Looking at leg 84 as being representative also of leg 86, and considering the profile shown in FIGS. 2*a*, 4*f* and 5*c*, the distal portion of leg 84 (i.e., the portion standing away most distantly from back 82) has a fitting, or accommodation, or seat 94 that is matingly co-operable with first member 44, and that provides a shear load transfer interface 96, e.g., in which a vertical gravity load from member 44 is transferred into web 84 (or 86 as may be). Seat 94 includes vertical reaction interface 96, and has a back that conforms to the shape of the back of first member 44. In the examples shown, seat 94 is L-shaped.

A moment restraint is indicated as retainer 100. Retainer 100 includes, or can alternately be named as being, an upper reaction member, a securement, anchor, key, grip, lock or lock member, and so on. In the embodiment of FIGS. 4*a*-4*f* and 5*a*-5*d*, retainer 100 has the general form or a channel 98, having a back 106 and a pair of spaced apart, first and second members or legs, or arms, or fingers 112, 114 that extend away from opposite edges of back 98. Retainer 100 may also be referred to as a clip, cleat, clasp or clamp; a lock or locking member, or key; a link; a securement or an engagement member. First leg 112 may be termed an anchor, or root, or catch, or hook. Similarly, second leg 114 may be termed an engagement member, finger, catch, claw, grip, holder, retainer or retainer member, and so on. Back 98 may be referred to, or may define, the reach or grasp, or span of retainer 100 in the y-direction. The lower portion of the back of the L-shape can also be considered to be, or to define, a lower reaction member 102. That is, retainer 100, in particular outer finger 114 of retainer 100, and lower reaction member 102 present or define a pair of moment-couple reaction surfaces that co-operate to react the moment couple produced by the weight of the masonry veneer applied at the moment arm of the eccentricity of the veneer load relative to the vertical reaction interface 96.

Leg 84 (or 86) may have a stop, or abutment, or seat, or accommodation 104 that, in use is occupied by one arm or leg, or finger 112 of retainer 100 is engaged or anchored. Accommodation 104 may be formed by trimming the upper end of back 98 and cutting a notch or relief or rebate 134 into the top end of legs 84 and 86. Back 98 may also be trimmed at the bottom end, and rearwardly extending feet 136 may remain that extend in the plane of the sidewalls, i.e., of legs 84 and 86. Retainer 100 over-reaches the upper end of the vertical leg of shelf angle 46, such that the other arm or finger, or leg 114 of retainer 100 depends or extends in front of the uppermost margin of first member 44. This may tend to prevent its escape, and tending to prevent it from rotating counter-clockwise as seen in FIG. 2*a* due to the eccentricity of the vertical load of the bricks. The inside face of the downward or distal tip of finger 114 may have the form of an abutment, or stop, or restraint that faces wholly, substantially, or predominantly in the −y direction, defining upper reaction member 100. As may be noted, during installation, retainer 100 slides downward into place to engage, i.e., to capture, the upper end of the back wall of the shelf angle to the front edges of the seats of the mounting bracket. This engagement occurs without the use of a threated fastener, or a mechanical fastener requiring plastic deformation, like a rivet or a Huck™ bolt, or a permanent joining process such as welding. That is, retainer 100 is free of mechanical fasteners, such as bolts, rivets, and the like. One or other, or both, of legs 112 and 114 may be bowed slightly outward, and angle slightly inward toward the tip, such as to form a spring having toes that deflect to provide a spring load. This deflection can be very small and yet still achieved the desired deflection and spring load.

Vertical reaction interface 96 may be defined as the upper face of the toe, edge, or side of an extending portion or member, or abutment, or stop, or lug, or dog, or toe 108, however it may be called, such as may be or may define a protruding extension or protrusion in the y-direction of the lower margin of leg 84. That is, in the embodiment illustrated the recessed channel shape of seat 94 includes a shoulder at a bottom end. That shoulder defines vertical reaction interface 96, and it carries the shelf angle, such that the brick supporting flange extends laterally outward from the wall.

Lower reaction member 102 extends upwardly and away from the root of toe 108, and has the form of a wall or edge that faces wholly, substantially or predominantly in the +y direction. A fatigue detail, or stress relief detail, in the form of a finite radius relief 110 is provided at the root of the intersection of vertical reaction interface 96 and lower reaction member 102. The upper and lower stops (i.e., 100 and 102) constrain the translational degree of freedom of corresponding upper and lower regions of the back of angle iron 46, and thus define a moment-couple reaction inhibiting motion in the rotational degree of freedom about the x-axis of angle iron 46 in the counter-clockwise direction.

The overall height of seat 94 may be taken from the vertical shear transfer receiving interface of shoulder 96 to the uppermost extremity of the vertical leg 118 of shelf angle 44, and is indicated as $h_{94}$ in the various Figures. In this embodiment, shelf angle 46 is mounted at a height that corresponds generally to the height of the attachment interface of back 82 to the load-bearing support wall structure. This may be expressed several ways. First, it may be expressed in the relative squareness of the mounting bracket when seen in side view, as in FIG. 2*a* and in the alternative embodiments of FIGS. 2*b*, 2*c* and 2*d*. The most distant extremity of toe 108 is defines a distance, pos. In the embodiments of FIGS. 2*a* and 2*b*, $y_{108}$ may be comparable to the overall height of member 50, indicated as $z_{52}$, such that the ratio $z_{52}/y_{108}$ may lie in the range: $2/3<z_{52}/y_{108}<3/2$.

As another measure of squareness, the lateral projection of fastener 54 falls between the upper and lower boundaries of seat 94. Expressed differently again, the projection of the y-direction of mounting fitting 90, namely slot 92, falls within the projection of seat 94 in the y-direction. This may be expressed equivalently as the projection of seat 94 in the y-direction including the footprint of the mounting fitting, where that footprint is defined by the y-direction projection of the inscribed perimeter of the contact of back 82 against the mating support structure. Either of those conditions also implies that the y-direction projection of shelf angle 46 also falls upon the mounting fitting footprint. As another expression of the squareness, it may be said that seat 94 lies opposite to mounting fitting 92, or generally substantially or predominantly in line with mounting fitting 92, as opposed to being offset downwardly therefrom as in the apparatus of FIGS. 2*c* and 2*d*, discussed below.

The brick support defined by angle iron 46 may include a mounting flange which engages anchor bracket 50, and a supporting flange arranged to carry bricks. The mounting flange and the supporting flange may typically be mounted at right angles to form an L-shaped angle iron, typically made of steel. As in the various Figures, angle iron 46 has a first or horizontal leg 116 and a second or vertical leg 118. Horizontal leg 116 extends forwardly (in the +y direction) away from vertical leg 118, and hence on installation also forwardly and away from bracket 52. Horizontal leg 116 runs along the wall structure in the x-direction. Typically the running length of the angle iron is much greater than the horizontal leg length. For example, in one embodiment the running length may be 72 inches, while the leg of the angle may be 6 inches or less. In various embodiments the x:y aspect ratio of lengths may be in the range of 4:1 to 16:1. In other embodiments the running length may be 20 ft. or 40 ft., or a portion thereof as cut-to-length, giving an aspect ratio of 4:1 to 100:1. Bracket 52 may be cut to length as may suit. As installed, the length of leg 116 proud of the end of toe 108 in the y-direction, Lao, may have a length corresponding to the depth in the y-direction of the facing members to be supported. In the case of face brick, that length corresponds to the depth of the face brick. In some embodiments it may be somewhat less than the depth of the face brick to permit the iron to be less noticeably visible, or to be hidden as in FIG. 2*b*.

In the embodiment of FIG. 2*b*, vertical leg 118 has an accommodation, slot, aperture, socket, or relief, or reliefs 120 spaced upwardly from the junction of members 116 and 118. The lower margin of relief 120 may be located at or above the run-off of the rolled radius 117 between members 116 and 118, i.e., in the tangent portion of vertical leg 118, rather than in radius 117. Reliefs 120 are sized to receive the dogs, or toes 108 of web members 84 or 86. They are over-sized in the x-direction to permit lateral adjustment of bracket 52, as, for example, according to the fastener position along inclined slots 92. For half inch thick legs, the slot may be 2.5 inches wide, giving, potentially, one inch play to either side of center. The height of the slot may be slightly oversize to permit rotating installation of bracket 52. The vertical through thickness of each toe 108 may be 1" or more.

In the engagement of toe or dog 108 in accommodation or relief 120, as may be, it may be that the lowermost margin of leg 84 (or 86) does not extend lower than (i.e., downwardly proud of) the bottom of horizontal leg 116, such that no additional vertical clearance allowance is required for toe 108, meaning that the toe is concealed behind the external veneer and the bottom edge of the lowest course of bricks may be lower than otherwise. Expressed differently, in terms of a seating arrangement of structural members, second member 50 may be considered to be the receiving member, and first member 44 may be considered to be the received member. In the arrangement of FIG. 2*b*, the received member is flush with, or extends downwardly proud of, the lowermost portion or extremity of the receiving member and may tend to conceal the receiving member from view. The engagement of the receiving and received members is a mechanical interlocking relationship that is biased into securement by gravity acting on the load. That is, while the angle iron may be adjustable and engageable while unloaded, the loading of bricks or other surface elements may tend to increase the moment couple on the angle iron, such as may tend to tighten the hold of the moment couple reaction members of the receiving member.

The received member, such as the shelf angle identified as angle iron 46, is itself a receiving member, or accommodation, for the externally visible facing elements, and as the facing elements are received, rearward structure such as bracket 52 is obscured from view. The received member need not be an angle iron, and whether or not it is an angle iron, is need not have a 90 degree angle. In more general terms, the received member has a first portion that defines a seat or bench, or accommodation, or support, or platform or under-girding, or shelf, for the externally visible facing members, hence the term "shelf angle". It is a form of sill. The received member also has a second portion that engages the receiving member such that vertical load from the received member is transmitted or carried into the receiving member and thence into the load-bearing supporting structure. In that sense the second portion can be thought of as an engagement fitting, or key, or inter-locking feature, or indexing feature, that mates with the receiving member. It happens that an L-shaped angle iron may be a convenient form having these properties.

Considering FIG. 2*b*, mounting support bracket 130 is similar to mounting support bracket 52, except that it is deeper in the y-direction, and the toe 108 is formed to fit through the apertures 120 in the shelf angle 46. This greater depth may correspond to a greater thickness of insulation, such as thermal insulation panel 56. To accommodate this greater depth, a lock or key, or bracket such as retainer 100 could be used with a correspondingly longer reach of its back 106 in the y-direction. However, as shown, rather than over-spanning the entire depth of the side leg 154 of the bracket, mounting support bracket 130 has a mid-depth accommodation or slot or seat or notch 132, that is sized to receive first leg 112 of retainer 100.

In the embodiments shown in FIGS. 2*b*, 2*c* and 2*d*, inasmuch as each leg 84, 86 or 154, may pass through the wall insulation panels 56, each leg may also have an array of apertures as at 124, such as may reduce the section for heat transfer in the y-direction. In some embodiments apertures 124 may be non-circular, and may have an oval, oblong, or elliptical form. The form of aperture may have a long axis and a short axis. The long axis may be inclined at an angle to the perpendicular. In one embodiment the angle of inclination may be about 45 degrees. The interstitial strips 126 between adjacent apertures may tend to be correspondingly inclined on a generally diagonal angle. On the diagonal angle, the diagonal may be oriented from outwardly and downwardly to upwardly and inwardly, i.e., the mean slope dz/dy in FIG. 2*b* is negative. As such, a vertical load imposed at interface 96 may tend to place members 126 in tension, or to impose a tensile load component in them.

Support assemblies 26 need not be located only at the lowermost course of facing elements 40, but may be located at intermediate heights, with bricks both above and below the support bench defined by the horizontal leg of the shelf angle. Such locations may occur at horizontal control joints, employed in structures having wall heights over 30 ft. A shelf angle may be used for each successive storey. The height of the structure to which the support assembly may be mounted may not necessarily be the height of the structure at which the shelf angle is to be located. There may be circumstances when the shelf angle is to be located some distance below the level of the securement to load-bearing structure.

Considering FIGS. 2*c* and 2*d*, structural load-bearing wall assembly 140 may have steel framing 142 and a floor slab 144. A hard-point, or rail, 146 is located at the end of floor slab 144. A mounting fitting 148 is secured to rail 146. An external facing veneer assembly is identified as 150. Veneer assembly 150 has a horizontal expansion joint 152. Veneer assembly 150 is connected to wall assembly 140 by a vertical load transfer assembly 160 that, as before, includes a first member 162 and a second member 164. First member 162 may be the received member, and may be a shelf angle. It may have a first portion, horizontal leg 166; and a second portion, upright leg 168. The shelf angle, and in particular horizontal leg 166, may be located at the position of horizontal expansion joint 152, such that it bears the vertical load of that portion of wall assembly 150 extending upwardly thereof. Second member 164 may be the receiving member with which it co-operates, and may be a channel-shaped bracket 170. As before, the receiving member 164 is rigidly secured to the load bearing wall structure, namely wall assembly 150. On installation, the back of bracket 170 lies in facing abutment against the load bearing wall structure in the same manner, or substantially the same manner, as member 50 described above, and where the wall is vertical, bracket 170 is correspondingly vertical. The load output interface of vertical load transfer assembly 160, namely the connection to the load bearing wall, is located at a first height, identified as $H_{164}$. The load input interface of assembly 160, at which the vertical load of the external veneer or cladding is received at leg 166, is identified as a second height, $H_{166}$ and passed into the vertical load input interface of bracket 170 at the upper shoulder of toe 174. The first height is substantially higher than the second height.

That is, $H_{166}$ lies at a level that is below the height of the bottom margin of the floor slab, and at a height that is more than two brick courses (i.e., more than 6") below $H_{164}$. Side web or leg 172 of channel or bracket 170 is much deeper in the z-direction (see $H_{172}$) than is the depth of the accommodation for the shelf angle, i.e., first member 162, identified as $H_{168}$. The overall height of leg 172 is greater than the height $H_{172}$ from the vertical load input interface from the shelf angle (at $H_{166}$) to the vertical load output interface (at $H_{164}$).

In FIGS. 2*c* and 2*d*, second member 164 may have the same mounting arrangement and adjustability as back 82 of bracket 46. The receiving seat or accommodation may differ, though. That is, there may be a vertical load reaction member, in the nature of a protruding toe 174 having an upper shoulder or side, or face, upon which shelf angle 162 rests. A relief or slot, or rebate, or accommodation 176 may extend upwardly therefrom. In the embodiments of FIGS. 2*c* and 2*d*, insulation 182 is located in the space between load-bearing wall assembly 140 and veneer assembly 150. Insulation may also be located within the mounting bracket, second member 164, or within any of the other mounting brackets shown or described herein. Bracket 170 of FIG. 2*d* may be understood to be the same as bracket 164, of FIG. 2*c*, except insofar as discussed below.

In FIGS. 2*c* and 2*d*, if one defines a load center at the vertical load input interface of the seat, notionally $C_{174}$ and another load center at the connection point, or centroid, of the fastening connection or connections to the load-bearing wall structure, notionally $C_{164}$, the line of action constructed between those centers extends upwardly and toward the load-bearing structure. That line of action is predominantly upwardly oriented, i.e., the rise is greater than the run, as suggested by the ratio of $\mathbf{172}_{Rise}/\mathbf{174}_{Run}$. This may also be expressed in terms of the hanging, non-square nature of the mounting brackets of FIGS. 2*c* and 2*d*. In these embodiments the y-direction projection of the seat does not fall on the footprint of the mounting fitting, but rather falls well below it. The seat is not in line with the mounting fitting. On the contrary, the seat is downwardly displaced from the centerline of the mounting fitting at $C_{164}$ by several pitches of the seat height, $H_{94}$. or $H_{46}$, as may be. The overall height of the leg of the mounting bracket may be as much as 5 ft. The overall height of the downward offset of seat 94 (or, from the other perspective, upward offset of fitting 148 or 54) is more than one pitch of the seat height, and may be up to 16 or 18 pitches. In another embodiment the ratio may be in the range of 3 to 8 pitches of the seat height.

In each case the general description of installation and use is substantially the same. That is, a brick support in the form of a standard size shelf angle is mounted across the wall on the anchoring brackets. The anchoring brackets are first bolted to the wall by securing the bolts loosely by hand. The brick support is then mounted on the anchoring brackets by placing the shelf angle in the seat. Once the shelf angle is seated, retainer 100 is installed, in these examples by downward vertical translation so that retainer clasps the vertical leg of shelf angle 44 to mounting bracket 52. The rearward edge at 102 prevents the brick support from being further pivoted within the recessed channel under the increasing moment couple as the weight of the bricks is applied to the brick support.

Until the nuts on the respective bolts are tightened, the relative height of each anchoring bracket is adjustable by sliding the anchoring bracket laterally along the brick support as the anchoring bracket is moved upward or downward relative to the bolt extending from the wall. This lateral movement of the anchoring bracket relative to the brick support with the adjustment in height is due to the inclination of the fastener slot from the vertical. Once the nuts are tightened on the bolts the brick support is secured to the load-bearing wall structure, and bricks may be supported thereon. The inclination of the fastener slot from the vertical acts to inhibit vertical displacement of the anchoring bracket along the mounting bolt through the resistance of the lateral movement of the anchoring bracket along the brick support. Having anchoring brackets of opposing orientation mounted adjacent to each other further restricts the entire brick anchor system from shifting positions relative to the wall once the bolts are tightened. The relative location of the anchoring brackets remains adjustable as the brick support is mounted thereon for accommodating irregularities in the wall or misalignment between adjacent anchoring brackets. Once the brick support is securely fastened to the wall further vertical displacement of the anchoring brackets is inhibited by the resistance of lateral movement of the anchoring brackets relative to the brick support due to the arrangement of the fastener slot.

In FIGS. 2*a* and 2*b*, shim plate or doubler or load spreader 88, similar in size to the anchoring bracket, may be mounted between each anchoring bracket and the outer face of the wall for evenly engaging the concrete surface and for spacing each anchoring bracket from the wall as desired to accommodate for irregularities in the outer face of the wall.

Returning to FIGS. 1*a*-1*h*, the shelf angle, identified as second member 50, is seen in perspective, top, and front views. A traditional shelf angle tends to be formed of an angle iron of constant cross-section, that runs in a substantially straight, and usually level, line across a wall or portion of a wall, the wall being substantially planar. In a traditional shelf angle, the respective second moments of area, $I_{xx}$ and $I_{yy}$, for vertical or horizontal bending, and therefore the flexural modulus EI, tend to be constant.

Second member, or shelf angle, 44, however, is made of shelf angle in the form of an angle iron 200 that is segmented. That is, the horizontal leg 202 of angle iron 200 has reliefs formed therein, as at 204, 206, 208 and so on. Consequently, rather than being a continuous web, horizontal leg 202 has a series or array 210 of discrete tabs, or sub-shelves, or supports, or support legs or toes, or segments 212, 214, 216, 218, and so on. The notch or relief may be slightly V-shaped or tapering when seen from above in the un-deflected condition, such that it is wider at the distal, outside end or margin; and narrowest nearest the root at the vertical flange. Notch or relief 204, 206, 208 may extend through the bottom or lowermost portion of vertical flange, web, or leg 222, and may extend upwardly beyond the radius of the curve at the transition or junction between vertical leg 222 and horizontal leg 202 of shelf angle 44. The removal of the materials from the array of reliefs means that structural connection of the segments is limited to that provided by the linking of vertical leg 222. At these locations between the segments of the horizontal shelf, the remaining upstanding back or flange or web is effectively formed into an in-plane line connection (i.e., the line is in the plane of vertical leg 222) or neck, or hinge, 224, 226, 228. In this location, or neck, the second moment of area Iyy in bending about the vertical axis has been reduced from that of angle iron 200 generally to that of the neck or hinge, which is much less, being the in-plane second moment of area of the web, alone. The neck is comparatively flexible, and can be thought of as a bending location, or hinge, at which shelf angle 200 may tend to bend more easily than elsewhere. The neck can also be considered as a spacer, or index, or reference, or datum, that sets or fixes maintains the arc length, or path length, between adjacent segments of shelf angle 200 on installation. The back or vertical leg 222 of the various segments of angle iron 200 (i.e., of shelf angle 44) may include a lightening or access aperture 230 that may provide access to the head of the nut of mechanical fastener 54. On installation, the back follows an arc or path, whether straight or bent at the necks between the angle segments. In an angle such as one of the segments shown, the neutral axis of the second moment of area relative to bending about a vertical axis will lie in a plane that is perpendicular to the horizontal leg, located forwardly of the vertical leg. In the neck region, the neutral axis in bending will lie within the through-thickness of the vertical leg, and may lie in the middle of the section. Accordingly, the neck will be easier to bend than the adjacent angle, as the second moment of area, Iyy, will be smaller.

As described above, shelf angle 44 is linked to the supporting wall structure by an array of mounting brackets, as exemplified by the mounting bracket of support assembly 26. Traditionally, an array of such mounting brackets (be it as few as a spaced-apart pair) would be mounted on a planar wall. However, while shelf angle 50 may be mounted in the traditional manner as a straight-line element, it can also be mounted to an arcuate surface, such as a curved wall, symbolized by the circular arcs 232, 234 of FIG. 1*h*. When the curve is concave, as along arc 234, the adjacent edges 236, 238 of each notch or relief 204, 206, 208 are rotated toward each other such that the relief closes up to some extent. When the curve is convex, as along arc 232, the adjacent edges 236, 238 of each notch or relief may tend to splay further apart such that the notch or relief widens.

Insertion of the various segments of angle iron 200 into the mounting brackets is in translation in the radial direction. In this form of installation, the angle iron is not rotated into a seat, as in U.S. Pat. No. 6,128,883 of Hatzinikolas, but rather moved radially. On installation, a first segment, such as end segment 212, is seated in its mounting support bracket, and a retainer is installed, locking segment 212 in place. Angle iron 200 is deflected to wrap around the curvature of the arc of the wall, as on arc 232, such that the further segments 212, 214, 216, or 218 are positioned to conform to the arc. When segment 216 or 218 is in place, a further clip or retainer 100 is installed. Bending of angle iron 200 at its various hinges 224, 226, 228 and so on occurs, as angle iron 200 is deflected to wrap on the contour of the wall structure, with additional clips or retainers 100 being installed at corresponding mounting support brackets along the curve.

In an alternate embodiment, the shelf angle may be supplied not as a single monolith that spans several mounting brackets, whether that shelf angle is a straight line or flexible into a noon-straight line installation. That is, the shelf angle may be supplied as the discrete segments 212, 214, 216, 218 themselves. Each discrete segment may then be mounted to its own mounting bracket 52, (or such other embodiments as may be, as seen, for example in the other embodiments described herein) and locked in place with a respective retainer 100. Where individual segments are used, the older style of mounting bracket, with an overhanging finger and partial rotation on installation may also be employed, since there is no out-of-plane flexing of the shelf angle. An array of such segments and brackets may form an array positioned to support the masonry veneer members of a wall. In the array, the adjacent shelf edges may be placed as closely together as if the vertical webs of the back were joined and bent, but are not. In some embodiments, the vertical webs or flanges of the neighbouring segments may be positioned to abut each other. In that example, rather than the shelf angle being continuous and flexible, the segments are discontinuous.

Retainers 100 are suited for use in such an incrementally installed curved angle iron 200, because they can be installed one-at-a-time sequentially. In the seat style of U.S. Pat. No. 6,128,883 of Hatzinikolas, the vertical leg of the shelf angle must be installed in all of the support mounting brackets at the same time, and the shelf angle must be substantially straight as it is rotated into position. Here, even when installing a straight shelf angle, the one-at-a-time installation of the clips or retainers permits simpler and more forgiving installation, with the retainer cinching the back of the shelf angle into final position as it is installed. Since the clip has a lateral extent (i.e., in the x-direction) as it is installed that is quite a bit less than the lateral extent of the vertical leg of the particular segment, possibly in the range of ½ to ¾ of that length, there is room for adjustment where the segment is not precisely centered on the support mounting bracket. As may also be noted, installation of the shelf angle, e.g., angle iron 200, involves translation in the x-direction, without the need for rotation as the angle is being installed. The degree of freedom of the installed lock, or locking member, namely retainer 100, is different from the degree of freedom of installation of shelf angle 200. That is, in the example the degree of freedom of the locking member is vertical. However, it need not be perpendicular, but could be angled, or set on a taper or wedge such as might tend to tighten as retainer 100 is driven into place. The motion of installation of retainer 100 is independent of the direction of motion of installation of shelf angle 200.

Looking at retainer 100 in FIGS. 6*a* to 6*e*, the rearward leg, or first leg 112 may have notches 242, 244 at each lowermost corner. The un-notched depth as at edge 246, corresponds to the depth of the relief formed in back 98, such that the downwardly extending members, or dogs or abutments, or tabs or tangs, however they may be called at 248, 250 are blocked laterally by side webs 84, 86 on installation, thus tending to prevent lateral disengagement of retainer 100 in the embodiment of FIG. 2*a*. In the embodiment of FIG. 2*b* the same effect is achieve with a vertical slot 132 into which leg 112 seats, with members 248, 250 again being trapped by the side webs or legs 84, 86. That is, relief 134 or 132 immobilizes retainer 100 in the degree of freedom of translation in the x-direction, and the relationship of members 248, 250 trapped by, or in engagement with, sidewalls 84, 86 bounds freedom of motion in the y-direction such that retainer 100 cannot escape laterally once installed. Gravity and friction prevent escape in the degree of freedom of vertical translation in the z-direction.

The embodiments of FIGS. 2*c* and 2*d* have long-legged mounting support brackets 164, 170 as discussed above. However, in these cases the upper edge of the vertical flange of shelf angle 50 is far below the top edge of support mounting bracket, be it 164 or 170.

In the embodiment of FIG. 2*c*, and of FIGS. 7*a*, 7*b*, and 8*a*-8*d*, one of the pitches of lightening holes 124 is omitted, or adjusted, such that a pair of first and second, or left-hand and right-hand members, such as may be termed reaction interfaces, dogs, catches, stops, abutments, hooks, anchors, wings, tangs or tabs 252, 254, are bent inwardly from metal. By being bent inwardly the metal vacates part or all of sidewall openings 256. Retainer 180 is substantially the same as retainer 100, except that its ends have been trimmed so that the overall width $W_{180}$ of retainer 180, is narrower than the space between side webs or legs 84, 86 of bracket 250. In this instance, freedom of motion laterally is inhibited by webs or legs 84, 86, and motion in the +x direction is inhibited by the interaction of rear leg 262 with members 252, 254. The relationship of front leg 114 with the upper margin of vertical leg 118 of shelf angle 54 is as before.

Figure 9A:
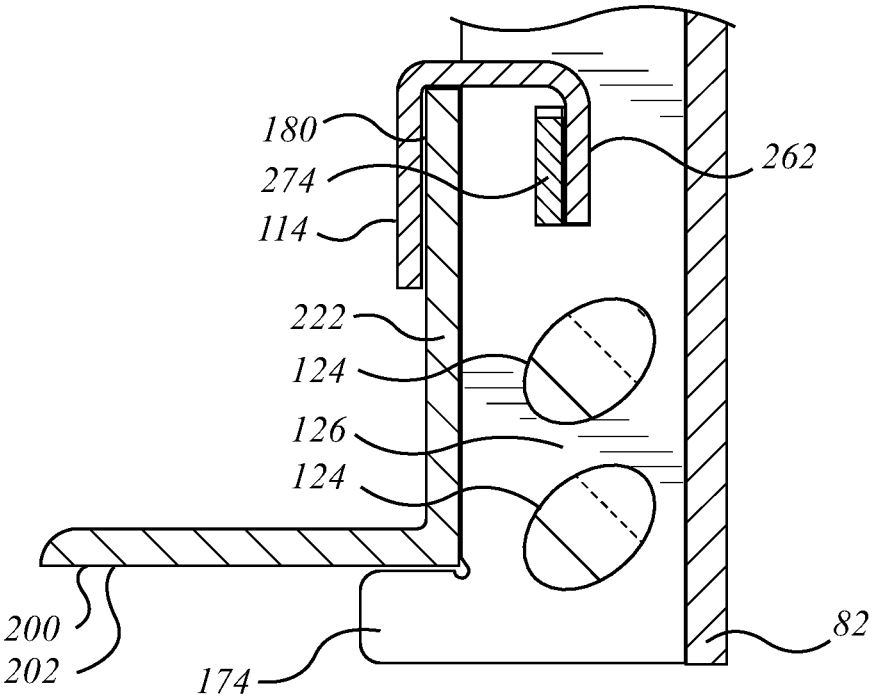
Figure 9B:
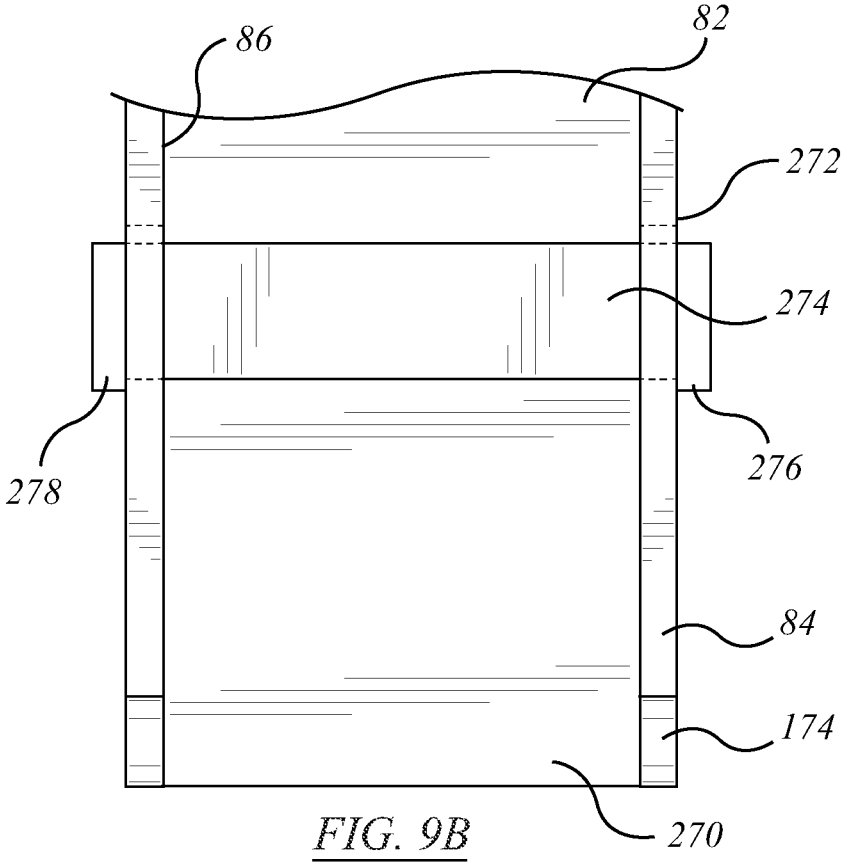
Figure 9C:
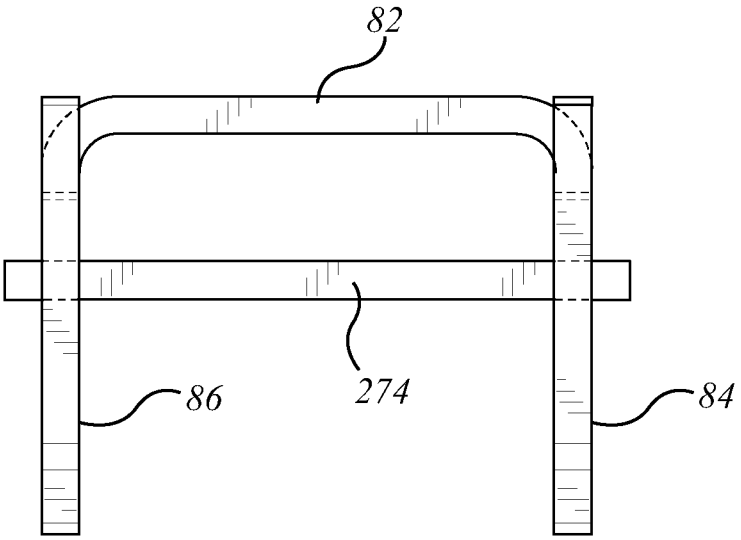
Figure 9D:
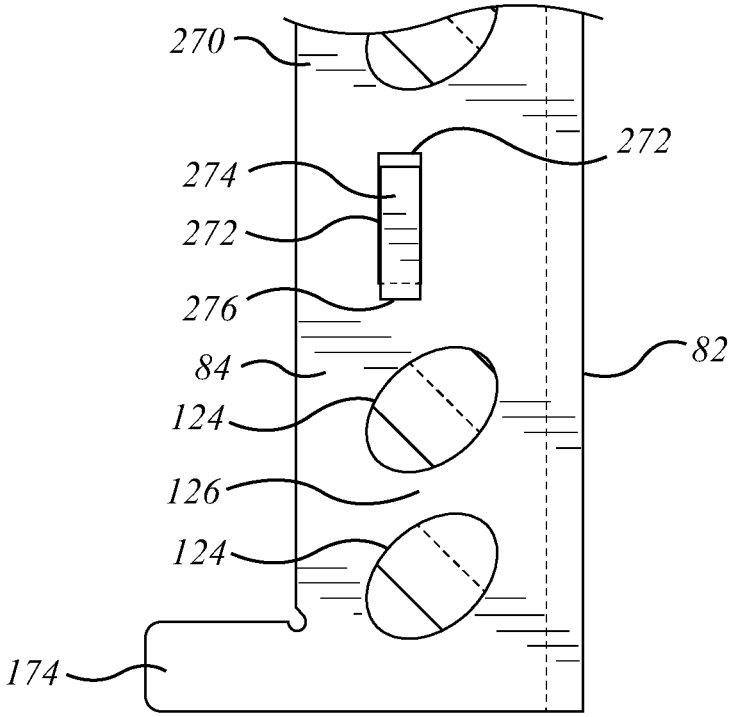

In the embodiment of FIG. 2*d* and of FIGS. 9*a* to 9*d*, one pitch of the lightening holes in legs 84 and 86 of long-legged bracket 270 is modified as an aperture 272 that admits a transom, or a cross-member, bolt, bar, shim, anchor, key, or stop, however it may be called, identified as 274. The cross-member, 274, however it may be called, may have ends that are enlarged. At least one of the ends must pass through aperture 272. The ends may have abutments, or hooks or catches, or dogs 276, 278, that, when installed, limit the range of lateral travel relative to webs or legs 84, 86. The intermediate portion of the beam is narrower, and the openings or apertures 272 have a greater vertical depth than the intermediate portion, such that when cross-member 274 is slid across, at least one end can pass through the apertures, but once through, the dogs can sit down as seen in FIG. 9*b*. Retainer 180 is as before.

Figure 10C:
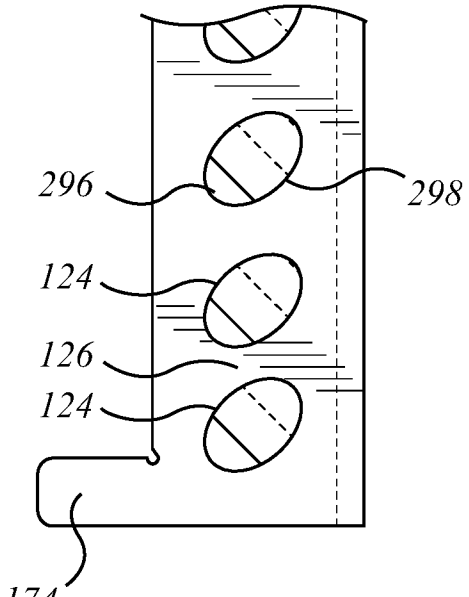
Figure 10B:
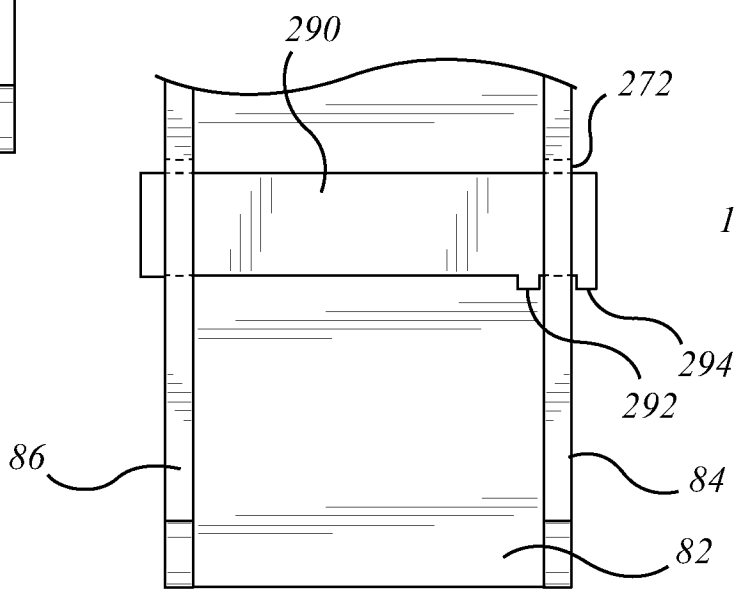
Figure 10A:
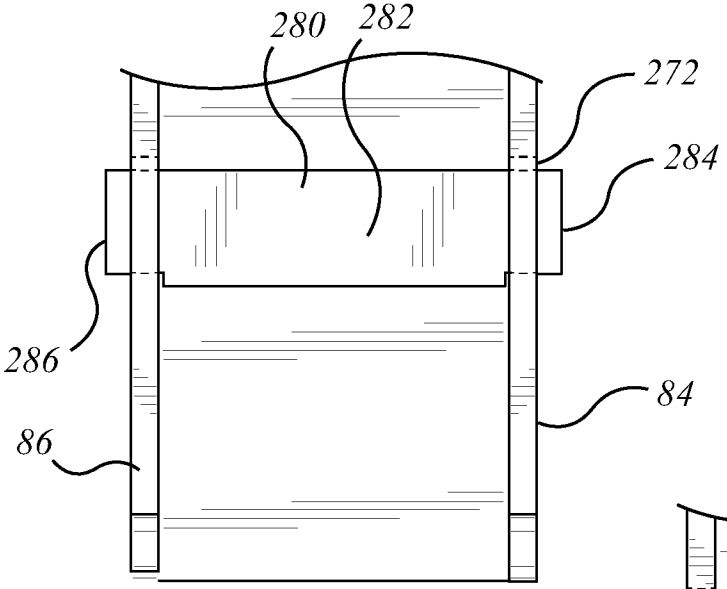

In the alternate embodiment of FIG. 10*a*, cross-member 280 is deep in the intermediate or central portion 282, and shallow at the ends. The lateral play between central portion 282 and side webs or legs 84, 86 is less than the length of end portions 284, 286, such that once in place, when central portion 282 sits down, cross-member 280 cannot escape laterally. Retainer 180 is as before.

In the alternate embodiment of FIG. 10*b*, cross-member 290 has two dogs 292, 294 formed at one end. They interact with web or leg 84 (or, equivalently, 86) to inhibit motion in the lateral direction once installed. It is not necessary for the outside dog 294 to be able to pass through aperture 272. Retainer 180 is as before.

In the alternate embodiment of FIG. 10*c*, the sidewall aperture 296 has been formed to extend or merge into, a lightening opening 298 more generally. The embodiment of FIG. 10*c* may be used with the cross-members of any of the embodiments of FIG. 9*a*, 10*a* or 10*b*. Retainer 180 is as before.

Figure 11C:
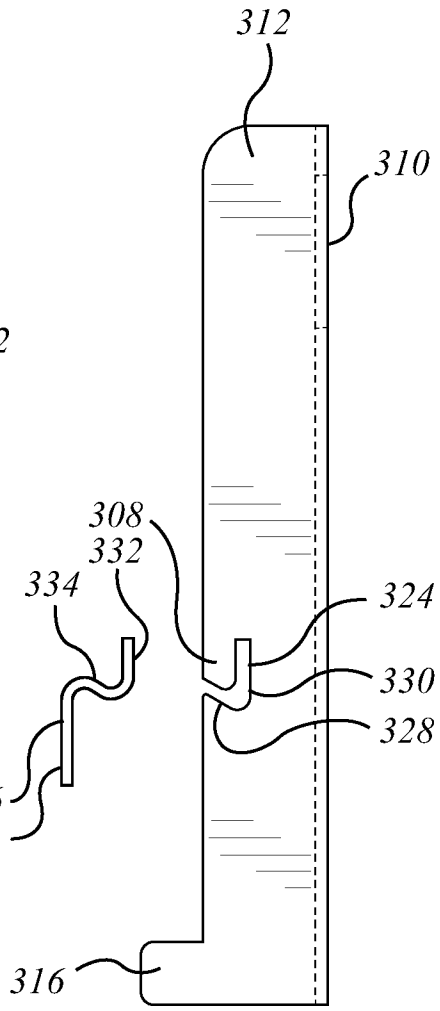
Figure 11B:
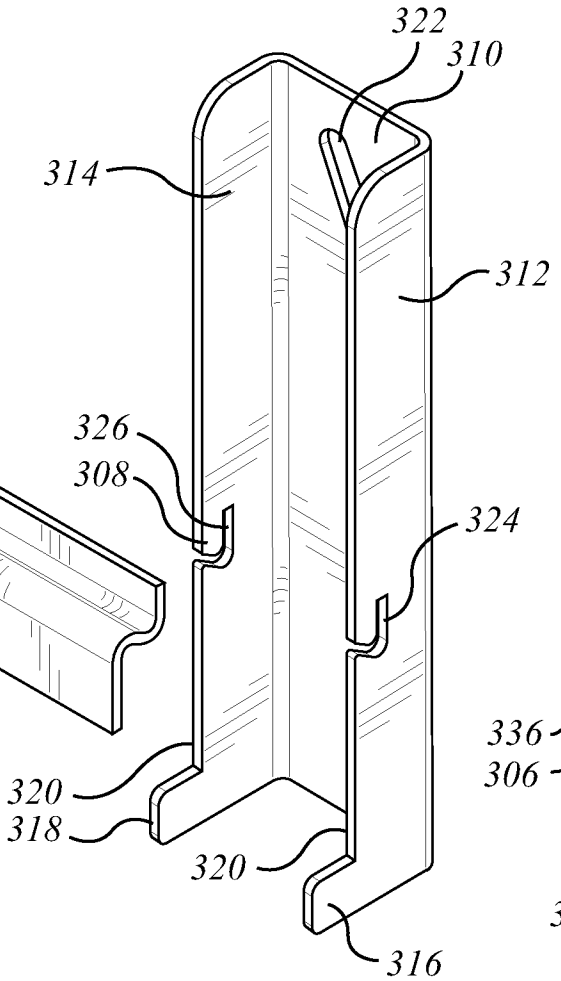
Figure 11A:
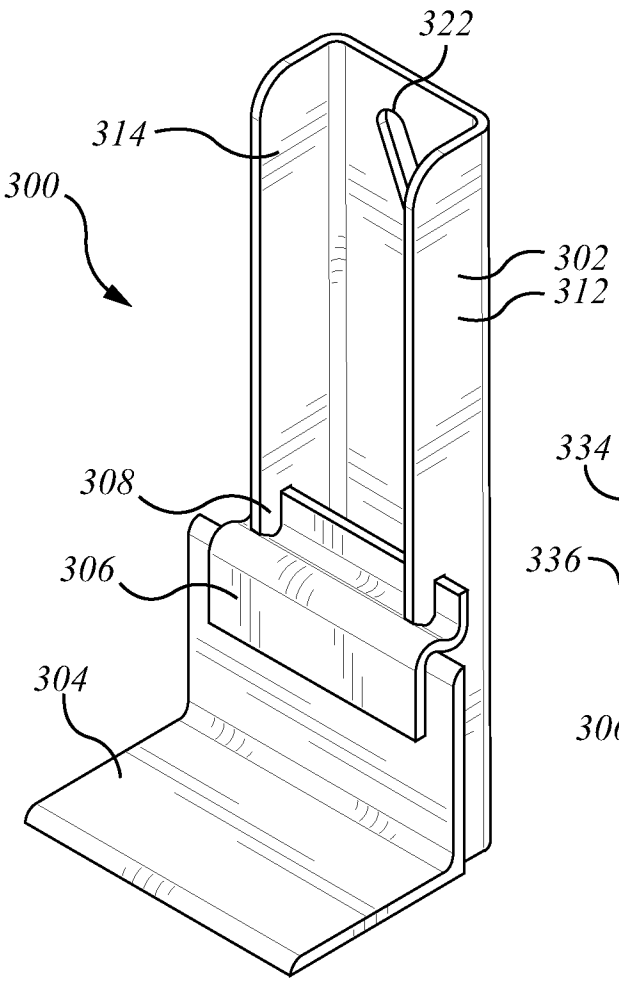
Figures 12A, 12B, 12C, 12D:
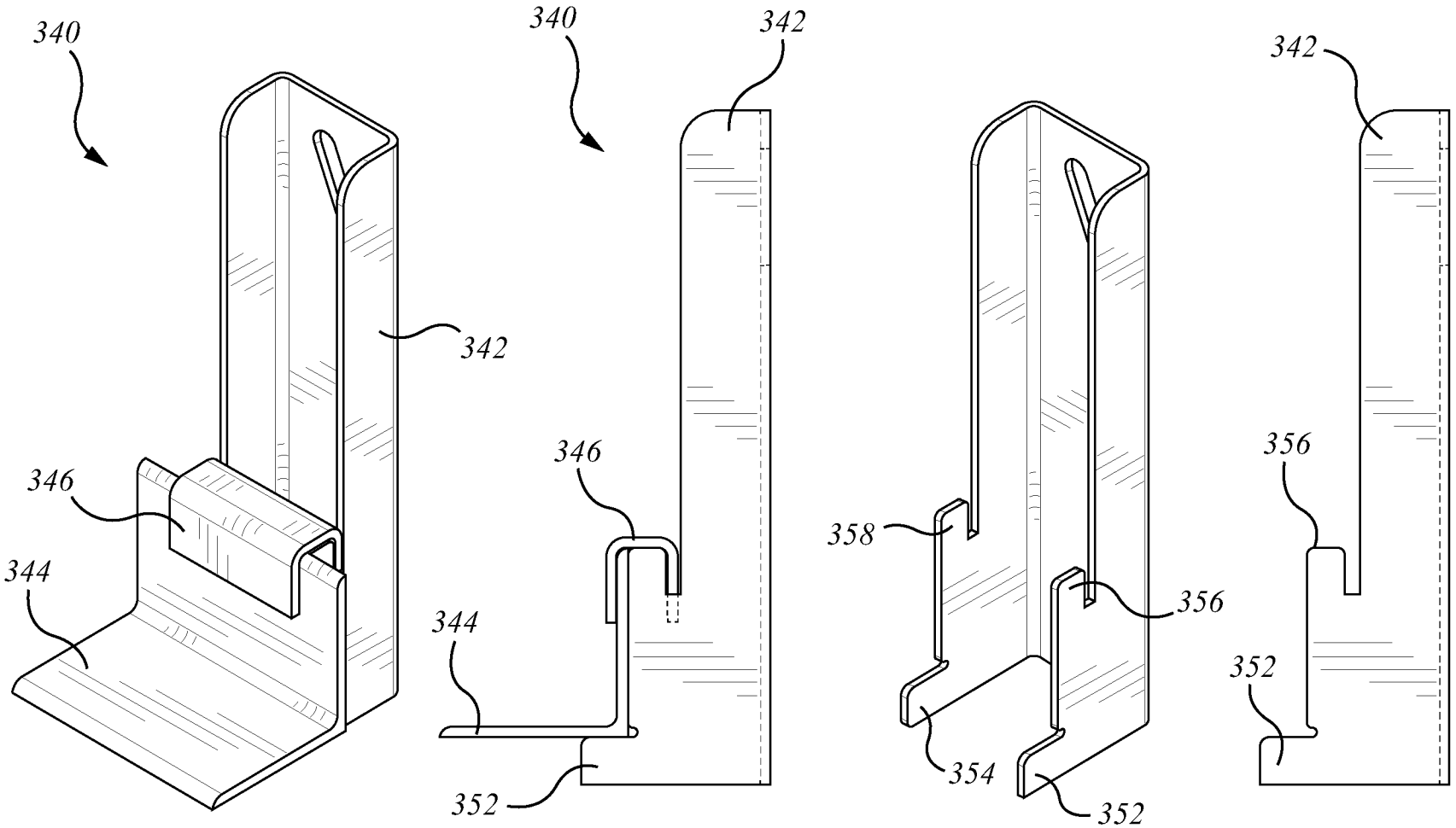
Figures 13A, 13B, 13C, 13D:
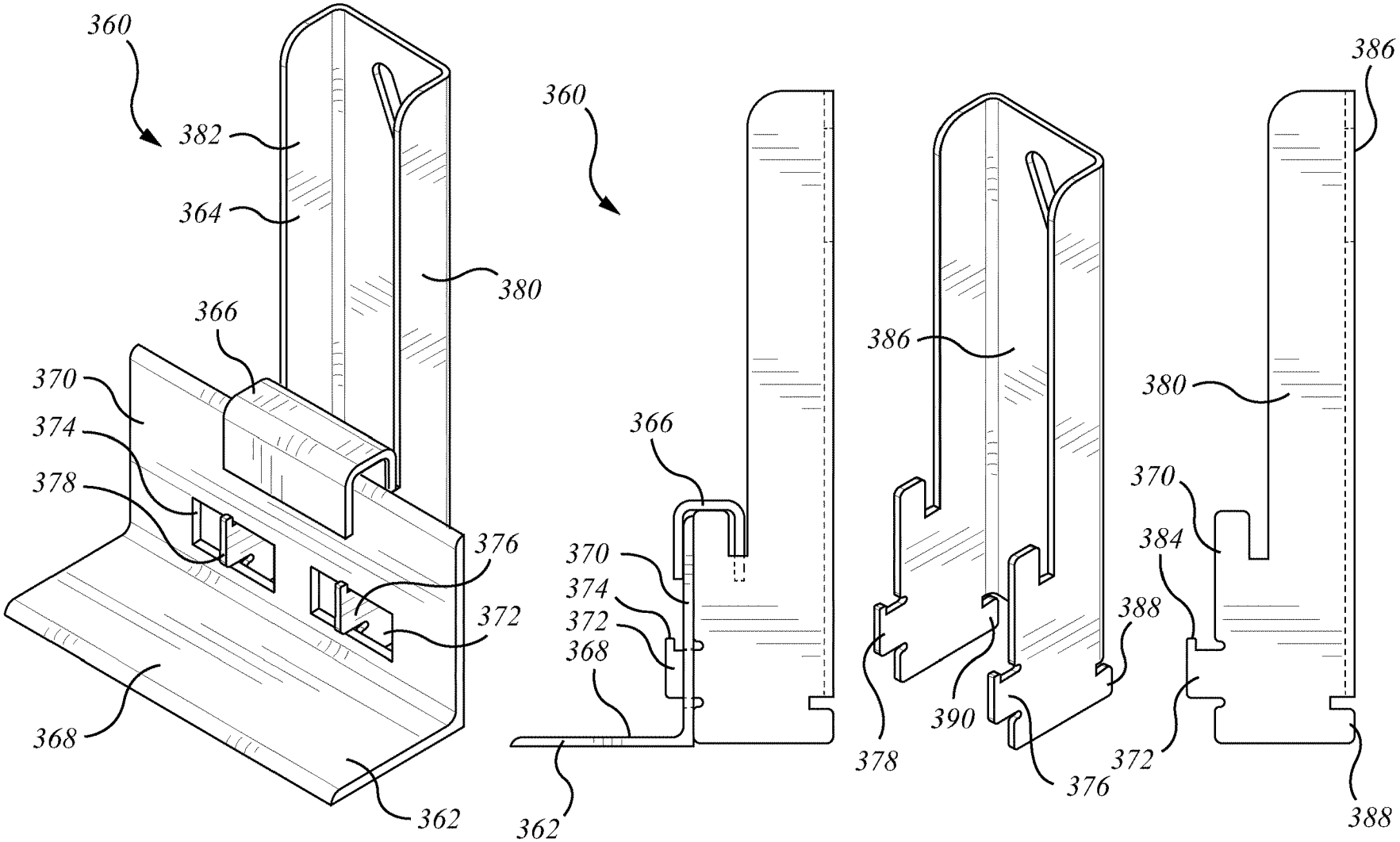

A further alternate embodiment is shown in FIGS. 11*a* to 11*e*. In this instance a masonry veneer support wall mounting assembly may be designated generally as 300. It may be used with the various alternative shelf angles described above, whether straight or flexed into a curve, whether continuous or segmented. Assembly 300 includes a first member, such as mounting bracket 302, which may be a long-legged wall mounting bracket such as used, for example, over a door or a window. There is a second member, such as a shelf angle 304, of which only a short section is shown in FIG. 11*a*. The second member mounts to the first member in the manner described above. There is a third member, namely a clip, or key, or retainer 306. As may be understood, the assembly may typically include more than one first member 302, i.e., each shelf angle may be supported by two or more wall mounting support brackets, as seen, for example, in FIGS. 1*a*-1*d*, 1*g* and 1*h*.

In this example, mounting bracket 302 may have the form of a long-legged channel having a back 310, a first web or leg 312 and a second web or leg 314, the two legs 312 and 314 being attached to and extending forwardly away from back 310. In the example, legs 312 and 314 are square to back 310, and are spaced apart and parallel. The vertical length may be taken as being the same as, or in the same ranges as, the long legs previously described. The lower region of the forward margins of the legs again define a seat 320 that engages the shelf angle, the seat including a horizontal portion, the top margin of the toe, and an upwardly extending portion which engages the back, or vertical flange of the shelf angle. To that end, the seat may include a forwardly protruding toe 316, 318 respectively, whose upper shoulder, or edge, defines a vertical shear load transfer interface. The upper region or portion of the back includes a second load transfer interface in the form of an attachment fitting, slot 322, as before.

The forward margin of legs 312, 314 extends upwardly from toes 316, 318. A retainer accommodation 324, 326 is formed inwardly of that margin at a height greater than the upwardmost extent of the back, or flange, of shelf angle 304 when installed. Each of accommodations 324, 326 may have the form of a forwardly open slot having a first portion 328 and a second portion 330. The first portion extends inwardly from the forward margin, and the second portion is kinked or dog-legged relative to the first portion. This leaves an overhanging finger 308. The first portion extends inwardly and downwardly, while the second portion extends upwardly, generally parallel to the forwardmost margin. Retainer 306 has a matching shape having corresponding first and second portions 332, 334, as well as a third portion 336 which defines a finger or catch that, when installed, locates in front of the vertical back or flange 310 of shelf angle 304. As located it provides a moment couple reaction interface to act against the rotational moment of the masonry veneer on the shelf. In the example, the first and third portions 332, 336 are substantially parallel, and middle portion 334 forms a web between them, the web being slanted such that the section has a Z shape. On installation, shelf angle 304 is placed on seat 320, and retainer 306 is then driven sideways (i.e., parallel to the running direction of the shelf angle) into the slots or accommodations 324, 326, thus locking the shelf angle in place. Retainer 306 could also be referred to as a key, or a locking member. When face brick or other masonry veneer is installed on the shelf angle, the forward finger of retainer 306 engages the forward face of the vertical flange of the shelf angle, and provides the reaction force acting in the rearward direction to prevent rotation of the shelf angle. The dog-legged geometry of the slot and Z shape prevents retainer 306 from disengaging from the mounting bracket.

In the embodiment of FIGS. 12*a*-12*d*, there is a mounting assembly 340, that is substantially the same as assembly 300, that includes a mounting bracket 342, a shelf angle 344 as before, and a retainer 346. Retainer 346 is the same as retainer 100. Mounting bracket 342 differs from bracket 304 insofar as the forwardmost margin of legs 348, 350 has been profiled to give a forward toe 352, 354 corresponding to toes 316, 318, forming the shelf angle seat; and upwardly extending knobs or anchors or fingers 356, 358 that conform to retainer 346, i.e., retainer 346 and fingers 356, 358 are mutually engaging.

In the embodiment of FIGS. 13*a*-13*d*, mounting assembly 360 includes a shelf angle 362, a mounting bracket 364, and a clip, or key, or retainer 366. Retainer 366 is the same as retainer 346 or 100. Shelf angle 362 has a horizontal shelf 368 and an upstanding back 370. Upstanding back 370 has accommodations in the form of mounting apertures 372, 374. The mating engagement members that provide the vertical shear force reaction, or shear load interface, or shear load input of mounting the brackets are mounting bracket toes 376, 378. On installation, toes 376, 378 seat in those accommodations, i.e., by extending through apertures 372, 374, on installation. Toes 376, 378 are located upwardly of the lowermost margin of legs 380, 382. As mounted, the horizontal shelf of shelf angle 362 is flush with or lower than that lowermost margin, such that mounting bracket 364 is concealed. Toes 376, 378 may have an upstanding end stop 384 such as may discourage shelf angle 362 from falling off toes 376, 378 when placed loosely, prior to insertion of retainer 366. The lower portion of back 386 is truncated upwardly of the lowermost margin of legs 380, 382, and the rearwardmost ends 388, 390 of the lower ends of legs 380, 382 form abutments, or reactions.

In the embodiment of FIGS. 14*a*-14*d* there is a shelf angle mounting assembly 400 where there is a shelf angle 402, a wall mounting bracket 404, and a retainer 406. Retainer 406 may be taken as being the same, or substantially the same, as retainer 100 or 364. Wall mounting bracket 404 is similar in nature and function to second member 50 of FIG. 2*a* or 2*b*, second member 170 of FIG. 2*c* or 2*d*, but is a short-legged version, rather than a long legged version. Wall mounting bracket 404 may be provided in either short-legged or long-legged versions. Shelf angle 402 may be taken as being any of the first members 44 of the various masonry veneer support assemblies described above, be it shelf angle 46.

As with channel 80 of support bracket 52, in this example the second member is wall mounting bracket 404, which has a channel shape having a back 410, a first leg 412, a second leg 414, a first protruding toe 416, a second protruding toe 418, a first rearward blade or abutment 420, a second rearward blade or abutment 422, and first and second upwardly protruding lugs, or fingers, or dogs, or stubs, or anchors 424, 426, however they may be called. In the embodiment shown, first leg 412 includes, or is formed integrally with toe 416, abutment 420 and retainer anchor 424. Likewise, second leg 414 includes, or is formed integrally with, toe 418, abutment 422, and anchor 426. In the example shown those respective elements are co-planar. Back 410 includes a mounting fitting 408, which, as before, has the form of a diagonal slot. On installation a mechanical fastener co-operates with mounting fitting 408 to secure mounting bracket 404 to supporting structure, be it steel beams or other framework, a poured concrete slab, or other framing structure. The mounting fitting is the vertical load output, or vertical load output interface, however it may be named.

Figure 18:
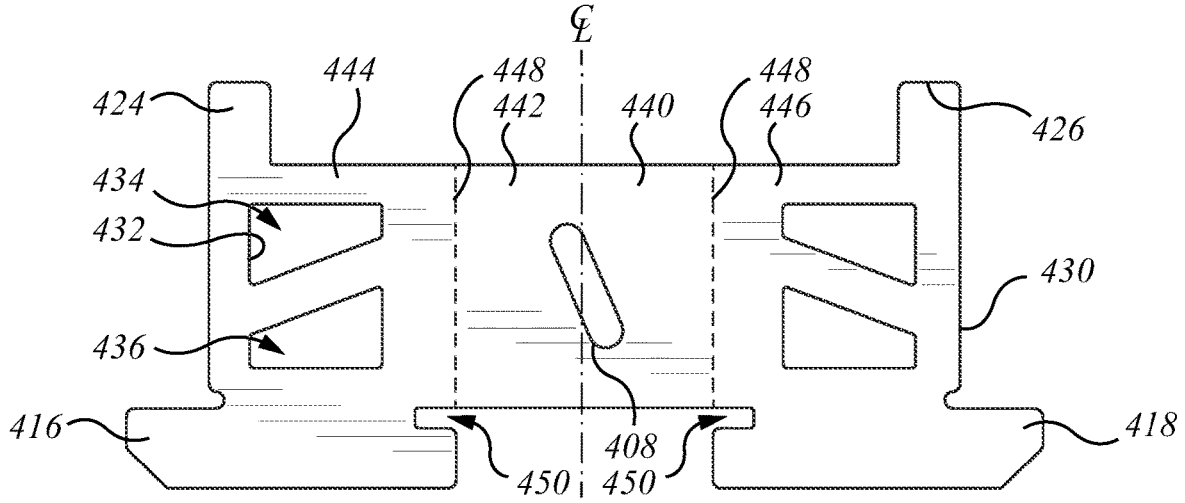
FIG. 18 is a developed view of a sheet metal blank prior to bending to make the mounting bracket of FIG. 16*a;*
Figure 19:
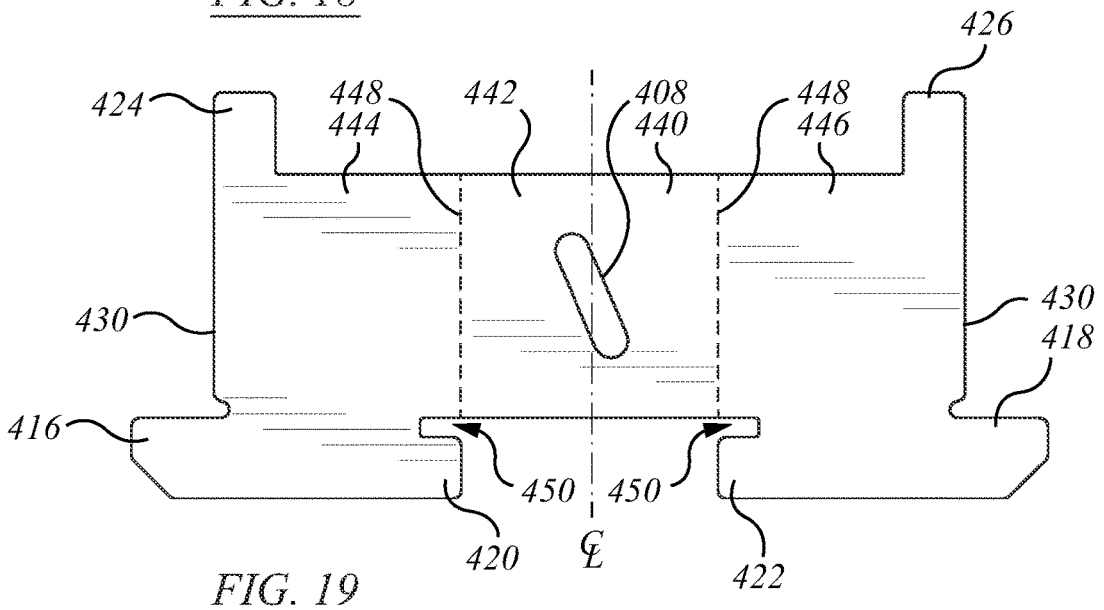
FIG. 19 is a developed view of an alternate sheet metal blank to that of FIG. 18.

Each of legs 412 and 414 is perforated by an array of openings 434, 436. Mounting bracket 404 may be made of plate or sheet steel. A blank 440 is cut from the steel sheet as in FIG. 18. Blank 440 has portion 442 corresponding to back 410, portion 444 corresponding to first leg 412, and portion 446 corresponding to second leg 414. Blank 440 is profile cut (or stamped) about its periphery to yield the profiles of toes 416, 418, and therefore of the shelf angle seat 430 in general. In the embodiment of FIGS. 15*a*-15*e* and FIG. 19, legs 412 and 414 are made as imperforate, i.e., continuous, solid plates or webs. In the embodiment of FIG. 18, an array or set of apertures or perforations 432 is formed in each of portions 444 and 446. In this example, the array of perforations includes a first aperture or first perforation 434 and a second aperture or second perforation 436. The material that remains between perforations 434 and 436 forms a strut 438. Strut 438 may be a diagonal strut. Other than the diagonal slot of fitting 408, blank 440 may be symmetrical about the vertical centerline. After stamping, blank 440 is bent on vertically running fold lines 448.

In the embodiment of FIG. 18, the array of apertures leaves a truss-like frame of reduced cross-sectional area for thermal conduction. The truss-like frame includes a first or proximal or rearward upright 452, and a second or distal or forward upright 454, either of which could also be termed a chord, or post, or pillar. Upright 452 and back portion 444 form an angle, resistant to out-of-plane deflection relative to the plane of the back and relative to the plane of the leg, 412 or 414 as may be. The truss-like frame also includes a first or upper lateral member, or strut, or chord 456 and a second, or lower, lateral member or strut or chord 458, such that a four-sided box or rectangle is formed, with diagonal strut 438 traversing the rectangle. Strut 438 then forms the hypotenuse of the two generally triangular (or trapezoidal) apertures. A taller bracket (such as those shown in FIGS. 16*a*-16*e* and 17*a*-17*e*, or as shown in FIGS. 2*a*-2*d*) may have more apertures, and more diagonal members or struts. Fingers or anchors 424, 426 are formed at the outer top corner of the box or frame, and protrude upward. Toes 416, 418 are formed generally at the bottom outer corner, and protrude forward. Abutments 420, 422 are formed at the rearward, lower corner. There is a relief 450 formed between the top of the blade or abutment, 420, 422 and the radiused bend of each leg into back 410.

Figure 20:
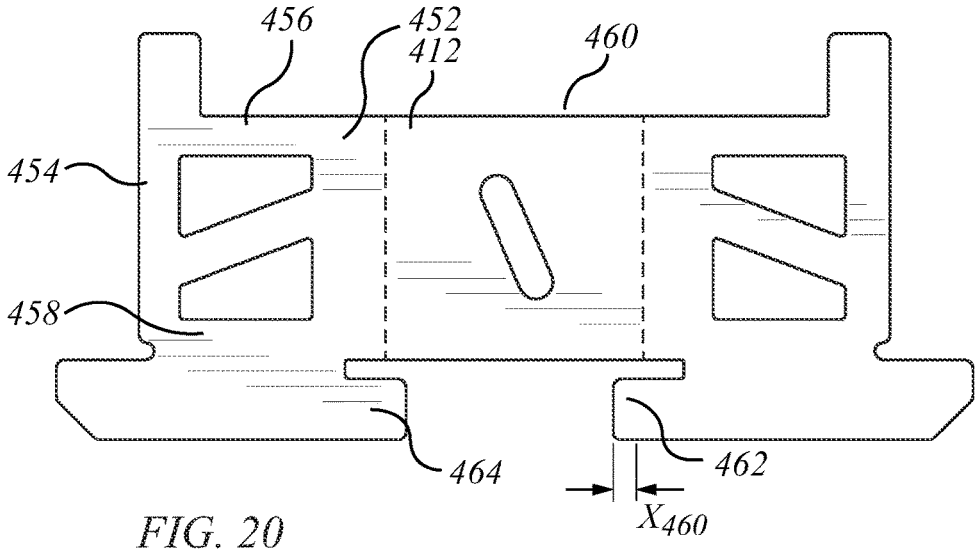
FIG. 20 is a developed view of a further alternate sheet metal blank to that of FIG. 18 having abutments extending rearwardly proud.

In the embodiment of FIG. 20, which is otherwise the same as the embodiment of FIG. 18, the rearward abutments 462, 464 are still formed out of the same blank 460 as back 412. However abutments 462, 464 have extended length, such that when blank 460 is bent, abutments 462, 464 extend rearwardly proud of (i.e., beyond) back 412 by a distance $x_{460}$. That distance may correspond to the thickness of a thermally insulative member as discussed below. The space above abutments 462, 464 and behind back 412 can be considered to be an accommodation for a spacer, such as a low thermal conductivity pad, such as spaced 490, below.

Figure 21:
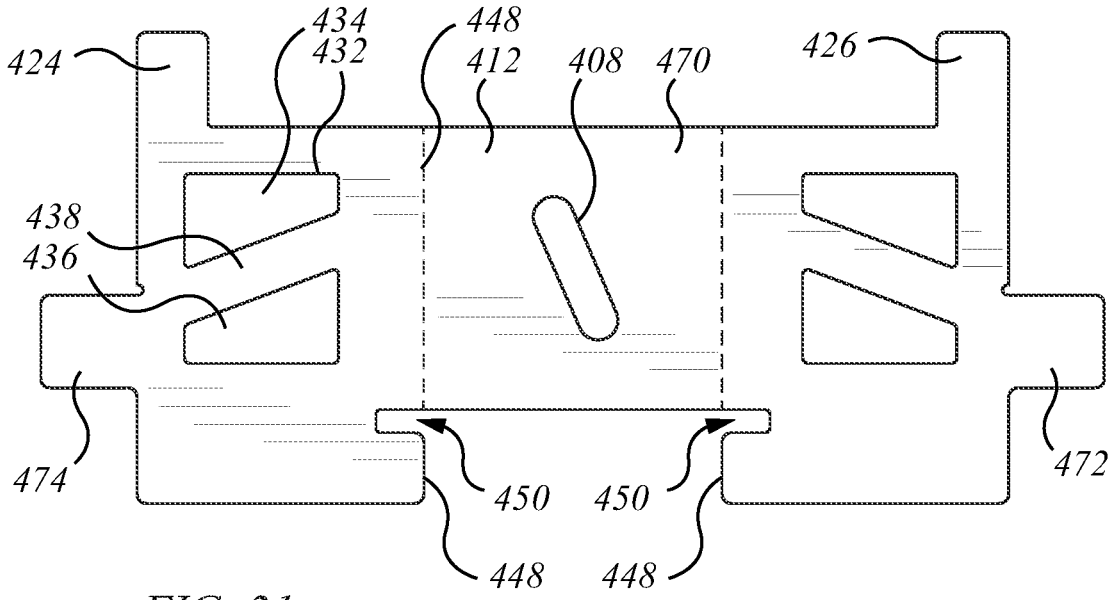
FIG. 21 is a developed view of an alternate sheet metal blank to that of FIG. 18.
Figure 22:
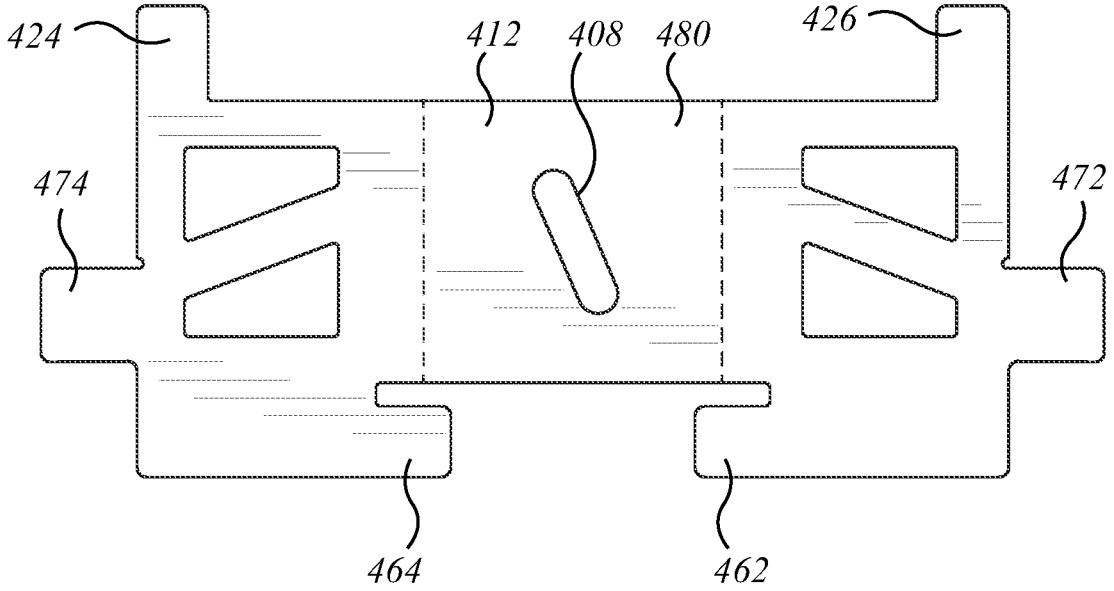
FIG. 22 is a developed view of a further alternate sheet metal blank to that of FIG. 18 having abutments extending rearwardly proud.

The embodiment of FIG. 21 is substantially the same as the embodiment of FIG. 18. However, in this instance, blank 470 has forward toes 472, 474 that are located upwardly relative to abutments 476, 478, such as to co-operate with a shelf angle having mating accommodations in the upright leg, as in FIGS. 13*a* and 13*b*. The embodiment of FIG. 22 is substantially the same as the embodiment of FIG. 21. However, in this case, blank 480 has extended abutments 462, 464.

In the embodiments of FIGS. 18, 20, 21 and 22 the apertures are bounded by the frame borders of the outside of the aperture arrays (or, conversely, the inside boundary of the external rectangular four-sided frame) defined by boundaries $x_{452}$ of upright 452, $x_{454}$ of upright 454, $y_{456}$ of top chord 456 and $y_{458}$ of bottom chord 458. As may be understood, the mounting brackets of FIGS. 14*a*, 15*a*, 18, 19, 20, 21 and 22 may also be made in long-legged versions such as may be used over a door or window.

Furthermore, mounting brackets similar to those described above having rearward abutments may also be made that do not employ a retainer clip, as in the embodiments of FIGS. 16*a*-16*e* and 17*a*-17*e*. In FIG. 16*a*, there is a masonry veneer support assembly 500 that includes a first member, 502; and a second member, mounting bracket 504. First member 502 has a first leg or flange defining a horizontally running shelf 506 and a second leg defining an upright flange 508. Mounting bracket 504 has the form of a channel section 510 having a back 512, a first leg 514 and a second leg 516. As in the channels described above, first and second legs 512, 514, extend forwardly way from back 512, to form angles relative thereto. The angles may be right angles. Legs 514, 516 may lie in parallel, spaced apart planes. The proximal margins of legs 514, 516 merge into back 512 at corners. Back 512 has a mounting fitting 518 corresponding to mounting fitting 148 or 408. The distal margins of legs 514, 516 are profiled by cutting or stamping to yield shelf angle seats 520, 522, there being a respective forwardly protruding toe 524, an upstanding back portion 526, an upper slot portion 528 and a retainer having the form of an overhanging finger 530. The lower rearward margins of legs 514, 516 include rearwardly extending abutments 532, 534. In this example, the rearward ends of abutments 532, 534 are flush with back 512. The main portion of legs 514, 516, toes, 526 and abutments 532, 534 are respectively co-planar. On assembly, the rearward facing, inside surface of overhanging finger 530 engages the forward facing surface of upstanding leg or flange 508 of shelf angle 502.

Legs 514, 516 are perforated to yield an open truss. That is, each of legs 514, 516 has a first member, being an upright 536, that may be termed the proximal upright, it being the margin that runs along and is joined to the respective left-hand or right-hand margin of back 512. Each of legs 514, 516 also has a second upright member 538, defined by the distal margin thereof, bounded by back portion 526 and slot portion 528, and from which toes 526 and overhanging fingers 530 extend forwardly. Each of legs 514, 516 also has a first strut or strut member, which may be identified as top chord 540, and a second strut, or strut member which may be identified as bottom chord 542. Within this four-sided box or frame, leg 514, 516 may include an array of bracing members, such as diagonal braces 544, 546 with may be termed upper and lower diagonal braces respectively. Braces 544, 546 may be convergent rearwardly. The array of perforations 550 may include first, second, and third perforations 552, 554, 556, that, when punched out or cut, leave the shape of struts or braces 542, 544. In the example, upper and lower perforations 552, 556 are trapezoidal, while perforation 544 may be an isosceles triangle located between them. Where a taller mounting bracket is used, there may be more perforations, or more sets of perforations. The perforations reduce the cross-sectional area of the leg for heat transfer.

The embodiment of FIGS. 17*a*-17*e* shows assembly 480, which is the same as assembly 500 of FIGS. 16*a*-16*e* except insofar as rearwardly extending abutments 482, 484 extend rearwardly proud of, i.e., beyond, the vertical plane of the rearward surface of back 486 of the channel section of the mounting bracket. There is an accommodation 488 defined upwardly of abutments 482, 484, and rearwardly of back 486. A spacer 490 seats in accommodation 488. That is, the distance $x_{490}$ by which abutments 482, 484 extend beyond back 486 corresponds to the thickness of spacer 490. The height is indicated as $y_{490}$. On installation, a mechanical fastener passes through the slot of mounting fitting 408 and of the corresponding slot in spacer 490 to secure assembly 480 to the supporting wall structure. Spacer 490 is made of a material having lower thermal conductivity than the steel of the mounting bracket and shelf structure. It may be made of an UHMW polymer.

Figure 23:
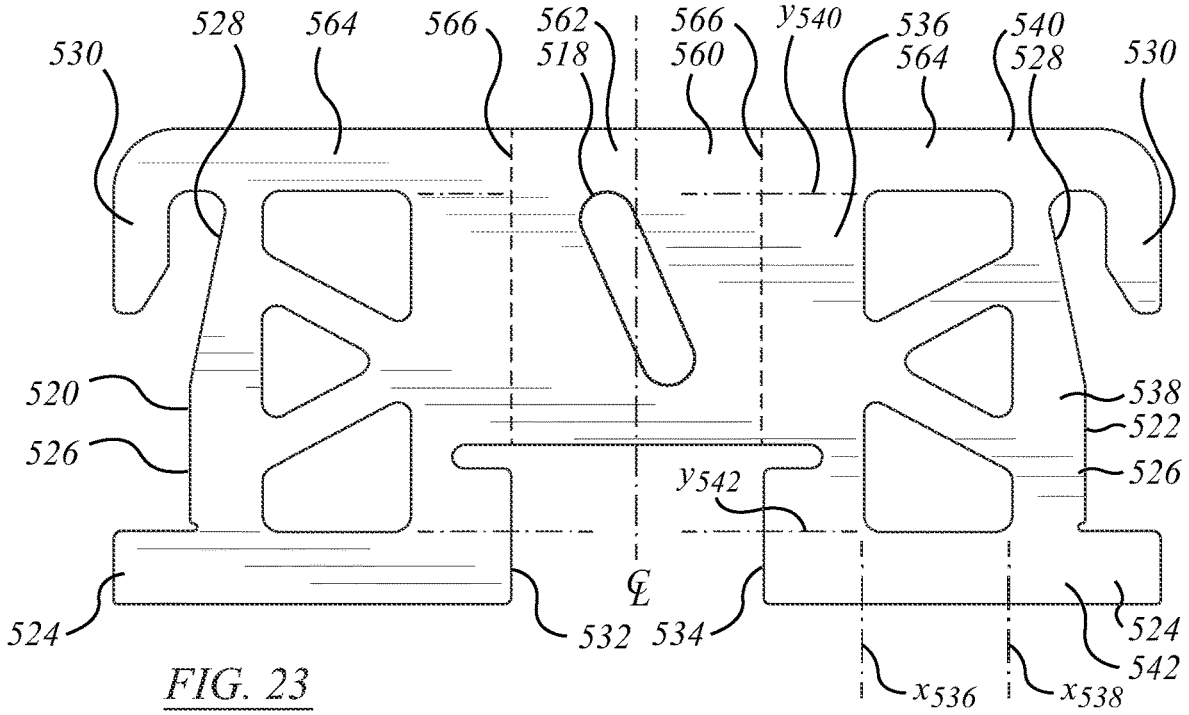
FIG. 23 is a developed view of a sheet metal blank prior to bending to make the mounting bracket of FIG. 17*a*.
Figure 24:
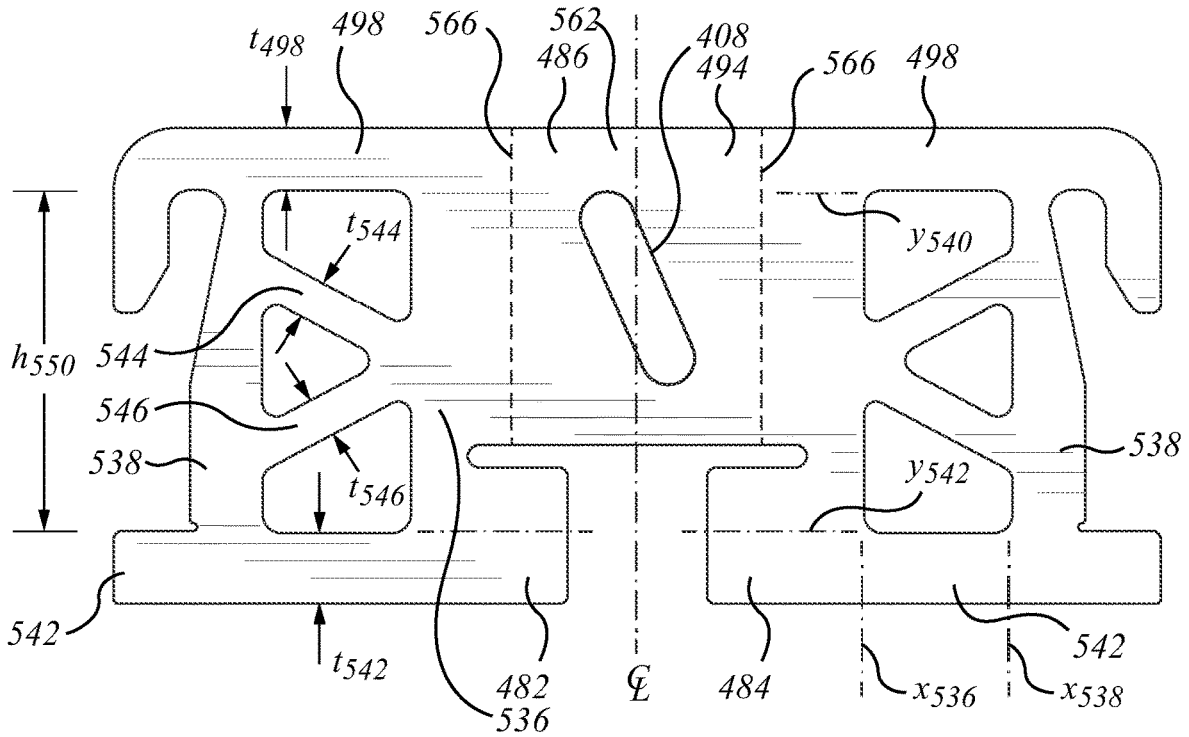
FIG. 24 is a developed view of a further alternate sheet metal blank to that of FIG. 18 having abutments extending rearwardly proud.

FIGS. 23 and 24 represent the sheet metal blanks 560 and 494 from which mounting bracket 504 (of FIG. 16*a*) and mounting bracket 496 (of FIG. 17*a*) are formed. As the mounting brackets are symmetrical about the vertical center line, other than the diagonally extending slot of the mounting fitting a description of one half is also a description of the other—particularly since the blank is then reversible back-to-front prior to bending. If the blank is folded in one direction, it makes a left-handed bracket (i.e., with mounting fitting extending upwardly to the right; and if folded in the opposite direction if makes a right-handed bracket (i.e., with the mounting fitting slot extending upwardly to the right). The back portion 562 may be the same. The leg portions 564 and 498 differ to the extent that leg portions 498 have a larger tab profile corresponding to abutment 482, or 484, than does leg portion 564. The bend lines between the respective backs and legs are indicated as 566.

In the embodiments of FIGS. 16*a*-16*e* and FIGS. 17*a*-17*e* the apertures are bounded by the frame borders of the outside of the aperture arrays (or, conversely, the inside boundary of the external rectangular four-sided frame) defined by boundaries $x_{536}$ of upright 536, $x_{538}$ of upright 538, $y_{540}$ of top chord 540 and $y_{542}$ of bottom chord 542. As may be understood, the mounting brackets of FIGS. 16*a*-16*e* and FIGS. 17*a*-17*e* may also be made in long-legged versions such as may be used over a door or window.

In masonry veneer systems, the object is to space the veneer outwardly by an offset from the support structure, such as may permit a layer of insulation to be installed, and an air gap to be provided. When the various embodiments of masonry veneer mounting support structure assembly are installed, the respective shelf angle carries an eccentric load relative to the supporting wall structure to which it is mounted proportional to that offset distance. The load is offset from the wall structure by the depth of the mounting bracket in the x-direction, namely the direction perpendicular to the wall. The moment couple in the clockwise direction (relative to FIG. 17*c* or FIGS. 2*a*-2*d*) is counteracted by the moment couple reaction of the mounting bracket against the wall structure. In that reaction, the fastener that engages the mounting fitting in the back of the mounting bracket (e.g., mounting fitting 408 or 518, as may be), is in tension, and the lower portion of the bracket is in compression, such that a counter-clockwise reaction moment is provided.

The metal of the support bracket and shelf angle may themselves act as thermal bridges by which there may be heat transfer from the building to the outside, or the reverse. To reduce thermal loss through the mounting bracket and shelf angle of the mounting support assembly, a less thermally conductive shim may be placed behind the back of the mounting bracket and the supporting wall structure. However, where a polymeric spacer is used, those portions of the polymer under compressive load may tend to wish to deform, or creep, over an extended period of time. This would tend to allow the shelf angle to rotate over time, which may result in the cracking of the veneer. Further, in a fire a polymeric spacer may tend to soften or melt, such as may relieve the clamping force of the fastener.

In respect of the embodiments of FIGS. 17*a*-17*e*, 20, 22 and 24, the upper portion of the assembly is held in place by the mechanical fastener in tension. The lower part of the bracket has extending horns, or ears, or abutments, such as 482, 484 that contact the supporting wall structure in compression. That is, the compressive load of the moment couple is reacted by and through the rearwardly extending abutments that stand rearwardly proud of the back of the channel, thus carrying the compressive load that would otherwise be squeezing the thermally insulating spacer pad or shim. By reducing the steel contact area, and by interposing the non-thermally conductive shim, the cross-sectional area of abutments 482, 484 that bear against the structure is small, giving a relatively small thermal conduction load path compared to the area of back 512, 82, 236, 286, 310, 386, 410, or 486, as may be. Further, by truncating the lower margin of the back upwardly of the upper edge of the abutment, those abutments can be manufactured by being stamped from the area of the metal blank that would otherwise have been stamped out and discarded. The length of the blade, or abutment, can be formed to correspond to the thickness of the pad, such that the abutment size and thermal shim size go together as a set or kit.

The example of FIGS. 25*a* and 25*b* is intended to illustrate the embodiment of FIGS. 14*a*-14*e* in an extended, or long-legged alternative. In this instance, the first member, mounting bracket 404, is provided in a longer version, similar to the alternative of FIGS. 8*a*-8*d*. Mounting bracket 600 has the form of a channel having a back 602, a first leg 604 and a second leg 606. Each of legs 604, 606 has a protruding toe 608 which may have the same geometry as any of the protruding toes shown or described in any of the other embodiments herein, be it 416, 418, 524, 472, 474, and so on. Similarly, it may have rearwardly extending blades or abutments 610 that correspond to abutments 462, 464, 482, 484; 420, 422; or 532, 534 as may be. As before, the downward margin of back 602 terminates, or is truncated, at a height greater than the uppermost margin of the rearwardly extending blades or abutments, such that they can be made from a single metal blank punched, stamped, or cut from a sheet of steel. Mounting bracket 600 differs from mounting bracket 404 in being taller. Mounting bracket 600 has a pair of back and front frame members, first and second post or uprights 612 (rearward) and 614 (forward), with upper and lower struts or frame members 456 and 454 as before. It has a full series of repeating lightening apertures identified as array 620 having first and second alternating apertures 434, (arbitrarily designated as left-hand) and 436 (arbitrarily designated as right-hand), separated by diagonals 438, again as before. The total height of one aperture 436, one diagonal 438, a second aperture 434 and one lateral strut 456 defines a pitch height $h_{436}$. This is the height of a repeating set of apertures and frame members measured from one successive lateral to another. As can be understood, legs 604, 606 may have one, two, three, or more such pitches. Apertures 436, 434 need not alternate L-R-L-R-L-R the entire way, but could alternate L-R-R-L-L-R-R-L, as may be in pairs of openings. As a measure of reduction of heat transfer path width, over any one pitch the ratio of metal section to total pitch height may be less than 1:2, and in one embodiment may be in the range of 3/10 to 1/2; and in one embodiment may be 3/8 to 7/16. That is, in each pitch, more than half of the material has been removed, and in one embodiment that removal may be in the range of 1/2 to 7/10. In another embodiment it is in the range of 9/16 to 5/8. Legs 604, 606 also have bent tabs, or dogs, or stops, anchors, or abutments 616, 618 that have been folded inward from the metal punched to form one of apertures 434 on either leg, at a height corresponding to the engagement height of clip or retainer 280 when installed to capture the upper margin 222 of a shelf angle 200. In the example, the abutments are formed out of the fourth aperture upward from the base. As before, the upper region of back 602 has a mounting fitting 408.

FIGS. 26*a* and 26*b* show that the embodiments of FIGS. 16*a*-16*e* and 17*a*-17*e* can be extended as in FIGS. 2*c*, 2*d*. Here, the diagonal strut pattern is different. That is, mounting bracket 630 has a back 632 and first and second legs 634, 636. The forwardly protruding toes 524, rearwardly protruding abutments, and overhanging finger 530 are as before. An array of apertures 640 is formed in each of legs 630, 632. The array is bounded by rear and front uprights 642, 644, a bottom member 542, and a top member 540, forming the four-sided or box-shaped, rectangular frame.

Array 640 could include apertures such as 436, 434, separated by a diagonal 438; or it could include repeating sets of three apertures 552, 554, 556 separated by diagonals 544, 546, and a top strut 540. Alternatively, as shown in FIGS. 26*a* and 26*b*, array 640 may have alternating triangular apertures 652, 654, separated by alternating left and right hand diagonals 544, 546. The end apertures at bottom and top may be apertures 552 and 556 as before. For one pitch from centerline to centerline of successive left hand diagonals, in one embodiment the proportion of area removal of the web between the uprights may be in the range of more than one half. In another, it may be in the range of 11/20 to 13/20 of the material. The embodiment of FIGS. 26*a* and 26*b* is also intended to show that the back of the channel section can also be provided with lightening holes. In this example, back 632 includes an array of aperture 650 that can be either as seen in FIGS. 25*a* and 25*b*, or as in legs 634, 636, with a pattern of alternating apertures, 622, 624, and may include a bottom end aperture 626 similar to aperture 542, with a bottom cross-member 628. There is a top end aperture 638, which may be the mirror image of bottom end aperture 628. The upper end of back 632 is effectively a rectangular plate that has a mounting fitting 92, as above. The apertures are bounded on left and right by respective uprights 646, 648 that co-operate with the top plate and bottom cross-member 628 to form a rectangular frame. Uprights 646, 648 also co-operate with the corresponding uprights of the side legs to form angles, thereby providing structurally stiff members. Mounting bracket 600 could be provided with an array of apertures in the same or similar manner. As with mounting bracket 600, mounting bracket 630 could have more or fewer pitches of apertures, struts and diagonal braces, according to the height of the installation. As before, the reduction in material between the inward margins of the rectangular-frame uprights may be greater than 30%, or one third; and in the embodiment shown may be greater than 50%, or one half. In the view of the inventors, the use of the rectangular framing format (i.e., with upright posts, top and bottom chord members, and diagonal struts, with the polygonal apertures that are, e.g., generally triangular or trapezoidal), as in the embodiments having alternating diagonal struts as seen in FIGS. 25*a*, 25*b*, 26*a* and 26*b*, as opposed to the punched round, oval, or elliptical apertures of FIGS. 2*c*, 2*d*, 8*d* and 10*c*, for example, may tend to permit a greater removal of material, and therefore a greater constriction, or reduction in effective cross-sectional area of the paths for heat transfer across the mounting bracket between the supporting wall structure and the shelf angle supported by the mounting bracket.

FIGS. 27*a*, 27*b* and 27*c* are intended to correspond to FIGS. 2*c*, 25*a* and 26*a*. The item annotation numbers of FIGS. 27*a*, 27*b* and 27*c* corresponds to the features of those earlier described embodiments. They differ in showing, respectively, mounting brackets 660, 670 and 680 in which the respective arrays of lightening apertures 662, 672 and 682 are not formed in the entire height of the side webs, or in the back wall, as may be, but rather only in a portion thereof. That is the die webs, or the back, as may be, are perforated in part. The other region remains unperforated, or solid. That imperforate region, the region without the arrays of openings, is the upper region. In some embodiments, and in the embodiments illustrated in FIGS. 27*a*, 27*b* and 27*c*, those apertures are found only in the lower region of the mounting bracket, extending to a height corresponding to the height of the shelf angle seat, or, correspondingly, the height of the back of the shelf angle when accommodated in the seat, or within one pitch of apertures beyond that height. The inventors have observed that the thermal conductivity of the mounting bracket tend to be more sensitive, overall, to the presence of apertures in the region most closely adjacent to the shelf angle seat than to apertures formed in the side webs, or legs, more distantly therefrom.

As shown, the mounting bracket may have an external coating. It may be a low thermal conductivity coating. It may be called a thermal insulation coating, or a thermal resistance coating, or a thermal barrier, or thermal barrier coating, or thermal insulation layer. For the purposes of this discussion, "low" thermal conductivity can be arbitrarily assessed as the thermal conductivity of the coating being less than 1 W/m-K. In general, thermal conductors such as metals and metal alloys have a thermal conductivity greater than 1 W/m-K. by contrast, materials that are commonly understood to be thermal insulators, such as wood materials, plastic resins, insulating ceramics, and so on tend typically to have a thermal conductivity less than 1 W/m-K In some embodiments, the coating may have a thermal conductivity that is less than 1/50 of the thermal conductivity of the material from which the body of the mounting bracket is made, e.g., mild steel. In some instances the thermal conductivity of the coating may be less than 0.1 W/m-K. The coating may be a polymeric coating. In particular embodiments, the polymeric coating may be an acrylic coating. The coating may have, and in the embodiment illustrated does have, an aerogel filler mixed in the resin of the coating. One such product is supplied by Tnemec Inc., 6800 Corporate Drive, Kansas City, MO 64120 USA under the identification "Series 971 Aerolon Acrylic", or simply "Aerolon". The manufacturer suggests that the thermal conductivity of the coating may be in the range of 12 mW/m-K. The application of the coating includes a primer and a top coat. The Application of such a coating to mounting bracket 52. In one embodiment, the thermally resistive coating, or low thermal conductivity coating, however it may be called, is applied to the surface of the shelf angle seat of the mounting bracket, thereby defining a thermal resistance between the mounting bracket and the shelf angle when installed. It can be conceptually thought of as a contact resistance. The resistance is then located at the mounting interface between one member, the shelf angle, and another member, the mounting bracket. It can also be termed a thermal conductivity barrier or break. In another embodiment a thermal resistance coating, or a low thermal conductivity coating is applied to the interface between the first member, i.e., the mounting bracket, and the supporting structure to which it is mounted or secured. That is, the thermal barrier coating, or low thermal conductivity coating is applied to the back or to the abutments of the mounting bracket. This yield a thermal break or thermal resistance or thermal barrier at the interface between the first member and the supporting structure. This may be done whether the mounting bracket has lightening holes as shown in FIGS. 2*c*, 25*a*, 26*a*, 27*a*, 27*b*, 27*c*, or any of the other embodiments shown or described herein, or not. It may also be done whether or not an additional shim is placed between the back and the supporting structure, as in FIG. 17*b* or 17*c*, or other embodiments described herein. Additionally, such a coating may be applied at both the input interface, i.e, the shelf angle seat, and at the output interface, i.e., at the supporting structure. Insulation, e.g., thermal insulation panel 56, may be cut to size and placed within any of mounting brackets herein, see, e.g., FIG. 17*b*. It may create a radiation barrier between the back of the bracket and the upstanding leg of the shelf angle, and may obstruct the vertical space within the bracket, such as may reduce the tendency of such an empty space to act as a chimney, or passage, for convective heat transfer.

Furthermore, coating the surface of the mounting bracket, generally, may tend to encourage the coating surface to approximate more closely the temperature of the air space in which the mounting bracket is located. The tendency for moisture from the air to condense on the surface of the mounting bracket is a function of the temperature of the mounting bracket. As such, a thermal coating on the mounting bracket surface constitutes a thermal resistance between the temperature of the member, namely the mild steel of the body of the mounting bracket, and the air temperature in the space. This resistance is in addition to such resistance as may be due to the convection heat transfer co-efficient of the surface. Furthermore, the thermal insulation coating may alter the radiation heat transfer surface properties of the mounting bracket such as to alter, or to diminish, their emissivity at moderate temperatures likely to be experience in building structures, or to enhance their reflectivity. In either case, the overall effect may be equivalent to a reduction in the apparent convention heat transfer co-efficient. Similarly, the shelf angle, such as shelf angle 46 or 162, 304, 344, 362, 402, 430, or 502, or such as may be, may also have a coating, or strip of coating of a thermally insulative coating applied in the region at which it mates with the seat or accommodation of the mounting bracket. Alternatively, the entire shelf angle may be coated. In some embodiments both the mounting bracket and the shelf angle may be coated.

The embodiments of FIGS. 8*a*-27*c* may be used in straight walls. That is, the mounting support brackets may be used with ordinary, non-segmented angle irons. Installation may be facilitated by not having to rotate the shelf angle during positioning, and the retainers or clips, can be installed one-at-a-time as the shelf angle is positioned. Additionally, however, the retainer clip style installation also permits installation on a curved or arcuate support structure or wall. It may also be noted that the embodiments of FIGS. 8*a*-10*c* can also be used in ordinary installations, such as that of FIG. 2*b* or 2*a*, that do not involved long-legged support mounting brackets. In each case, the assembly includes a veneer support member; a wall mounting member having a seat to receive the veneer support member; and a retainer or key, or lock, or anchor, that provides the moment couple reaction interface that prevents the shelf angle (i.e., the veneer support member) from rolling forward out of the seat under the load of the masonry veneer.

FIGS. 28*a* to 28*c* and 29*a* to 29*c* pertain to embodiments of shelf angle in which the masonry veneer is installed to extend behind the surface or arc of the wall mountings. That is, in the embodiments described above it is assumed that the masonry veneer follows the plane or arc of the vertical flange of the shelf angle, being offset outwardly or forwardly thereof by the reach of the mounting brackets, which may correspond to the thickness of insulation 56. There are circumstances, in which the masonry veneer extends beyond the lateral end of the shelf angle, e.g., to come to an end or corner. At that location, the masonry may be extending around a corner, or may include veneer that is oriented at a sharp corner, such as a square corner, as at a door or window opening, or corridor, or archway. The masonry then extends behind the plane of the vertical leg of the shelf angle.

In that context, In FIG. 28*a* there is a shelf angle assembly 700 that is mounted to supporting structure 690. Supporting structure 690 is shown as being a poured concrete wall or column, but it could be a steel framed structure, or other form of primary structure. There are at least first and second mounting brackets 702 and 704 mounted to supporting structure 690. Mounting bracket 702 and 704 may be taken as being the same as, mounting bracket 404 as in FIGS. 14*a*-14*d*, or as a single segment of support bracket 52 as in FIGS. 4*a* and 4*b*, or similar, using a retainer 706 such as retainer 106 or 406. In general, mounting brackets 702, 704 may be any of the clipped retainer types of mounting brackets shown and described above, whether sort legged or long legged, whether with back-blade abutments, whether with an insulative thermal resistance coating, whether perforated, and so on as suitable in the circumstances. However, they are shown as mounting brackets 404 as being generically representative to avoid redundant or repetitious description.

Mounting brackets 702 and 704 (and others as may be) are spaced apart as before. Assembly 700 has a shelf angle, or masonry support member 710 that spans the space between support brackets 702, 704. It has a flange, shelf 712, having a horizontal surface upon which to mount masonry veneer. It also has a web in the form of back 714 that stands as the vertical upright leg. As before, back 714 has an array of pairs of apertures 716, 718 that receive the toes of mounting brackets 702, 704, also as described above. They could be toes that mount under the shelf. However in irregular or interruption installations such as corners, windows and doors, it may be probable that it may be desirable to conceal the mounting brackets from view, and so apertures 716, 718 may be used. The shelf angle, or masonry support member 710 differs from the shelf angles described above in that shelf 712 has lateral wings 722, 724 that extend laterally beyond, i.e., sideways of, the lateral ends of back 714. Wings 722, 724 also have portions 726, 728 that extend rearwardly of the vertical plane of back 714. In this embodiment, shelf 712 also differs from the masonry support shelves of the shelf angles described above in that the length of the leg of shelf 712 is not constant. There is a first portion, or first leg, 730, and second and third portions, or second and third legs, 732 and 734, to either side of first portion or first leg 730 and in front of back 714. The length of leg 730 is different from the lengths of second and third portions 732, 734. As shown it is shorter, yielding a notch 720. When, e.g., face bricks are placed on the three portions, the central brick is inset rearward on leg 730 relative to the adjacent bricks on legs or portions 732, 734, such that a vertical channel or flute is formed therebetween. The vertical channel may be a decorative architectural feature, or it may have a functional role, such as to accommodate a down-spout. The lengths of portions 732, 734 need not be the same. Alternatively, the first leg could be longer than the second and third legs. As can be understood, support member 710 is made from a single sheet or plate of steel, punched to the desired profile, and then bent along the fold line between shelf 712 and back 714.

It may also be that whereas back 714 is straight and planar, the final desired form of the masonry is not straight and planar, but rather is curved, or is formed as segments on a curve. To that end, the length of legs 732 and 734 is not constant, but rather is formed on a taper or curve. As shown, the leg length decreases from the corner adjacent notch 720 to the merger with wings 722, 724 respectively. In this example, legs 732, 734 are on a straight taper, and the forward edge of wings 722, 724 is formed on a smooth curve, and ends at a rearward corner and a squared edge, or rectangular edged end. The squared or cornered end allows bricks or other masonry veneer to extend rearwardly of the plane of back 714, or, more generally, rearwardly of the tangent plane of the respective lateral edge 736 of back 714 in the case where back 714 is formed on a curve rather than in a plane.

FIGS. 29*a*, 29*b*, and 29*c* show a further development. A masonry support assembly 750 is mounted to a primary structure, shown as a concrete pillar or column 740. The primary structure may alternatively correspond to the corner of a building. Support assembly 750 has first and second mounting brackets 752, 754 on one face of column 740, and a third mounting bracket 756 on another face, which, in the example shown is square to the first face. Each of mounting brackets 752, 754, 756 may be taken as being the same as mounting brackets 702, 704, with retainer clips 758 the same as retainers 706. Masonry support member 760 differs from previously described shelf angles herein, and from masonry support member 710, in having a corner formed therein. That is, there is a first portion 762 of shelf member 760 and a second portion 764 of shelf 760, the first and second portions meeting at, or forming, a corner. In the embodiment shown the corner is a square corner. Support member 760 includes first and second vertical back or web members 772 and 774 that are bent up from portions 762 and 764 respectively, and provided with pairs of apertures 766, 768 to accommodate the toes of brackets 752, 754, 756.

Whereas in the flexible shelf angle of FIGS. 1*a*-1*c* the web is continuous and the horizontal shelf is discontinuous (it is segmented by notches), in assembly 750 the shelf is continuous but the web, made of web members 772, 774, is split or segmented, or discontinuous, to suit use in the abrupt corner installation of structure 740 where there is no smooth, large radius to which a continuously arcuate web could conform, and where, if a sharp corner were made as a bend between segments, there would be no support for the bricks or other masonry veneer installed at the corner. Assembly 750 provides a continuous shelf that reaches out laterally from web members 772 and 774 to provide support in the shared corner. Since mounting bracket 756 is on the second wall face of pillar or column 740, it is non-coplanar with mounting brackets 752, 754. That is, mounting brackets 752, 754 are mounted in the vertical plane of the first face of column 740, and mounting bracket 756 is mounted in the vertical plane of the second face of column 740. Those faces lie in different planes, and, in the example shown, those planes meet at a right-angle such that the faces are square to each other. It follows that the vertical webs or backs 772, 774 of the corresponding portions of the shelf angle are also not co-planar, since it is convenient that the vertical webs of the shelf angle be stepped away from the column faces in a constant offset, that offset typically corresponding to the thickness of an insulation panel 56 mounted in the spaced gap created by the length of the leg of the mounting bracket, as in FIG. 2*a* above. Layers of insulation 56 as shown in FIG. 2*a* may be included in any of the embodiments described herein, as suitable. In this example, first leg 776 of first portion 762 terminates laterally at a square cornered wing extension 782 that has a shelf extension wing 770 that extends past the far edge of web member 772 and has rectangular edges as seen in plan form in FIG. 29*a*. Shelf extension wing 782 has a portion 784 lying rearwardly of the profile of back or web 772. By contrast, second leg 778 of second portion 764 of support member 760 has a curved profile leading to an end wing extension 780 that extends past the far edge of web member 774, such as may correspond to the profile of each of legs 732, 734 and wings 722, 724. The corner assembly shown is asymmetric. However it could have the same shape wing extension on both sides, could be of opposite hand, and could be symmetric.

Although only the corner assemblies are shown, masonry support assemblies 700 and 750 could have laterally longer legs, or could be mounted adjacent to straight shelf angle assemblies or to flexible contour-following shelf angle assemblies such as seen in FIGS. 1*a*-1*c* hereinabove. In each case, the masonry support shelf surface extends laterally beyond the edge of the vertical leg. Also, in each case shown, the lateral wing extension extends behind the plane (or behind the tangent plane) of the profile of the associated vertical leg. A corner formation of this nature may be used where the primary support structure has a corner that could not be followed by a smoothly bending shelf angle such as shown in FIG. 1*a*. The corner may terminate at a door or window where the masonry veneer is to be square to the window or door, or such other architectural feature as may be. In as much as this feature may be associated with a window or door where there is a vertical height difference from a supporting floor slab, or steel frame girder or post, while mounting brackets 702, 704, 752, 754 and 756 are shown as standard height mounting brackets they could also be long-legged brackets as shown other embodiments described herein, as suitable.

Various embodiments of the invention have been described in detail. As explained, the various embodiments described address one or more of the various problems and challenges of dealing with with curved walls and with discontinuities or interruptions in a wall structure such as corners, windows, doors, the desirability of reducing heat transfer, the facilitation of manufacturing, and so on. Since changes in and or additions to the above-described best mode may be made without departing from the nature, spirit or scope of the invention, the invention is not to be limited to those details but only by the appended claims.

We claim:

1. A masonry veneer support shelf angle for mounting to stand away from supporting wall structure, and upon which to mount masonry veneer face brick having a face brick depth, said shelf angle being a steel angle iron having an upstanding web and a flange, said flange extending away from said web a length greater than said face brick depth, said shelf angle being operable to carry an eccentrically applied moment couple of the masonry veneer, said flange defining a shelf upon which to place the masonry veneer, said flange being segmented into a plurality of segments that, as installed, extend away from the wall structure and upon which masonry veneer face brick sits, and said web being bendable.

2. The shelf angle of claim 1 wherein said plurality of segments of said flange includes at least a first segment and a second segment, said first and second segments being side-by-side, said flange having a notch formed therein between said first and second segments.

3. The shelf angle of claim 2 wherein said notch terminates inwardly at said web at a narrow end, and said notch broadens outwardly away from said narrow end.

4. The shelf angle of claim 1 wherein each segment of said plurality of segments has a broad end adjoining said web, and a narrow end most distant from said web.

5. The shelf angle of claim 1 wherein said web is mounted to run on a continuous curve when seen in plan view, and said segmented flange has a plurality of toes defining said segments of said flange, said toes defining a discontinuous path of shelf supports alongside said web.

6. The shelf angle of claim 5 wherein:

said angle iron has a lengthwise direction and a respective arc length pitch spacing between said plurality of toes;

said plurality of toes includes a first toe and a second toe, and there is a notch formed between said first toe and said second toe, by which they are separated from each other; and said notch is smaller in width in the lengthwise direction of said angle iron than (a) half a brick; and (b) ¼ of the arc length pitch spacing of the web between centers of adjacent segments of said flange.

7. The shelf angle of claim 1 wherein said web has apertures formed therein in which to admit mounting support fittings; said mounting support fittings are spaced along said web lengthwise; said flange has notches formed therein, said notches being spaced along said shelf angle; and said apertures in said web are staggered from said notches in said flange.

8. The shelf angle of claim 7 wherein said notches formed in said flange include a pair of first and second notches and a first segment; said pair of first and second notches is associated with said first segment of said flange, and one of said apertures is centered relative to said first segment.

9. The masonry veneer support shelf angle of claim 1, further comprising:

a first member and a second member, said first member being said flange, said flange being an horizontal leg of said shelf angle, said second member being said web, said web being a vertical leg of said shelf angle;

said vertical leg and said horizontal leg meet at a right angle;

there is an internal radius between said vertical leg and said horizontal leg;

said shelf angle has a material thickness of at least ¼ inch;

said first member defines a shelf upon which to place masonry veneer;

a first of said segments of said first member defines a toe extending away from said vertical leg;

said toe having a root proximate to said vertical leg and a tip distant therefrom; and in plan view said toe narrows from said root to said tip.

10. The masonry veneer support shelf angle of claim 9 wherein said shelf angle is made from a rolled steel angle iron.

11. The masonry veneer support angle of claim 9 wherein said vertical leg of said shelf angle has an aperture formed therein upwardly of said internal radius.

12. The masonry veneer support angle of claim 9 wherein said toe is a first toe and a second of said segments of said shelf angle defines a second toe located beside said first toe; there is a notch between said first toe and said second toe, and said notch has a narrow end near to said vertical leg and a wide end distant from said vertical leg.

13. The masonry veneer support angle of claim 12 wherein said vertical leg defined by said web follows a curve and said first and second toes are angled relative to each other.

14. The masonry veneer support shelf angle of claim 9 wherein said toe is a first toe, and shelf angle has a second toe and a third toe, said second toe being located between said first toe and said third toe, there being a first notch between said first toe and said second toe and a second notch between said second toe and said third toe; said first toe, said second toe and said third toe all extending in an horizontal plane away from said vertical leg of said shelf angle; and said web being bendable such that, on installation, said web is curved and said first, second, and third toes point in different directions in said horizontal plane.

* * * * *